US010887951B2

(12) United States Patent
Kim et al.

(10) Patent No.: US 10,887,951 B2
(45) Date of Patent: Jan. 5, 2021

(54) COOKING APPARATUS AND METHOD OF CONTROLLING THE SAME

(71) Applicant: Samsung Electronics Co., Ltd, Gyeonggi-do (KR)

(72) Inventors: Hyo Suk Kim, Hwaseong-si (KR); Jeong Heon Kim, Suwon-si (KR); Hwa-Sung Kim, Yongin-si (KR); Chang Hyun Park, Suwon-si (KR); O Do Yu, Hwaseong-si (KR); Su-Ho Jo, Yongin-si (KR); Jong Hun Ha, Hwaseong-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 234 days.

(21) Appl. No.: 15/861,448

(22) Filed: Jan. 3, 2018

(65) Prior Publication Data

US 2018/0192480 A1 Jul. 5, 2018

(30) Foreign Application Priority Data

Jan. 3, 2017 (KR) ..... 10-2017-0000762

(51) Int. Cl.
*H05B 6/12* (2006.01)
*H05B 6/06* (2006.01)

(52) U.S. Cl.
CPC ..... *H05B 6/1218* (2013.01); *H05B 6/062* (2013.01)

(58) Field of Classification Search
CPC .. H05B 6/12; H05B 6/1218; H05B 2206/022; H05B 2213/05; H05B 2213/06; H05B 6/1236; H05B 2213/07; H05B 6/1245; F24C 7/04; F24C 15/10
See application file for complete search history.

(56) References Cited

U.S. PATENT DOCUMENTS

2006/0091135 A1 5/2006 Kondo et al.
2012/0118281 A1 5/2012 Shigeoka et al.
2015/0351163 A1* 12/2015 Kim ..... H05B 6/1218 99/342

(Continued)

FOREIGN PATENT DOCUMENTS

EP 2950614 A1 12/2015
JP 2009289466 A 12/2009

(Continued)

OTHER PUBLICATIONS

Communication from a foreign patent office in a counterpart foreign application, ISA/KA, "International Search Report," International Application No. PCT/KR2018/000112, dated Apr. 27, 2018, 3 pages.

(Continued)

*Primary Examiner* — Brian W Jennison

(57) ABSTRACT

Disclosed are a cooking apparatus and a method of controlling the same. The cooking apparatus includes a plurality of light sources configured to emit light toward a cooking container and grouped into a plurality of groups and a light emission driving controller configured to perform control in a manner that flame images are displayed by performing group controlling on the basis of at least one of a control command input by a user, a grouping form of the plurality of groups and a preset operation pattern.

20 Claims, 63 Drawing Sheets

(56) References Cited

U.S. PATENT DOCUMENTS

2017/0196049 A1* 7/2017 Kim ..... H05B 6/12

FOREIGN PATENT DOCUMENTS

| | | | |
|---|---|---|---|
| KR | 1006280800000 | B1 | 9/2006 |
| KR | 10-2015-0137802 | A | 12/2015 |
| KR | 10-2015-0137803 | A | 12/2015 |
| KR | 10-2015-0137837 | A | 12/2015 |

OTHER PUBLICATIONS

Supplementary European Search Report in connection with European Application No. 18736590.3 dated Nov. 15, 2019, 8 pages.

* cited by examiner

COOKING APPARATUS AND METHOD OF CONTROLLING THE SAME

CROSS-REFERENCE TO RELATED APPLICATION

This application is related to and claims priority to Korean Patent Application No. 10-2017-0000762 filed on Jan. 3, 2017, the disclosure of which is incorporated herein by reference.

TECHNICAL FIELD

Embodiments of the present disclosure relate to a cooking apparatus, and more particularly, to a cooking apparatus configured to allow a user to easily check an operation state of the cooking apparatus.

BACKGROUND

Generally, an induction heating cooking apparatus is a cooking apparatus configured to heat and cook food using an induction heating principle. The induction heating cooking apparatus includes a cooking top on which a cooking container is disposed and an induction coil that generates a magnetic field when a current is applied thereto.

When a current is applied to the induction coil and a magnetic field is generated, a secondary current is induced to the cooking container and Joule's heat is generated by a resistance component of the cooking container. Accordingly, the cooking container is heated and food in the cooking container is cooked.

When compared to a gas stove, a portable kerosene cooking stove, and the like, which heat a cooking container using combustion heat due to a fossil fuel such as a gas, an oil, and the like, being combusted, the induction heating cooking apparatus has advantages of rapid heating without occurrence of harmful gas and the danger of fire. However, since the induction heating cooking apparatus does not generate flames while heating a cooking container, it is difficult to intuitively recognize a heated state of the cooking container from the outside.

Meanwhile, a level meter type digital display may be provided at an induction heating cooking apparatus to display a heated state of a cooking container. However, since the digital display has a low recognition property, when a user is farther than a certain distance from the induction heating cooking apparatus or does not carefully observe the digital display, it is difficult to recognize the heated state and to provide an instantaneous sense to the user even when the heated state is recognized.

SUMMARY

To address the above-discussed deficiencies, it is a primary object to provide a cooking apparatus that displays a virtual flame image on the cooking apparatus.

Additional aspects of the present disclosure will be set forth in part in the description that follows and, in part, will be obvious from the description, or may be learned by practice of the present disclosure.

In accordance with one aspect of the present disclosure, a cooking apparatus includes a plurality of light sources configured to emit light toward a cooking container and grouped into a plurality of groups; and a light emission driving controller configured to perform control such that flame images are displayed by performing group controlling on the basis of at least one of a control command input by a user, a grouping form of the plurality of groups, and a preset operation pattern.

Each of the plurality of light sources may include at least one of a sub light source that outputs blue light and a sub light source that outputs red light.

Each of the plurality of light sources may include one or more sub light sources, and the one or more sub light sources may be connected to the light emission driving controller through one input end.

The light emission driving controller may set a phase difference or a time difference between driving signals applied to the plurality of groups according to the grouping form of the plurality of groups.

When an operation initiation command is input by the user, the light emission driving controller may perform control such that a flame image is displayed by applying a driving signal with respect to at least one group preset among the plurality of groups, and may sequentially apply the driving signal in a preset direction.

When an operation stop command is input by the user, the light emission driving controller may stop applying a driving signal with respect to at least one group preset among the plurality of groups, and may sequentially stop applying the driving signal in a preset direction.

When a command for adjusting an output level is input by the user, the light emission driving controller may simultaneously apply driving signals, which are adjusted corresponding to the received command for adjusting the output level, to the plurality of groups, or may sequentially apply the adjusted driving signals according to a preset sequence.

When an output level input by the user is a preset output level or below, the light emission driving controller may stop applying a driving signal with respect to at least one of the plurality of groups.

When an output level input by the user is a preset output level or below, the light emission driving controller may stop applying a driving signal with respect to any one of the plurality of groups and may apply a driving signal adjusted corresponding to the received output level with respect to another group.

The cooking apparatus may further include a lens configured to concentrate the light output from each of the plurality of light sources. Here, the number of focuses provided on the lens may be previously designed corresponding to the number of sub light sources included in each of the light sources.

When a malfunction occurs during operation, the light emission driving controller may stop applying a driving signal to at least one of the plurality of groups, or may control the application of the driving signal to allow the at least one group to output red light.

In accordance with another aspect of the present disclosure, a method of controlling a cooking apparatus includes calculating a driving output value with respect to a plurality of light sources on the basis of at least one of a control command input by a user, a grouping form of a plurality of groups, into which the plurality of light sources are divided, and a preset operation pattern, and performing control such that a flame image is displayed on the basis of the calculated driving output value.

Each of the plurality of light sources may include one or more sub light sources, and the one or more sub light sources may be connected in series through one line.

The calculating may include setting a phase difference or a time difference between driving signals applied to the plurality of groups according to the grouping form of the plurality of groups.

The performing of control may include, when an operation initiation command is input by the user, performing control such that the flame image is displayed by applying a driving signal with respect to at least one group preset among the plurality of groups and sequentially applying the driving signal in a preset direction.

The performing of control may include, when an operation stop command is input by the user, performing control such that application of a driving signal with respect to at least one group preset among the plurality of groups is stopped and control such that the application of the driving signal is sequentially stopped in a preset direction.

The performing of control may include, when a command for adjusting an output level is input by the user, performing control such that driving signals, which are adjusted corresponding to the received command for adjusting the output level, are simultaneously applied to the plurality of groups, or the adjusted driving signals are sequentially applied according to a preset sequence.

The performing of control may include, when an output level input by the user is a preset output level or below, performing control such that application of a driving signal with respect to at least one of the plurality of groups is stopped.

The performing of control may include, when an output level input by the user is a preset output level or below, performing control such that an application of a driving signal with respect to any one of the plurality of groups is stopped and a driving signal adjusted corresponding to the received output level is applied to another group.

The performing of control may include, when a malfunction occurs during operation, performing control such that an application of a driving signal to at least one of the plurality of groups is stopped or control of the application of the driving signal to allow the at least one group to output red light.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1 through 50, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

A cooking apparatus described below refers to an apparatus that heats food using an induction heating principle and includes a cooking top on which a cooking container is located and an induction coil that generates a magnetic field when a current is applied thereto.

Hereinafter, as one example of the embodied cooking apparatus, a cooking apparatus according to various embodiments shown in FIG. 1 will be described. However, embodiments that will be described below are not limited thereto and may be applied to all of a variety of well-known cooking apparatuses capable heating a cooking container by generating a magnetic field using an induction coil.

Figure 1:
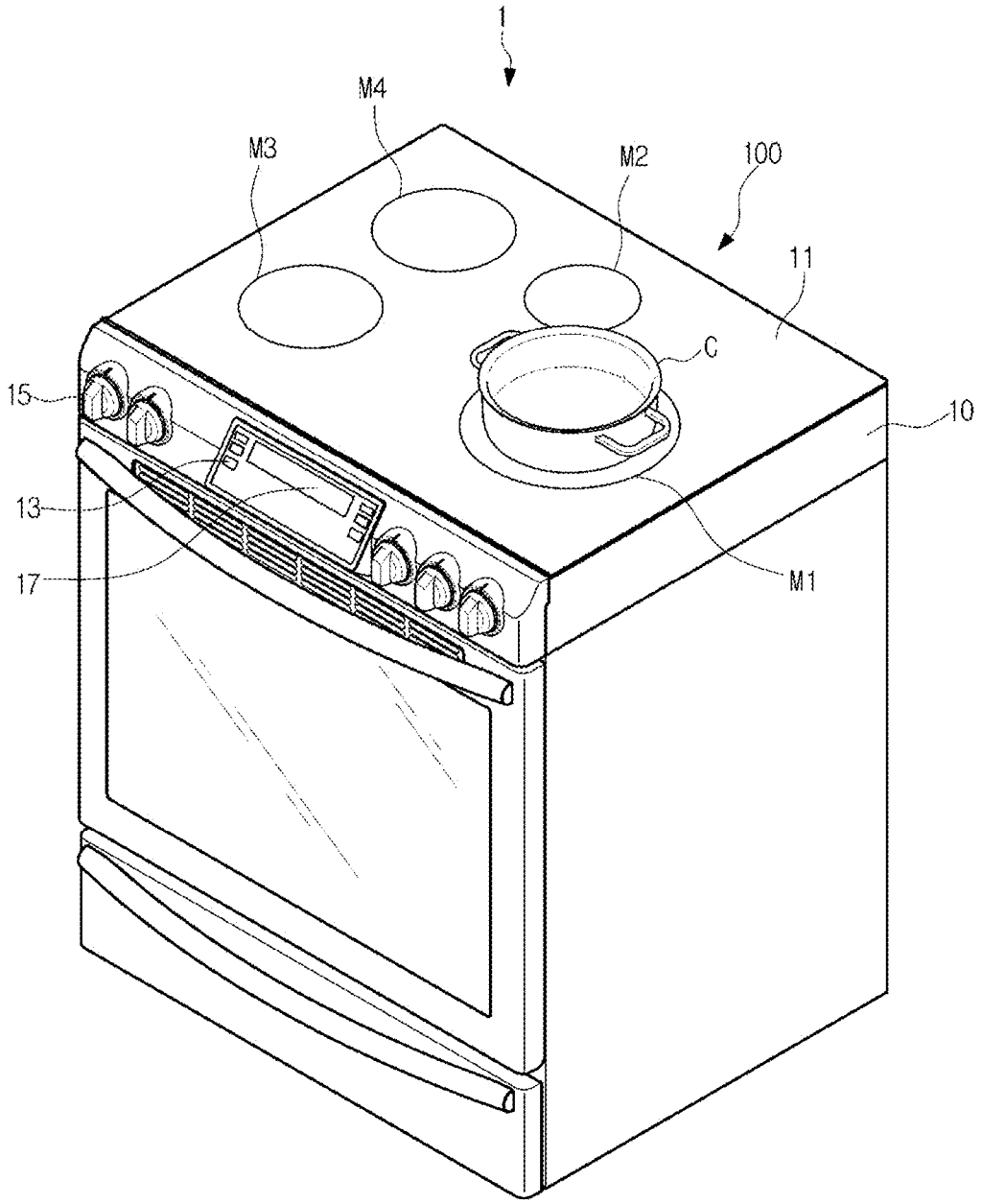
FIG. 1 is a view schematically illustrating an external shape of a cooking apparatus according to various embodiments.
Figure 2:
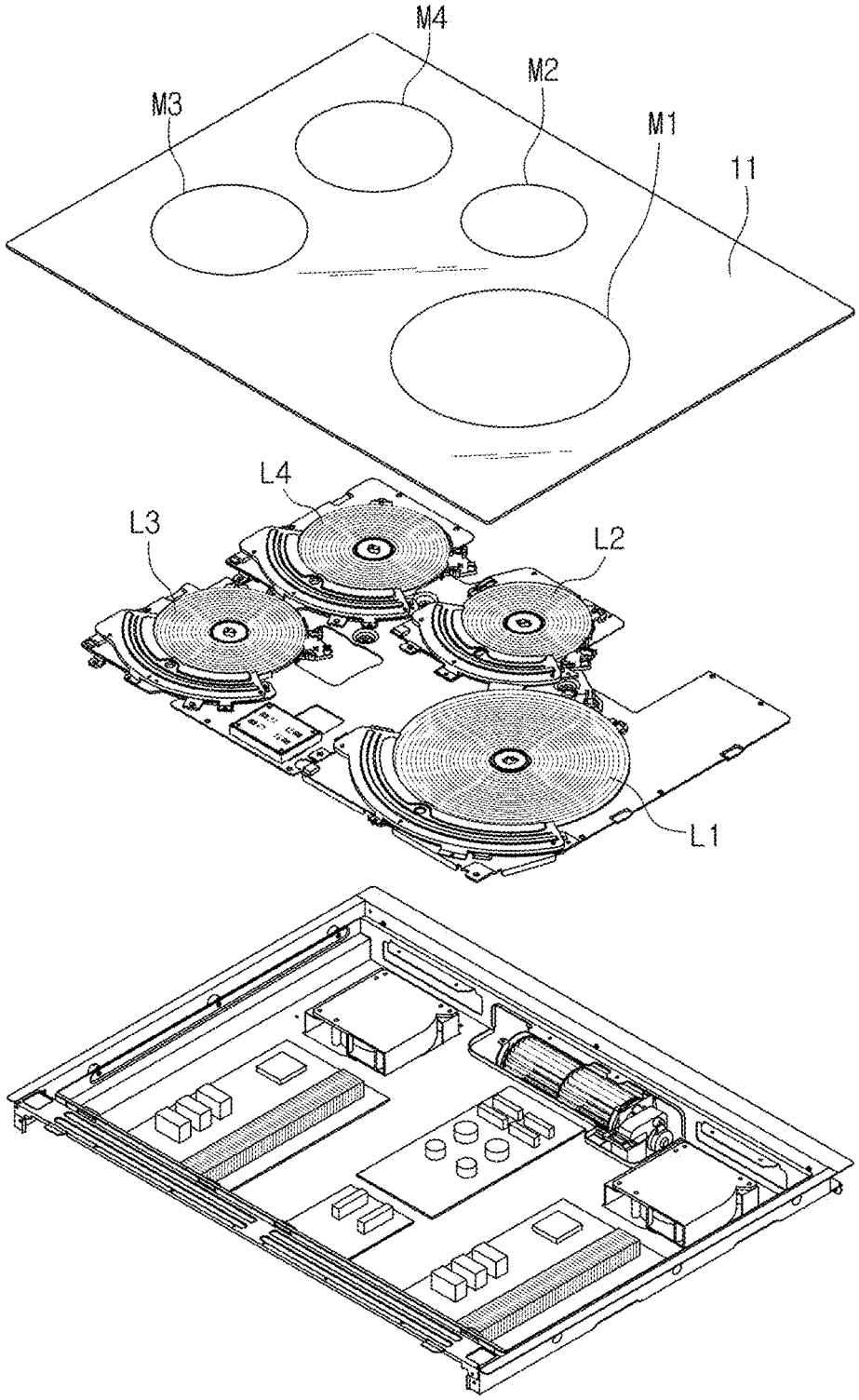
FIG. 2 is a view schematically illustrating an inside of the cooking apparatus according to various embodiments.
Figure 3:
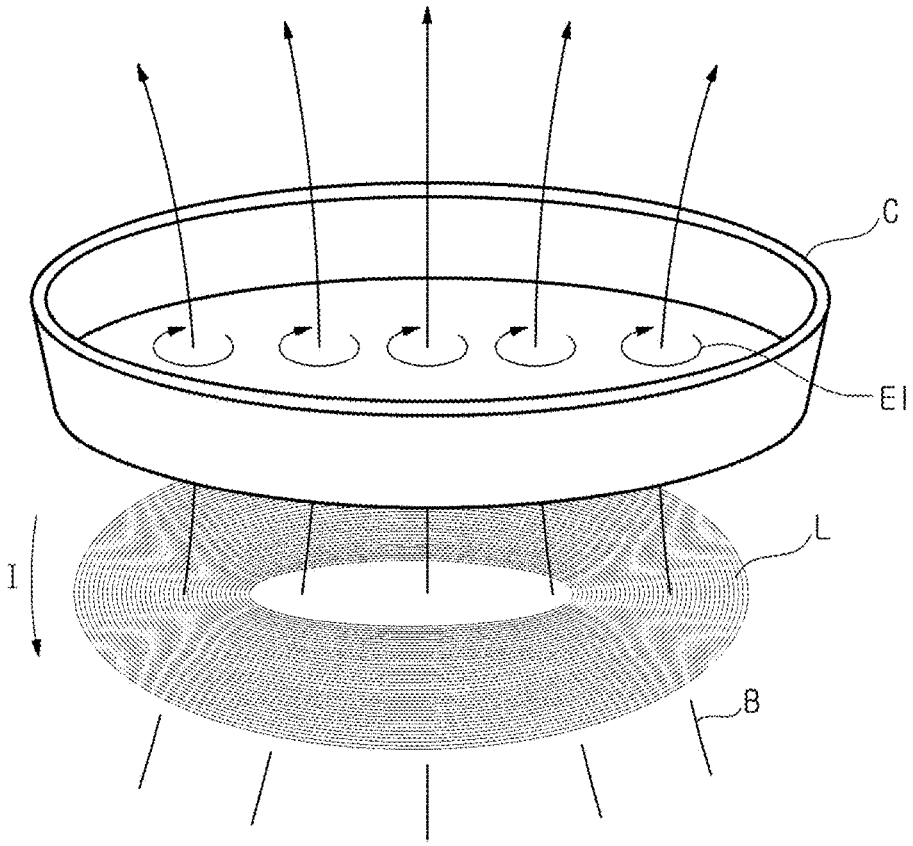
FIG. 3 is a view illustrating a principle of heating a cooking container by the cooking apparatus according to various embodiments.
Figure 4:
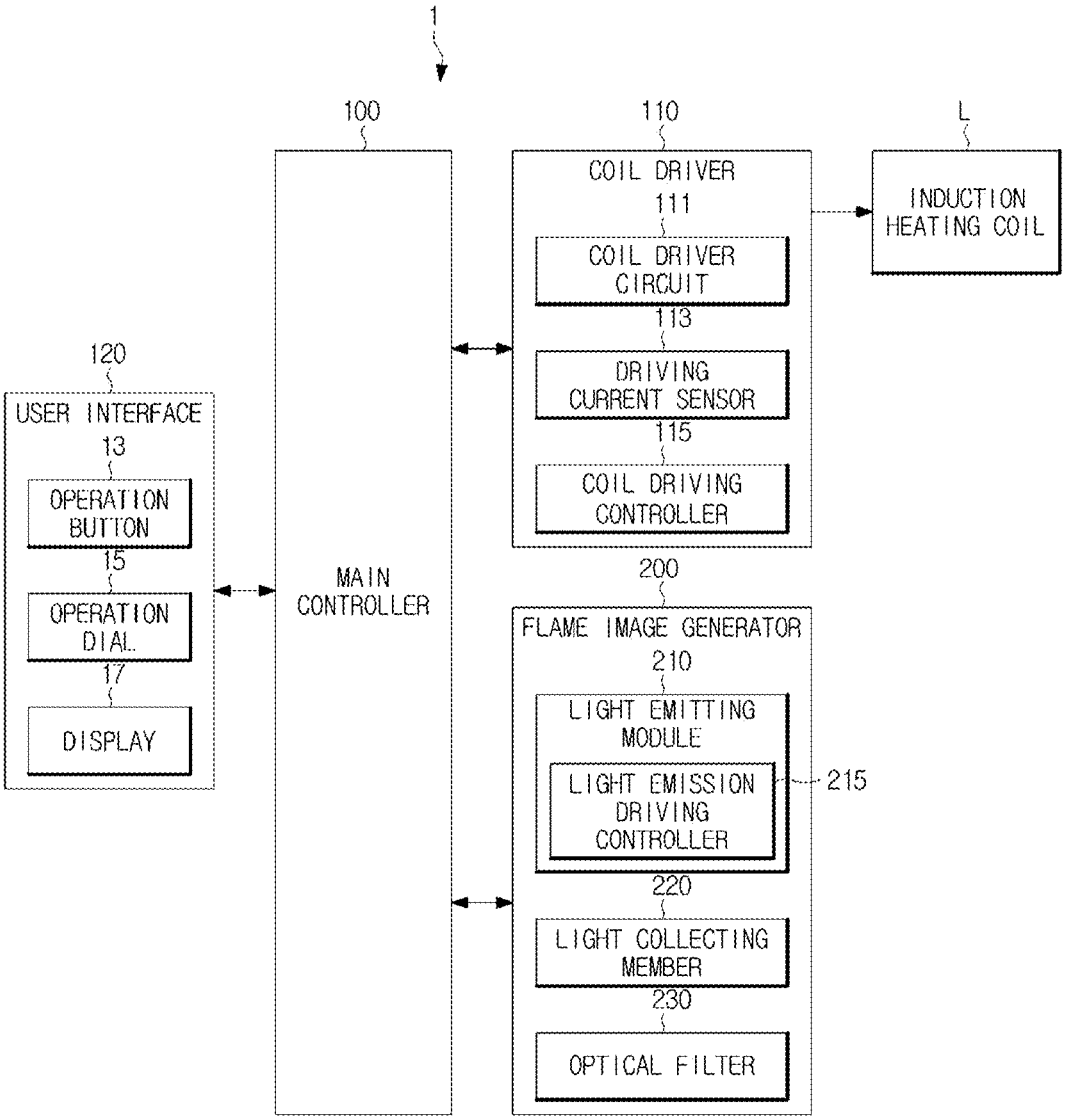
FIG. 4 is a schematic control block diagram of the cooking apparatus according to various embodiments.
Figure 5A:
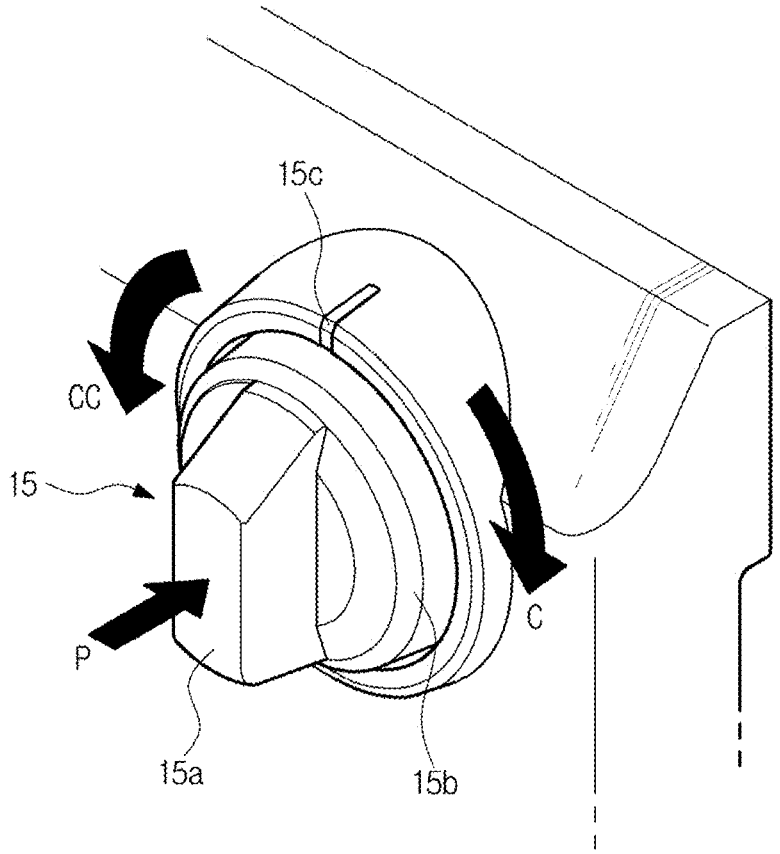
FIGS. 5A and 5B are views illustrating user interfaces included in cooking apparatuses according to different embodiments.
Figure 5B:
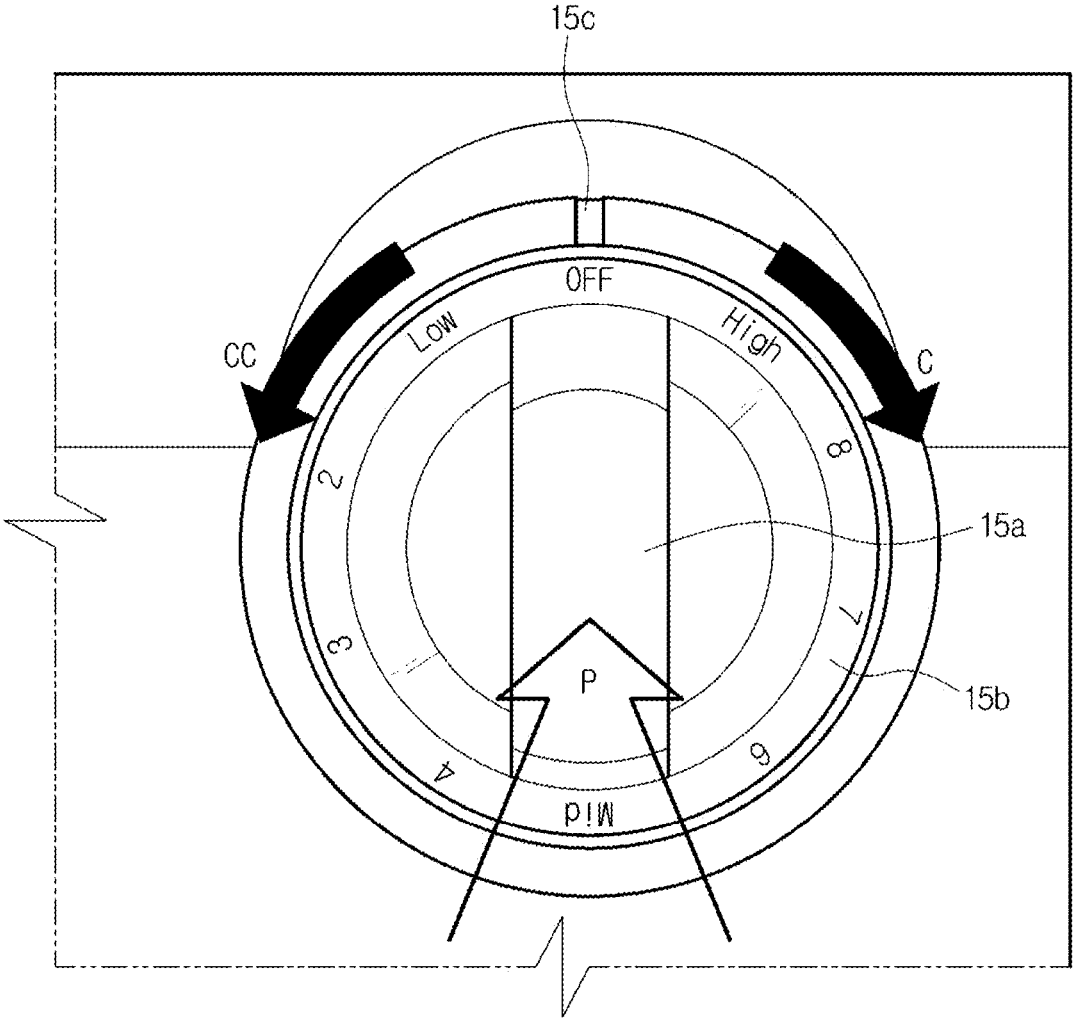
Figure 6:
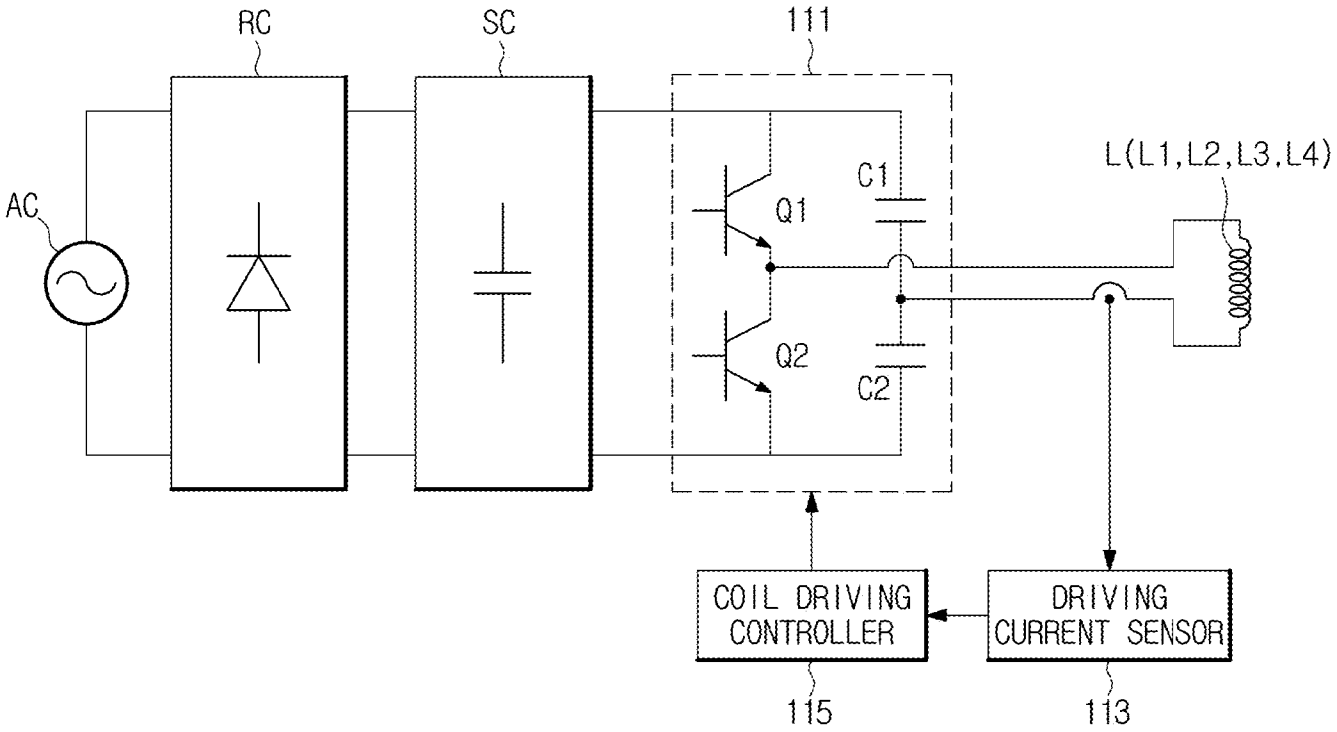
FIG. 6 is a view illustrating a configuration of a coil driver included in the cooking apparatus according to various embodiments.

FIG. 1 is a view schematically illustrating an external shape of a cooking apparatus according to various embodiments, and FIG. 2 is a view schematically illustrating an inside of the cooking apparatus according to various embodiments. Also, FIG. 3 is a view illustrating a principle of heating a cooking container by the cooking apparatus according to various embodiments, and FIG. 4 is a schematic control block diagram of the cooking apparatus according to various embodiments. Also, FIGS. 5A and 5B are views illustrating user interfaces included in cooking apparatuses according to different embodiments, and FIG. 6 is a view illustrating a configuration of a coil driver included in the cooking apparatus according to various embodiments. Hereinafter, they will be described together to avoid a repetition of description.

Referring to FIGS. 1 to 6, a cooking apparatus 1 includes a body that forms an external shape and accommodates a variety of components that form the cooking apparatus 1 therein.

A cooking plate 11 for positioning a cooking container C may be provided on a top surface of the body 10. The cooking plate 11 may be formed of tempered glass such as ceramic glass not to be easily damaged but is not limited thereto and may be formed of a variety of well-known materials.

Also, a guide mark may be provided at a top surface of the cooking plate 11 for a user to dispose the cooking container C to a proper position. For example, as shown in FIG. 1, a plurality of guide marks M1, M2, M3, and M4 for guiding a user to a position of the cooking container C may be formed on the top surface of the cooking plate 11.

At least one induction heating coil that generates a magnetic field may be provided below the cooking plate 11. For example, the cooking apparatus 1, as shown in FIG. 2, may include a plurality of induction heating coils L1, L2, L3, and L4. The plurality of induction heating coils L1, L2, L3, and L4 may be provided at positions corresponding to the guide marks M1, M2, M3, and M4, respectively.

The cooking apparatus 1 according to various embodiments includes the four induction heating coils L1, L2, L3, and L4 but is not limited thereto and may include three or less or five or more induction heating coils without a limit.

As shown in FIG. 3, when a current is supplied to an induction heating coil L, a magnetic field B that passes through an inside of the induction heating coil L is induced. For example, when a current that changes according to time, that is, an alternating current (AC) is supplied to the induction heating coil L, the magnetic field that temporally changes may be induced at an inside of the induction heating coil L. Accordingly, the magnetic field B induced by the induction heating coil L may pass through a bottom surface of the cooking container C.

When the magnetic field B, which temporally changes, passes through a conductor, a current EI that rotates around the magnetic field B may be generated at the conductor. Here, a phenomenon in which the rotating current EI is induced by the magnetic field that temporally changes is referred to as an electromagnetic induction phenomenon and the rotating current EI is referred to as an eddy current.

The electromagnetic induction phenomenon and the eddy current EI may be generated below the cooking plate 11. For example, when the magnetic field B generated by the induction heating coil L passes through the bottom surface of the cooking container C, the eddy current EI that rotates around the magnetic field B is generated in the bottom surface of the cooking container C.

The cooking container C may be heated by the eddy current EI. For example, when the eddy current EI flows through the cooking container C having electrical resistance, heat is generated according to the eddy current EI and the electrical resistance of the cooking container C. Accordingly, the cooking apparatus 1 according to various embodiments may supply currents to the first to fourth induction heating coils L1, L2, L3, and L4 and may heat the cooking container C using the magnetic field B induced by the first to fourth induction heating coils L1, L2, L3, and L4.

Also, a user interface 120 including an operation dial 15, which receives a control command from a user, may be provided at a front surface of the body 10. The user interface 120 will be described below in detail.

Meanwhile, referring to FIG. 4, the cooking apparatus 1 may include the user interface 120 that interacts with a user, the induction heating coil L, a coil driver 110 that supplies a driving current to the induction heating coil L, a flame image generator 200 that generates a flame image, and a main controller 100 that controls an overall operation of the cooking apparatus 1.

For example, the main controller 100, a coil driving controller 115 of the coil driver 110, and a light emission driving controller 215 of the flame image generator 200 may be included as separate components on the cooking apparatus 1 as shown in FIG. 4 and may be operated by a processor.

As another example, at least one of the main controller 100, the coil driving controller 115 of the coil driver 110, and the light emission driving controller 215 of the flame image generator 200 may be integrated on a system on chip (SOC) and may be operated by a processor. Here, the number of SOCs built in the cooking apparatus 1 may not be only one, and the components are not limited to being integrated on one SOC. Hereinafter, the components of the cooking apparatus 1 will be described.

The user interface 120 may receive a control command from a user and may transmit an operation signal corresponding to the received control command to the main controller 100. The user interface 120 may be provided at the front surface of the body 10 as described above but is not limited thereto. For example, the user interface 120 may be provided at any positions in the cooking apparatus 1, which are positions for easily receiving a variety of control commands from the user, and there is no limitation.

The user interface 120 may receives not only a variety of control commands such as an input pf power, initiation/stop of operation, and the like from the user but also a command for adjusting an output level to adjust strength of the magnetic field B generated by each of the first to fourth induction heating coils L1, L2, L3, and L4.

Here, the output level may refer to discrete classification of the strength of the magnetic field generated by each of the first to fourth induction heating coils L1, L2, L3, and L4. For example, as the output level is higher, each of the first to fourth induction heating coils L1, L2, L3, and L4 may generate a greater magnetic field such that the cooking container C may be more quickly heated.

As various embodiments, the user interface 120 may include an operation button 13 that receives control commands such as the input of power, initiation/stop of operation, and the like from the user and the operation dial 15 that receives the output level from the user.

The operation button 13 may be embodied using a variety of well-known switches such as a push switch, a micro switch, a membrane switch, and a touch switch, and the like and there is no limitation.

The operation dial 15, as shown in FIG. 5A, may include a holder 15*a* formed to protrude from the body 10, and an output level mark 15*b* that displays an output level may be formed on the periphery of the holder 15*a*. Also, an indicator mark 15*c* for indicating a selected output level may be formed at the body 10.

The user may adjust an output level by pressurizing the holder 15*a* toward the body 10 of the cooking apparatus 1 and then rotating the holder 15*a* clockwise C or counterclockwise CC.

For example, when the user rotates the holder 15*a* clockwise C or counterclockwise CC, the output level mark 15*b* may rotate with the holder 15*a* and one of a plurality of output levels displayed on the output level mark 15*b*, which meets the indicator mark 15*c*, may be input to the cooking apparatus 1. Then, the main controller 100 may not only adjust strength of a magnetic field to correspond to the received output level by controlling the coil driver 110 through a control signal but also display a flame image to correspond to the received output level by controlling the flame image generator 200. A detailed description thereof will be described below.

As various embodiments, when the user rotates the holder 15*a* counterclockwise CC, as shown in FIG. 5B, output levels 1 to 9 meet the indicator mark 15*c* according to the rotation of the holder 15*a* and then one of the output levels 1 to 9 may be input to the cooking apparatus 1. In addition, when the user rotates the holder 15*a* clockwise C in an OFF state, a maximum output level may be input to the cooking apparatus 1.

In other words, when the user rotates the holder 15*a* counterclockwise CC in the OFF state, the output levels displayed on the output level mark 15*b* are sequentially input. When the user rotates the holder 15*a* clockwise C in the OFF state, the maximum output level may be immediately input.

Also, the user interface 120, as shown in FIG. 4, may further include a display 17 that displays operation information of the cooking apparatus 1.

For example, when an output level and an operation initiation command are input together from the user, the display 17 may display that the cooking apparatus 1 is operating and may display the received output level. Accordingly, the user may intuitively recognize an operation state of the cooking apparatus 1 through output level information displayed on the display 17.

The display 17 may be embodied by a liquid crystal display (LCD), a light emitting diode (LED), a plasma display panel (PDP), an organic light emitting diode (OLED), a cathode ray tube (CRT) and the like but is not limited thereto. Meanwhile, when the display 17 is embodied as a touch screen type, the display 17 may not only display a variety of pieces of information but also receive a variety of control commands from the user through various touch manipulations such as a touch, a click, a drag, and the like. In other words, when the display 17 is embodied as a touch screen type, the display 17 may perform functions of the operation button 13 and the operation dial 15.

Meanwhile, the cooking apparatus 1 may include the coil driver 110 that supplies a driving current to at least one of the plurality of induction heating coils L1, L2, L3, and L4 that generate the magnetic field B for heating the cooking container C.

The coil driver 110 may include a coil driver circuit 111 that supplies a driving current to the induction heating coil L, a driving current sensor 113 that detects the driving current supplied to the induction heating coil L, and the coil driving controller 115 that controls the coil driver circuit 111. Here, the coil driving controller 115, as shown in FIG. 4, may be provided as a separate component on the cooking apparatus 1. Otherwise, the coil driving controller 115 may be combined or integrated with the main controller 100 and there is no limitation in embodiable forms.

Each of the plurality of induction heating coils L1, L2, L3, and L4 may have a two-dimensional spiral shape and may generate the magnetic field B as described above.

The coil driver circuit 111 may supply a driving current to the induction heating coil L to enable the induction heating coil L to generate the magnetic field B. For example, the coil driver circuit 111 may supply a driving current that temporally changes, for example, an AC driving current to the induction heating coil L to generate the magnetic field B that temporally changes.

As various embodiments, the coil driver circuit 111 may convert direct current (DC) power to supply a driving current to the induction heating coil L. Here, the DC power, as shown in FIG. 6, may be generated by rectifying and smoothing AC power supplied from an external AC power using a rectifier circuit RC and a smoothing circuit SC.

The coil driver circuit 111 may be embodied as a half bridge shape as shown in FIG. 6 but is not limited thereto. The coil driver circuit 111 includes a pair of switches Q1 and Q2 connected in series and a pair of capacitors C1 and C2 connected in series, and the pair of switches Q1 and Q2 and the pair of capacitors C1 and C2 are connected in parallel. Also, both ends of the induction heating coil L may be connected to a node to which the pair of switches Q1 and Q2 are connected in series and a node to which the pair of capacitors C1 and C2 are connected in series.

The pair of switches Q1 and Q2 connected in series include an upper switch Q1 and a lower switch Q2, and the pair of capacitors C1 and C2 connected in series may include an upper capacitor C1 and a lower capacitor C2.

The coil driver circuit 111 may supply the AC driving current to the induction heating coil L depending on turning ON/OFF of the upper switch Q1 and the lower switch Q2. For example, when the upper switch Q1 is turned on and the lower switch Q2 is turned off, a driving current may be supplied to the induction heating coil L from the upper capacitor C1. The driving current here flows downward from a top of the induction heating coil L with respect to the shown in FIG. 6.

On the other hand, when the upper switch Q1 is turned off and the lower switch Q2 is turned on, a driving current may be supplied to the induction heating coil L from the lower capacitor C2. The driving current here flows upward from a bottom of the induction heating coil L with respect to the shown in FIG. 6.

The driving current sensor 113 may detect a driving current supplied to the induction heating coil L. For example, the driving current sensor 113 may include a current transfer CT that proportionally reduces a level of the driving current supplied to the induction heating coil L and an ampere meter that detects a proportionally reduced current level.

As another example, the driving current sensor 113 may detect a current value of a driving current using voltage drop generated at the shunt resistance, which is provided between the coil driver circuit 111 and the induction heating coil L. Here, a position of the shunt resistance is not limited to a position between the coil driver circuit 111 and the induction heating coil L. The shunt resistance may be positioned between the smoothing circuit SC and the coil driver circuit 111.

The coil driving controller 115 may generate a control signal and may control the coil driver circuit 111 through the generated control signal. For example, the coil driving controller 115 may include a processor capable of perform a variety of arithmetic operations and may further include a memory in which control data for controlling an operation of the coil driving controller 115 is stored. Here, the control data may be stored in a memory of the main controller 100.

The coil driving controller 115 may generate a control signal on the basis of the data stored in the memory and may control the coil driver circuit 111 according to the generated control signal. For example, the coil driving controller 115 may receive a control signal of the main controller 100 and may control the coil driver circuit 111 by generating a control signal on the basis thereof. As various embodiments, the coil driving controller 115 may alternately turn on/off the upper switch Q1 and the lower switch Q2 of the coil driver circuit 111 to supply an AC driving current to the induction heating coil L.

Also, the coil driving controller 115 may adjust a level of the driving current supplied to the induction heating coil L by adjusting a frequency that turns on/off the upper switch Q1 and the lower switch Q2, and strength of the magnetic field B generated by the induction heating coil L may be adjusted according to the level of the driving current supplied to the induction heating coil L.

Referring to FIG. 4, the flame image generator 200 that generates a flame image may be provided at the cooking apparatus 1. The flame image generator 200 may emit light toward the cooking container C according to a control signal of the main controller 100 to form a flame image at the cooking container C. The flame image generator 200 will be described below in detail.

Also, the main controller 100 that controls the overall operation of the cooking apparatus 1 may be provided at the cooking apparatus 1 as shown in FIG. 4.

The main controller 100 may generate a control signal and may control the components in the cooking apparatus 1 using the generated control signal. For example, the main controller 100 may include a processor capable of performing a variety of arithmetic operations and the memory in which control data for controlling the operation of the cooking apparatus 1 is stored. Accordingly, the main controller 100 may generate a control signal on the basis of the control data stored in the memory and may control the components in the cooking apparatus 1 using the generated control signal.

For example, the main controller 100 may determine whether a malfunction occurs during operation of the cooking apparatus 1. As various embodiments, the main controller 100 may receive a value of a driving current applied to the induction heating coil L, which is detected by the driving current sensor 113. According thereto, when the driving current value deviates from a normal range, the main controller 100 may determine there is generated a malfunction and may perform a corresponding measure process. Additionally, the main controller 100 may receive a variety of control signals or state information of the components provided at the cooking apparatus 1 and may determine whether there is generated a malfunction in operation of the cooking apparatus 1.

As various embodiments, the main controller 100 may control the flame image generator 200 using a control signal to allow some or all of light sources D to output red light. Otherwise, the main controller 100 may control the flame image generator 200 using a control signal not to allow some or all of light sources D to output light, that is, to allow some or all of light sources D to flicker. Meanwhile, the above-described operation of determining whether a malfunction occurs and operation of performing a corresponding measure may be directly performed by the flame image generator 200 and there is no limitation.

For example, the main controller 100 may control an operation state of the cooking apparatus 1 to be displayed on the display 17 of the user interface 120 through a control signal. As still another example, when an output level is input through the user interface 120, the main controller 100 may transmit a control signal to the coil driving controller 115 to generate the magnetic field B having strength corresponding to the received output level. Also, the main controller 100 may transmit a control signal to the flame image generator 200 to generate a flame image corresponding to the output level input through the user interface 120 as described above. Hereinafter, the flame image generator 200 will be described in detail.

Figure 7:
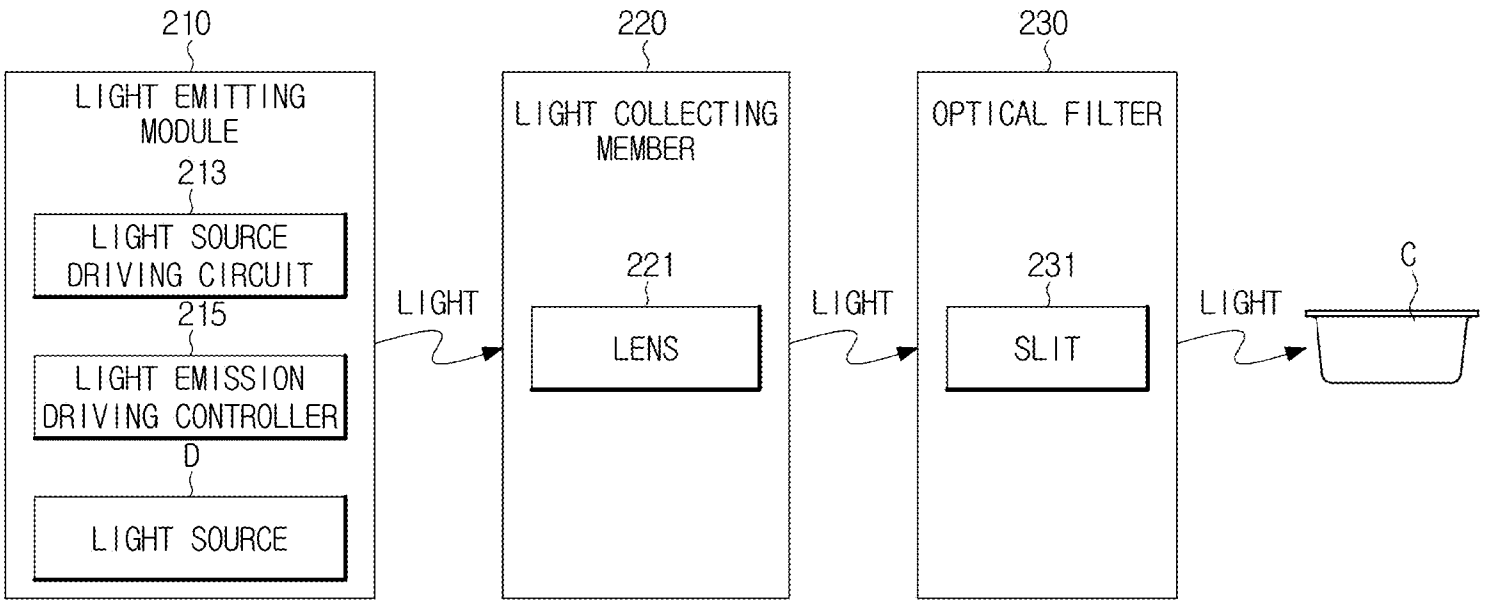
FIG. 7 is a schematic control block diagram illustrating a flame image generator of the cooking apparatus according to various embodiments.
Figure 8:
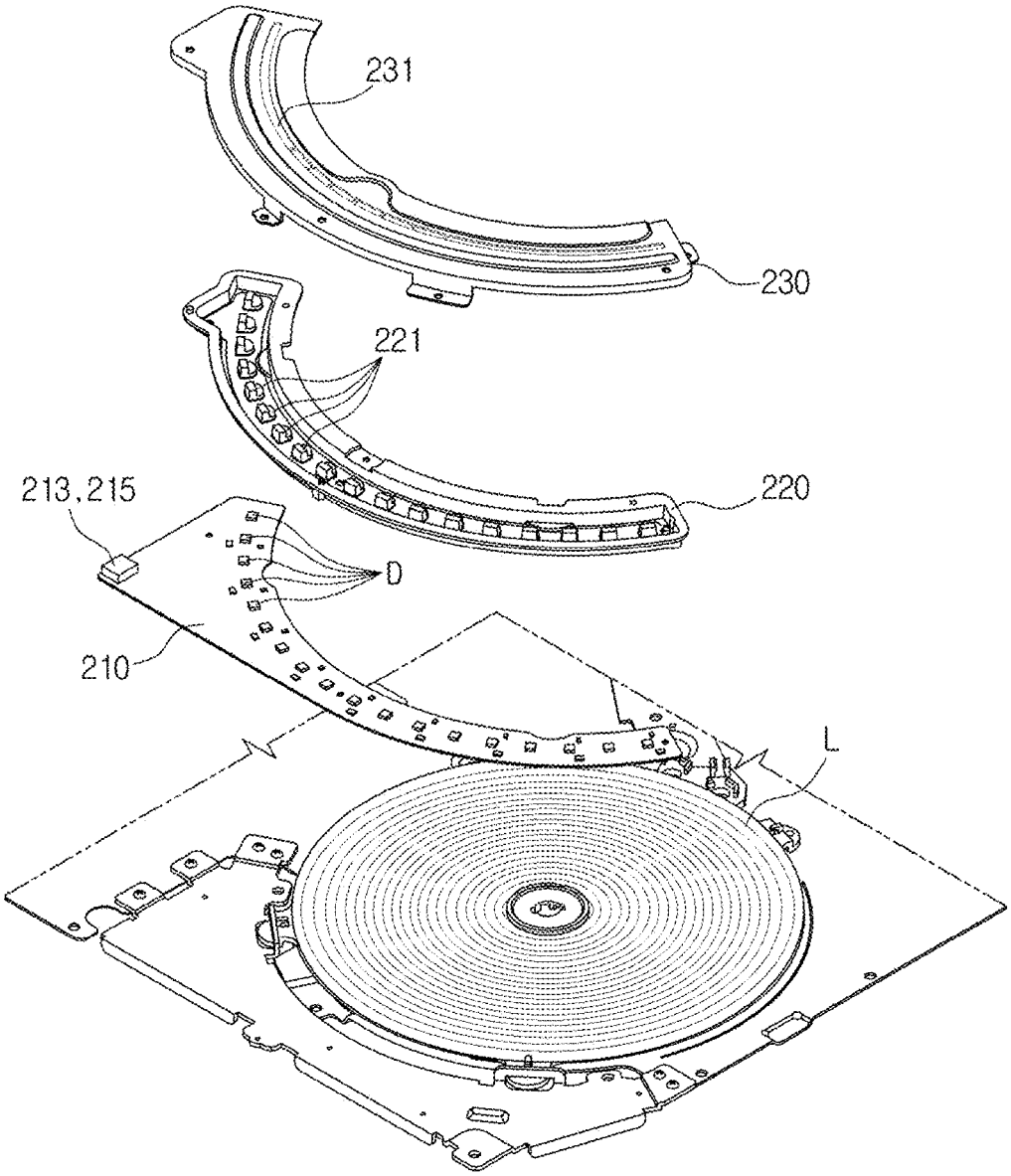
FIG. 8 is an exploded view illustrating the flame image generator of the cooking apparatus according to various embodiments.
Figure 9:
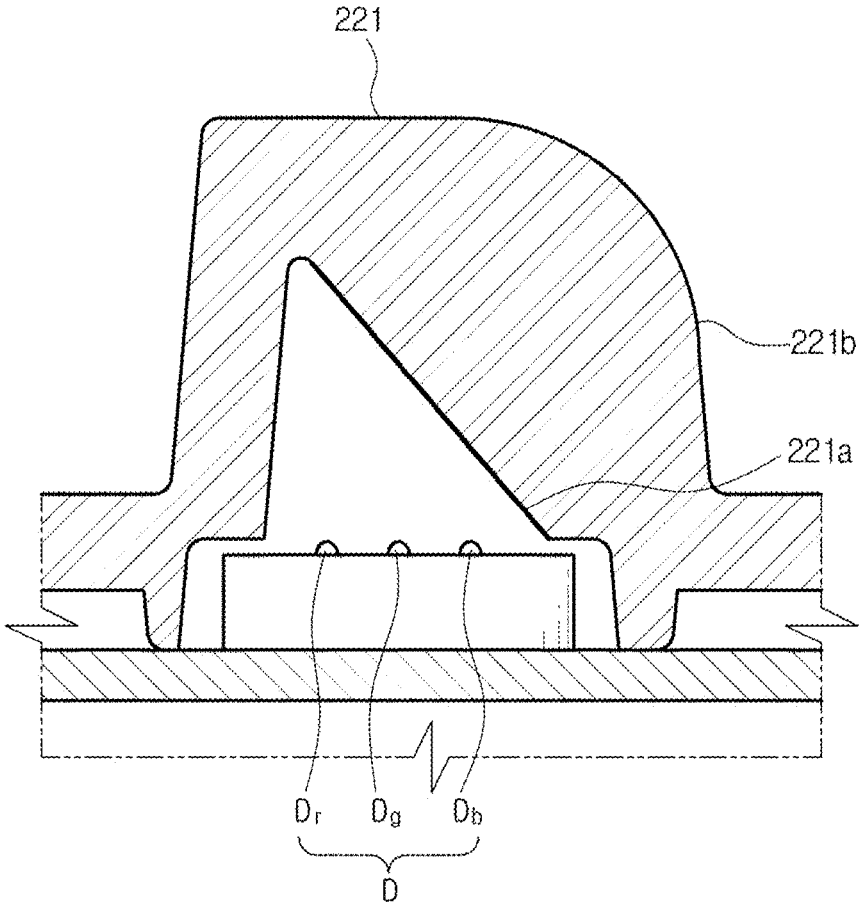
FIG. 9 is a view illustrating a light source including three sub light sources and an optical lens according to various embodiments.
Figure 10:
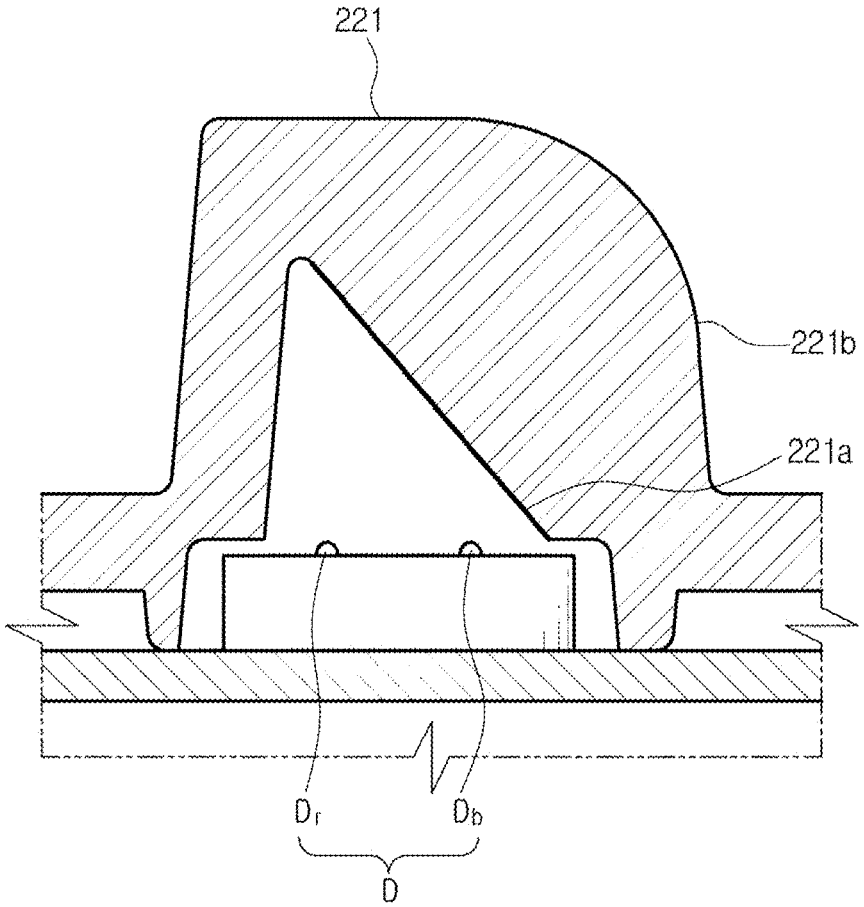
FIG. 10 is a view illustrating a light source including two sub light sources and an optical lens according to various embodiments.
Figure 11:
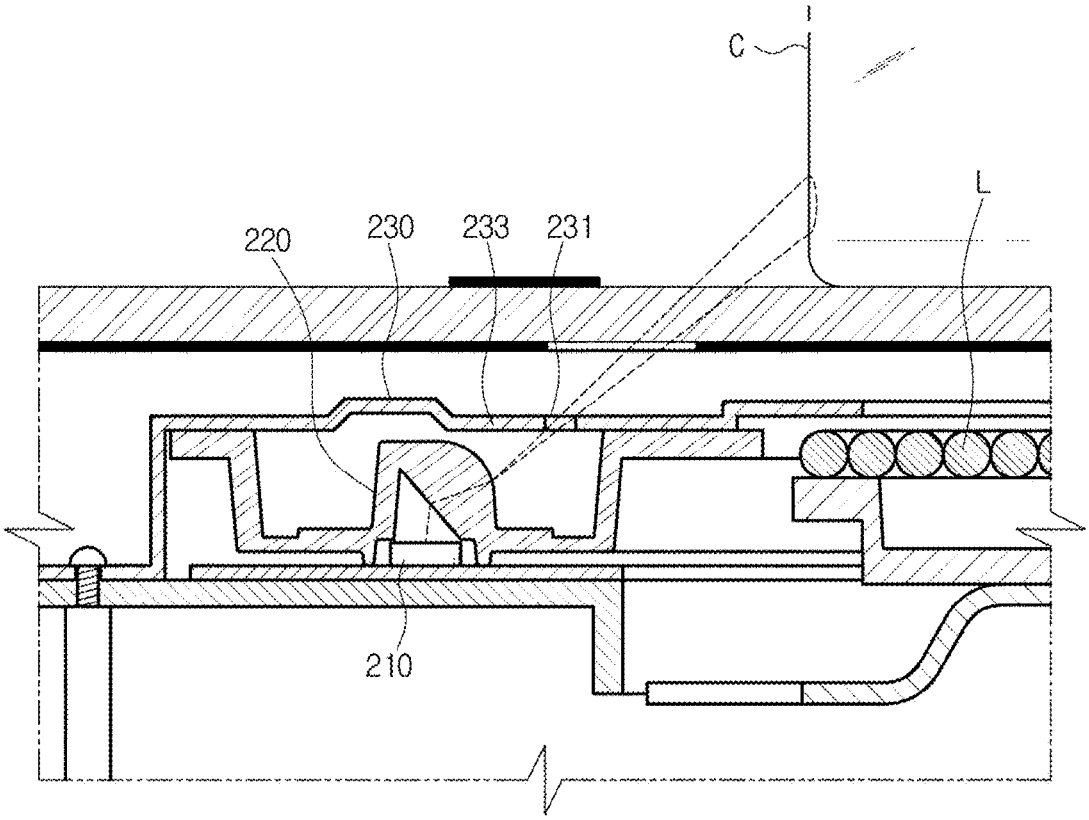
FIG. 11 is a view schematically illustrating a path of light emitted from a light source according to various embodiments.

FIG. 7 is a schematic control block diagram illustrating the flame image generator of the cooking apparatus according to various embodiments, and FIG. 8 is an exploded view illustrating the flame image generator of the cooking apparatus according to various embodiments. Also, FIG. 9 is a view illustrating a light source including three sub light sources and an optical lens according to various embodiments, FIG. 10 is a view illustrating a light source including two sub light sources and an optical lens according to various embodiments, and FIG. 11 is a view schematically illustrating a path of light emitted from the light source according to various embodiments. Hereinafter, they will be described together to avoid a repetition of description.

Referring to FIG. 7, the flame image generator 200 may include a light emitting module 210 that is provided on one side of the induction heating coil L and outputs light necessary for generating a flame image, a light collecting module 220 that refracts or totally reflects the light output from the light emitting module 210, and an optical filter 230 that selectively transmits light.

Here, the light emitting module 210 may include a light source D that outputs light, a light source driver circuit 213 that supplies a driving current to the light source D, and a light emission driving controller 215 that controls the light source driver circuit 213. Here, the light emission driving controller 215, as shown in FIG. 7, may be provided as a separate component on the cooking apparatus 1. Otherwise, the light emission driving controller 215 may be combined or integrated with the main controller 100 and there is no limitation.

A plurality of such light sources D may be provided as shown in FIG. 8. The plurality of light sources D may be arranged to form a circular arc corresponding to an outline of the induction heating coil L and may receive a driving current from the light source driver circuit 213 and may output light.

The light source D may be embodied by a light emitting diode (LED) that outputs light by a driving current or a light amplification by stimulated emission of radiation (LASER) and there is no limitation.

Meanwhile, color may be represented according to a variety of methods, and the light sources D may also be embodied to emit light in a variety of colors. For example, color may be represented according to a red green blue (RGB) method that represents any one or a combination of red, green, and blue. Corresponding thereto, the light source D, as shown in FIG. 9, may include totally three sub light sources including an R light source Dr that outputs red light, a G light source Dg that outputs green light, and a B light source Db that outputs blue light. Accordingly, the light emission driving controller 215 may emit light in a variety of colors by controlling light output from the R light source Dr, the G light source Dg, and the B light source Db by controlling driving currents supplied to the R light source Dr, the G light source Dg, and the B light source Db using a control signal.

Here, a form of the embodied light source D is not limited to the above-described example. For example, the light source D may include only a sub light source necessary for representing a flame image. Accordingly, the cooking apparatus 1 according to the embodiment may not only be producing at less costs but also control a flame image through a less arithmetic operation amount by reducing lines connected to the sub light sources.

For example, the light source D may include at least one sub light source that outputs same or different color light. As various embodiments, the light source D, as shown in FIG. 10, may include two sub light sources including the B light source Db that emits blue light and the R light source Dr that emits red light. As another embodiment, the light source D may include only a B light source that emits blue light or may include three sub lights such as the B light source and two R light sources and there is no limitation.

In other words, at least one of types, an arrangement form, and the number of sub light sources may vary according to how to represent a flame image. Data related to a method of representing a flame image and types and a number of sub light sources included in a light source may be prestored in a memory in the cooking apparatus 1. Accordingly, the main controller 100 may control an operation of the flame image generator 200 using the data stored in the memory.

Meanwhile, to realistically represent a flame image according to an output level, it is necessary to include all the above-described R light source Dr, G light source Dg, and B light source Db in the light source D. For example, to represent a flame image including orange color, strength of light output from the G light source Dg and the R light source Dr may be adjusted. However, when all the R light source Dr, G light source Dg, and B light source Db are included in the light source D, not only costs thereof are increased but also an arithmetic operation amount necessary for controlling is increased.

Accordingly, hereinafter, for convenience of description, a case in which the light source D includes at least one sub light source such as the B light source Db and at least one R light source Dr will be described as an example. However, as described above, the light source D may include the R light source Dr, G light source Dg, and B light source Db as sub light sources and there is no limitation. Flame images represented according to the types, number, and arrangement form of the sub light sources included in the light source D will be described below in detail.

The light source driver circuit 213 may include a resistor element that limits a level of a driving current supplied to the light source D and a switch element that supplies or cuts off a driving current to the light source D according to a control signal of the light emission driving controller 215. The light source driver circuit 213 will be described below in detail.

The light collecting module 220 may include a lens 221 that reflects or refracts light output by the light source D to concentrate the light.

The number of lenses 221 may be identical to the number of the light sources D and may be provided at positions corresponding to the light sources D as shown in FIG. 8. The lens 221, as shown in FIG. 9, includes a first refractive surface 221*a* that changes traveling of light output by the light source D and a second refractive surface 221*b* that concentrates the light transmitted by the first refractive surface 221*a*.

The first refractive surface 221*a*, as shown in FIG. 9, may be provided to oblique to a direction in which light is output and refracts light output in a vertical direction toward the cooking container C.

The second refractive surface 221*b*, as shown in FIG. 9, may be provided to lean toward the cooking container C to have a convex shape and may concentrate the light refracted by the first refractive surface 221*a*. The light is concentrated by the second refractive surface 221*b* and straightness thereof is improved such that a clearer flame image FI may be generated.

Meanwhile, the lens 221 may be embodied to have only one focus or a plurality of focuses according to the number of sub light sources included in the light source D. For example, when only a B light source Db is included as a sub light source in the light source D, the lens 221 may be embodied to have only one focus to concentrate blue light output from the sub B light source Db through reflection or refraction. As another example, when the light source D includes a B light source Db and a first sub R light source Dr as sub light sources, the lens 221 may be embodied to have only one focus or two focuses to represent light output from each of the sub light sources Db and Dr to be clearer and bigger. A detailed description thereof will be described below.

The optical filter 230 includes a filter body 233 that forms an external shape of the optical filter 230 and cuts off light among light output by the light source D, which does not head for the cooking container C, and a slit 231 that is provided at a top of the body 233 and transmits only light among light output by the light source D, which heads for the cooking container C.

Referring to FIG. 11, the slit 231 may be provided on a path through which output light travels toward the cooking container C. For example, the slit 231 may be provided between the second refractive surface 221*b* and the cooking container C.

Light among light transmitted by the light collecting module 220, which heads for the cooking container C, may pass through the slit 231 and form a flame image FI on the cooking container C. Light that does not head for the cooking container C may be prevented by the filter body 233.

Light output by the light emitting module 210 may be concentrated by the light collecting module 220, may pass through the optical filter 230, and may be emitted toward a side of the cooking container C. Accordingly, the flame images FI may be formed on the side of the cooking container C such that a user may see the flame images FI and may intuitively recognize an operation state of the cooking apparatus 1. Hereinafter, an arrangement form of the plurality of light sources D included in the light emitting module 210 will be described.

Figure 12:
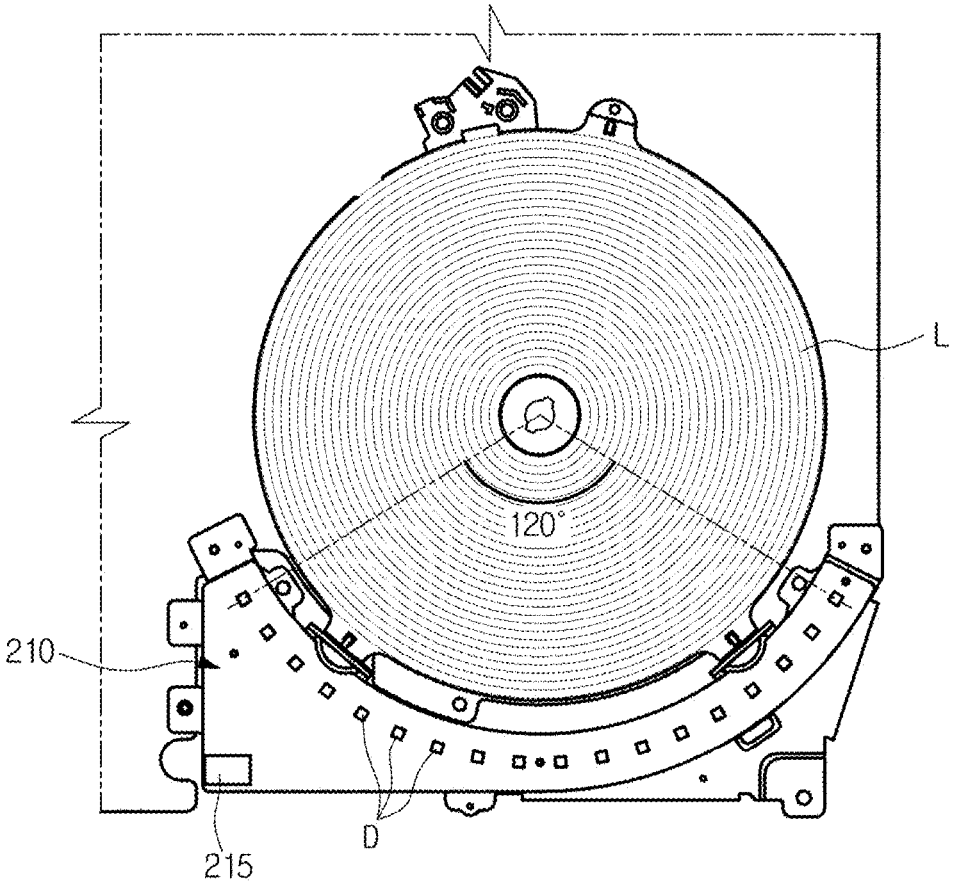
FIG. 12 is a view illustrating an arrangement form of a plurality of light sources according to various embodiments.
Figure 13:
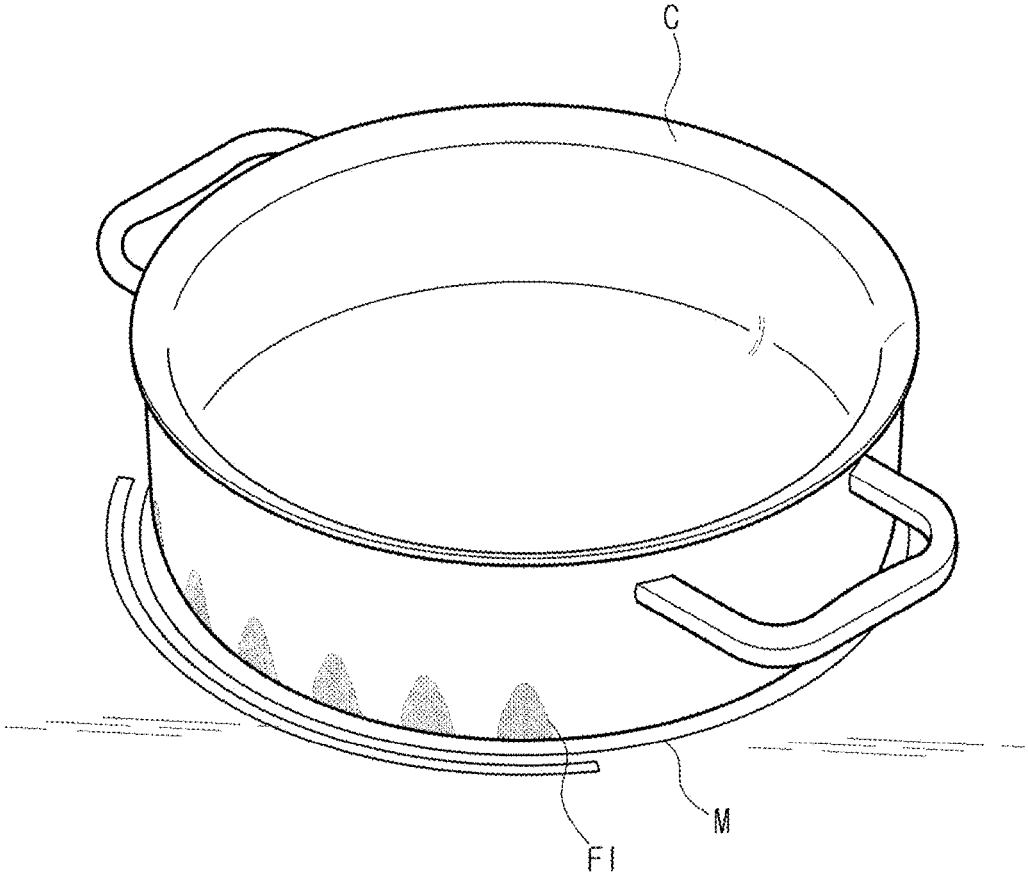
FIG. 13 is a view illustrating a flame image displayed on a cooking container when the plurality of light sources, according to various embodiments, are arranged as shown in FIG. 12.
Figure 14:
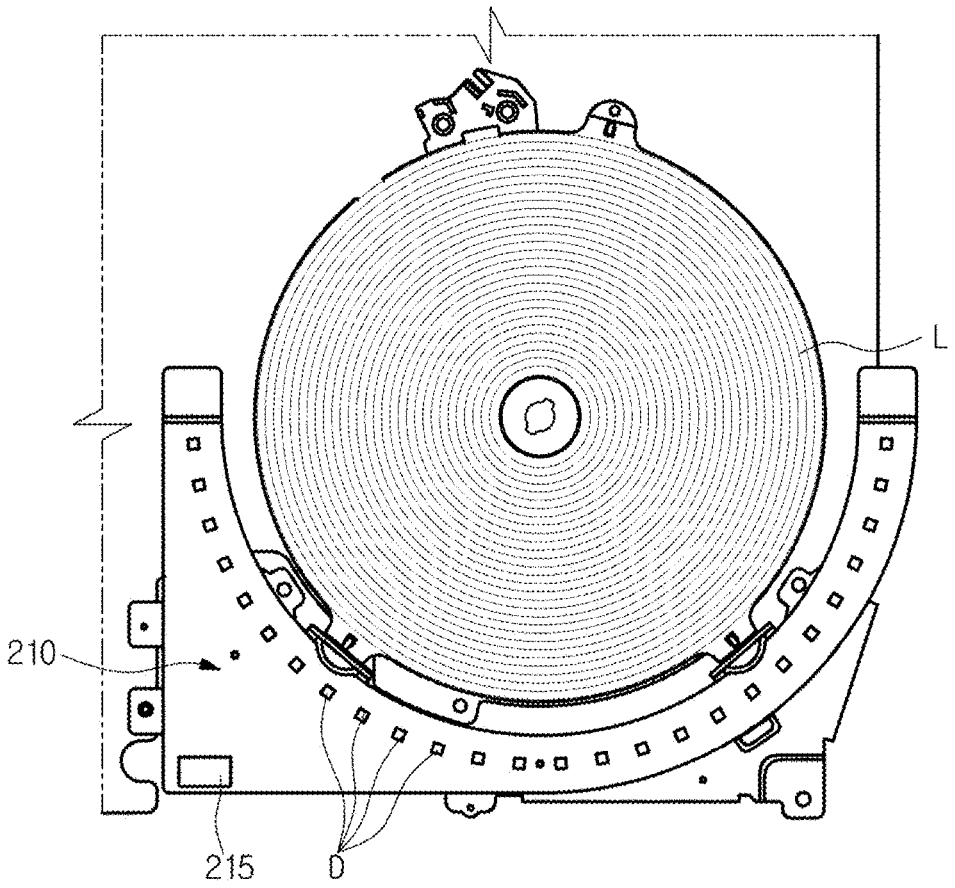
FIG. 14 is a view illustrating an arrangement form of a plurality of light sources according to various embodiments.
Figure 15:
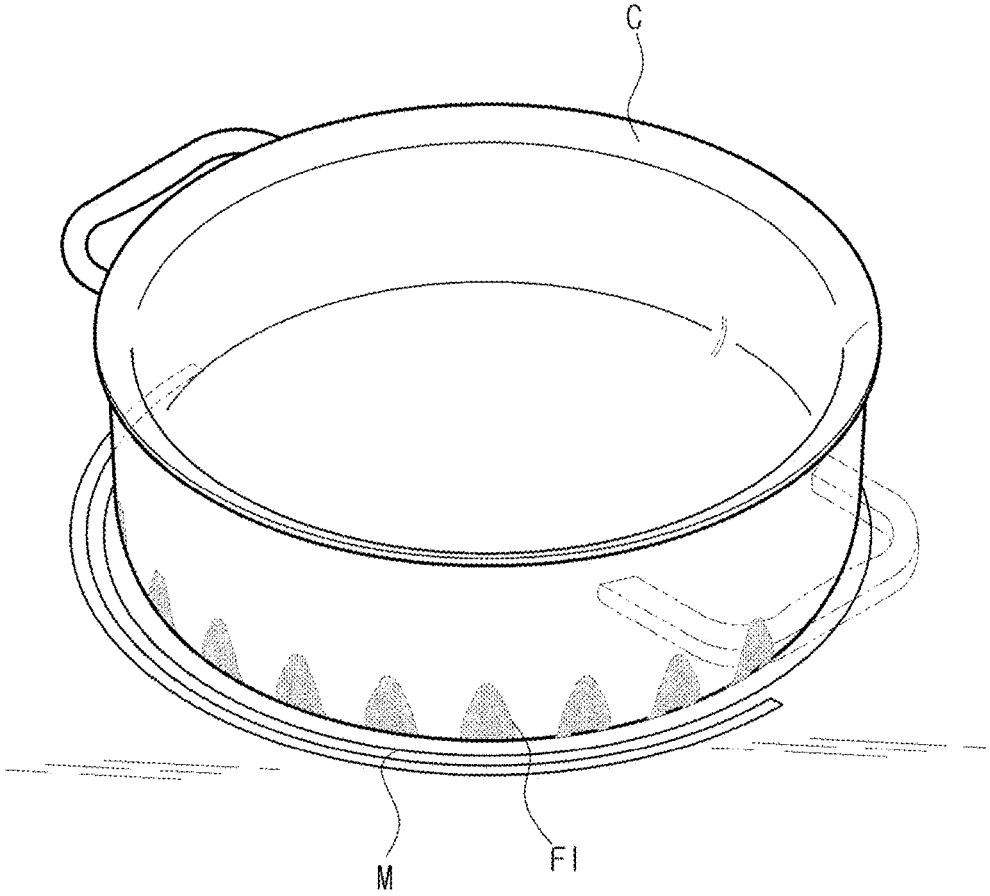
FIG. 15 is a view illustrating flame images displayed on the cooking container when the plurality of light sources, according to various embodiments, are arranged as shown in FIG. 14.
Figure 16:
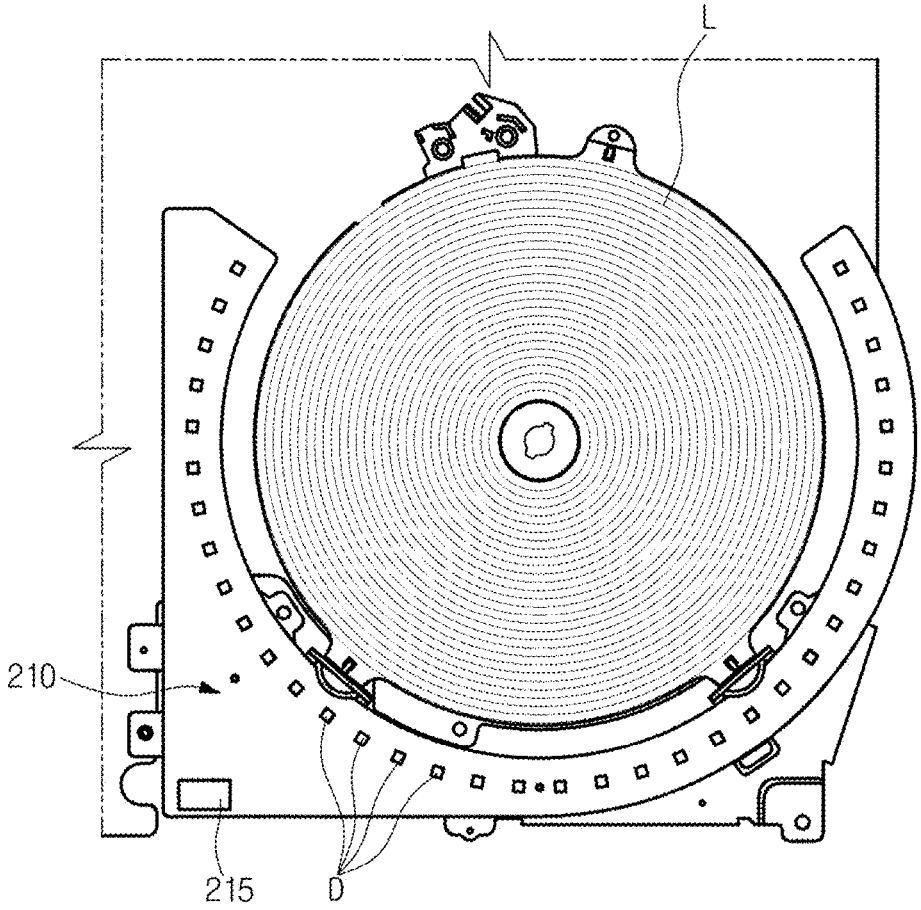
FIG. 16 is a view illustrating another example of an arrangement form of a plurality of light sources.
Figure 17:
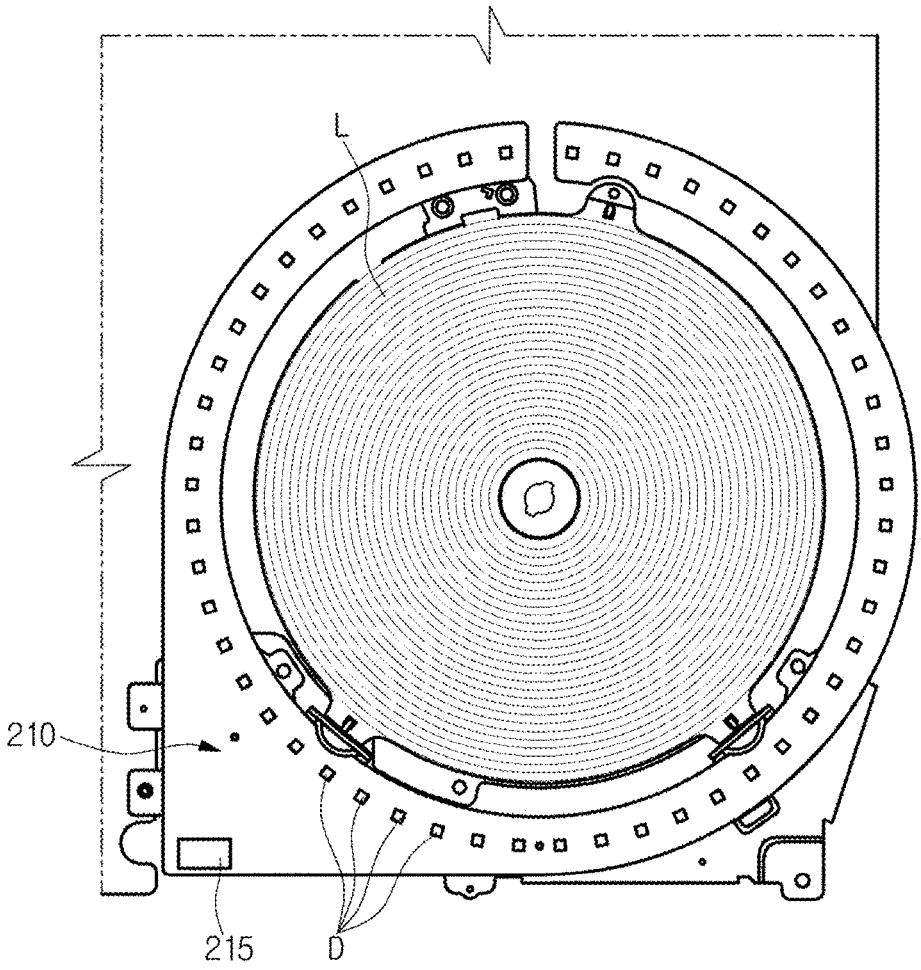
FIG. 17 is a view illustrating another example of the arrangement form of the plurality of light sources.
Figure 18:
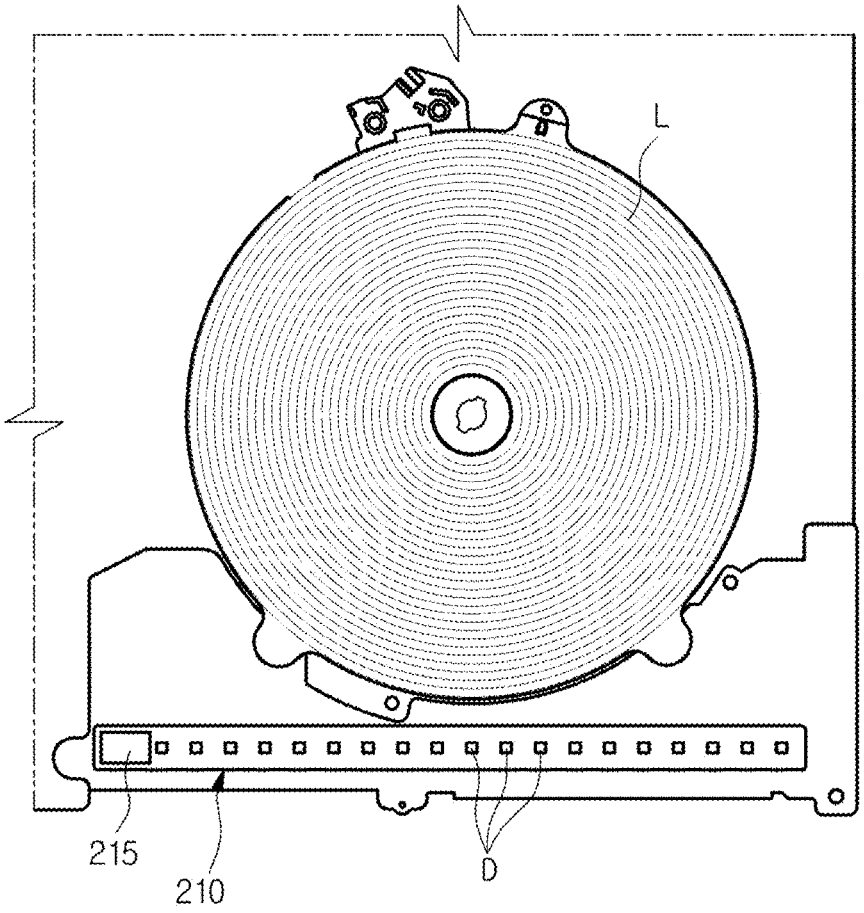
FIG. 18 is a view illustrating another example of an arrangement form of a plurality of light sources.
Figure 19:
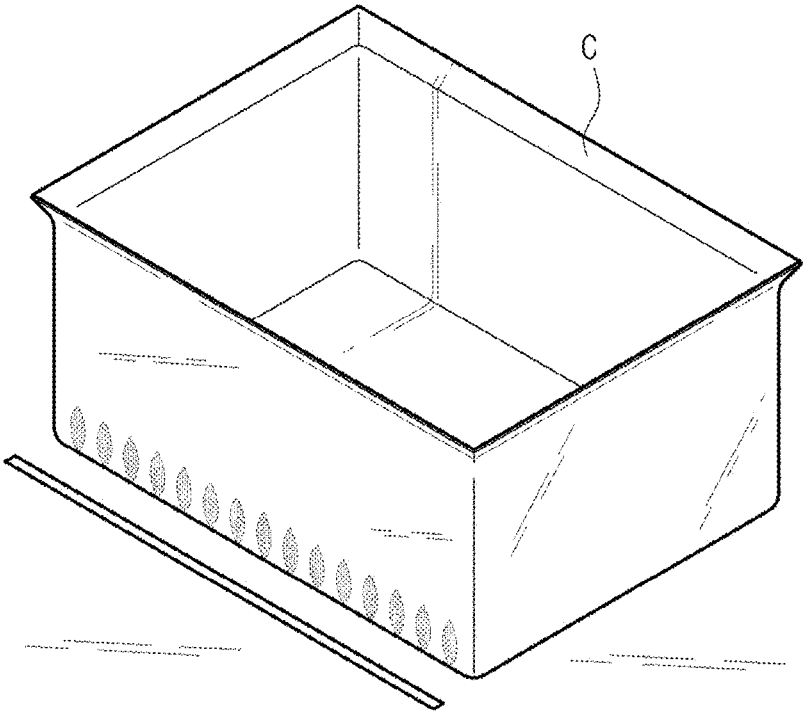
FIG. 19 is a view illustrating flame images displayed on a cooking container when the plurality of light sources, according to various embodiments, are arranged as shown in FIG. 18.
Figure 20:
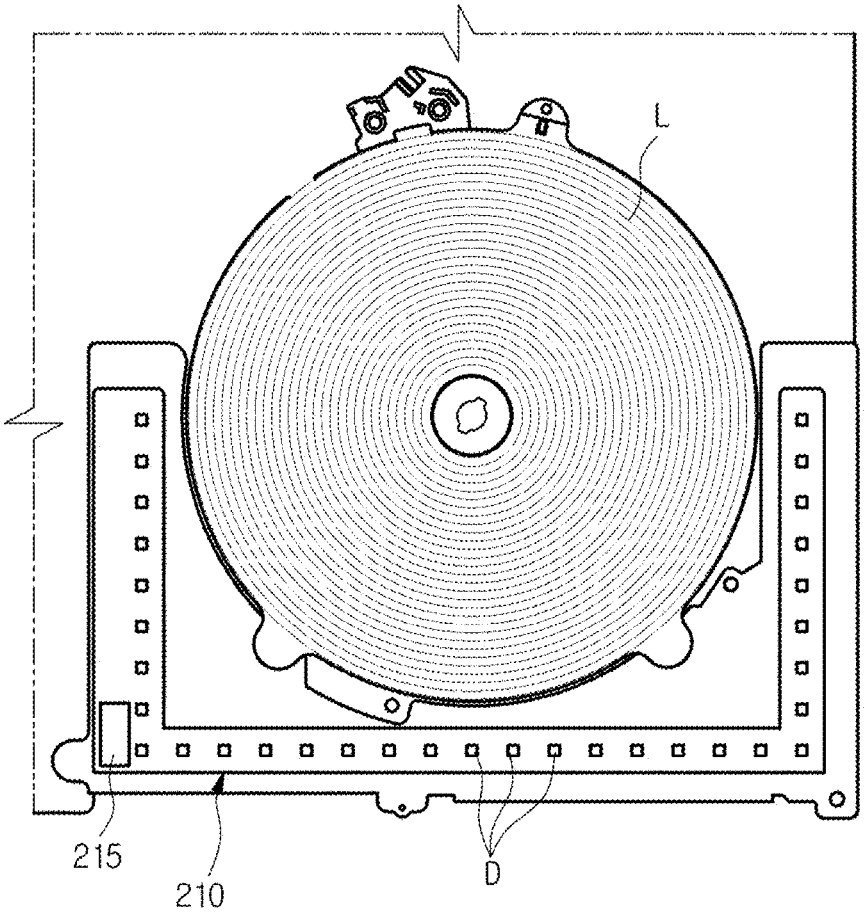
FIG. 20 is a view illustrating another example of an arrangement form of a plurality of light sources.

FIG. 12 is a view illustrating an arrangement form of a plurality of light sources according to various embodiments, and FIG. 13 is a view illustrating a flame image displayed on the cooking container when the plurality of light sources according to various embodiments are arranged as shown in FIG. 12. Also, FIG. 14 is a view illustrating an arrangement form of a plurality of light sources according to another embodiment. FIG. 15 is a view illustrating a flame image displayed on the cooking container when the plurality of light sources according to various embodiments is arranged as shown in FIG. 14. Also, FIGS. 16 to 18 are views illustrating arrangement forms of a plurality of light sources according to different embodiments, FIG. 19 is a view illustrating a flame image displayed on the cooking container when the plurality of light sources according to one embodiment are arranged as shown in FIG. 18, and FIG. 20 is a view illustrating an arrangement form of a plurality of light sources according to another embodiment. Hereinafter, they will be described together to avoid a repetition of description.

The light sources D may be arranged to form a circular arc corresponding to an outline of the induction heating coil L.

For example, the light emitting module 210, as shown in FIG. 12, may be disposed in front of the induction heating coil L, and the light sources D may be arranged to form a circular arc of about 120 degrees with respect to a center of the induction heating coil L. When the light sources D are arranged to form the circular arc of about 120 degrees, flame images FI shown in FIG. 13 may be formed on the side of the cooking container C. Here, the light source D may include a B light source that outputs blue light and at least one light source as sub light sources.

As one embodiment, the flame images FI may be formed at positions where the light sources D are arranged, that is, in a range of 120 degrees at a front side of the cooking container C. Accordingly, the user easily recognizes the flame images FI in front of the cooking apparatus 1 and may intuitively recognize the operation state of the cooking apparatus 1.

Meanwhile, although a case in which twelve flame images FI are formed by twelve light sources D has been described with reference to FIGS. 12 and 13, the number of light sources D and the number of flame images FI are not limited thereto. The number of light sources D may be set differently according to a size of the cooking container C and intervals among the light sources D, and the number of flame images FI may vary according to the number of arranged light sources D.

For example, the light emitting module 210 including the light sources D, as shown in FIG. 14, may be disposed in front of the induction heating coil L, and the light sources D may be arranged to form a circular arc of about 180 degrees with respect to the center of the induction heating coil L. When the light sources D are arranged to form the circular arc of about 180 degrees, flame images FI shown in FIG. 15 may be formed on the side of the cooking container C. As various embodiments, the flame images FI may be formed at positions where the light sources D are arranged, that is, in a range of 180 degrees at the front side of the cooking container C. Accordingly, the user easily recognizes the flame images FI in front of the cooking apparatus 1 and may intuitively recognize the operation state of the cooking apparatus 1.

Meanwhile, although a case in which eighteen flame images FI are formed by eighteen light sources D has been described with reference to FIGS. 14 and 15, as described above, the number of the light sources D and the number of the flame images FI are not limited thereto.

For example, the light emitting module 210 including the light sources D, as shown in FIG. 16, may be disposed in front of the induction heating coil L, and the light sources D may be arranged to form a circular arc of about 240 degrees with respect to the center of the induction heating coil L. When the light sources D are arranged to form the circular arc of about 240 degrees, the flame images FI may be formed in a range of 240 degrees at the front side of the cooking container C. Accordingly, the user easily recognizes the flame images FI not only in front of but also beside the cooking apparatus 1 and may intuitively recognize the operation state of the cooking apparatus 1.

As another example, the light emitting module 210 including the light sources D may be disposed in front of the induction heating coil L, and the light sources D may be arranged to form a circular arc with respect to the center of the induction heating coil L as shown in FIG. 17. Accordingly, the user may recognize the flame images FI in every direction of the cooking apparatus 1.

In the cooking apparatus 1 according to the embodiment, the plurality of light sources D are arranged to form a circular arc such that light emitted by the light sources D may generate natural flame images FI on the side of the circular-shaped cooking container C. However, the arrangement form of the plurality of light sources D is not limited to the circular arc shape. For example, in the case of an angulated cooking container, for example, a square or rectangular cooking container, the plurality of light sources D may be arranged in a linear shape or U shape.

For example, the light emitting module 210 including the light sources D may be disposed in front of the induction heating coil L, and the light sources D may be arranged to form a straight line with a length corresponding to a diameter of the induction heating coil L as shown in FIG. 18. When the light sources D are arranged to form the straight line, flame images FI shown in FIG. 19 may be formed on the side of the cooking container C. In other words, the flame images FI may be formed at positions where the light sources D are arranged, that is, the front side of the cooking container C.

As another example, the light emitting module 210 including the light sources D may be disposed in front of the induction heating coil L, and the light sources D may be arranged to form a U shape having a size corresponding to the diameter of the induction heating coil L as shown in FIG. 20. The plurality of light sources D may be arranged to have a variety of shapes according to the shape of the cooking container C, a shape of the guide mark M, or the like and there is no limitation. Hereinafter, a circuit configuration of the light emitting module 210 such as an embodied shape of the light sources D, a connection form among sub light sources in the light source D, a grouping form thereof, and the like will be described.

Figure 21:
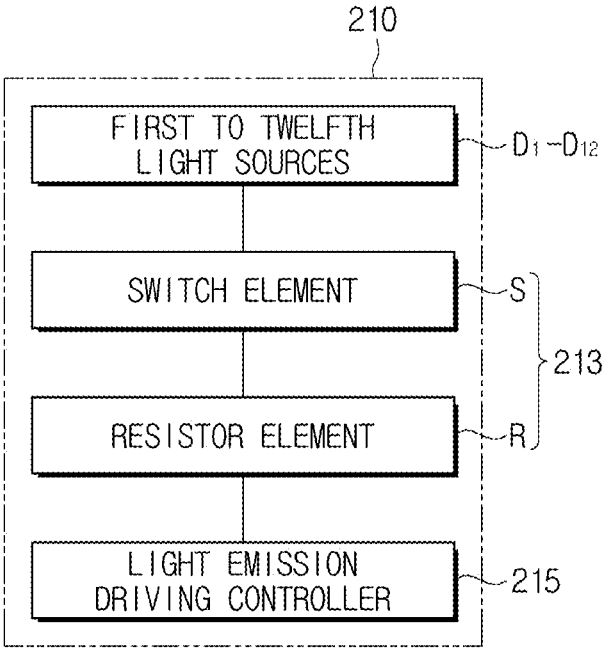
FIG. 21 is a control block diagram of a light emitting module according to various embodiments.
Figure 22:
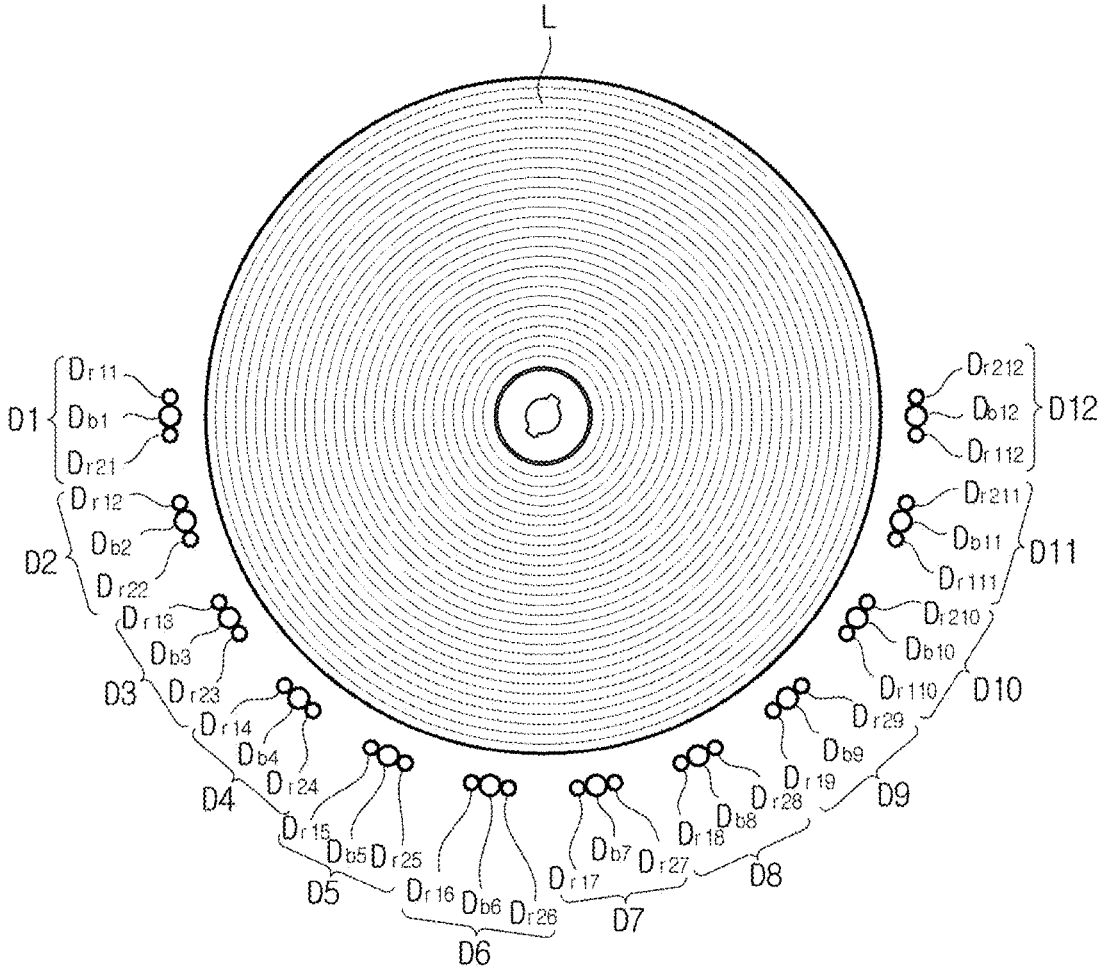
FIG. 22 is a view schematically illustrating an arrangement form of a plurality of light sources each including three sub light sources according to various embodiments.
Figure 23:
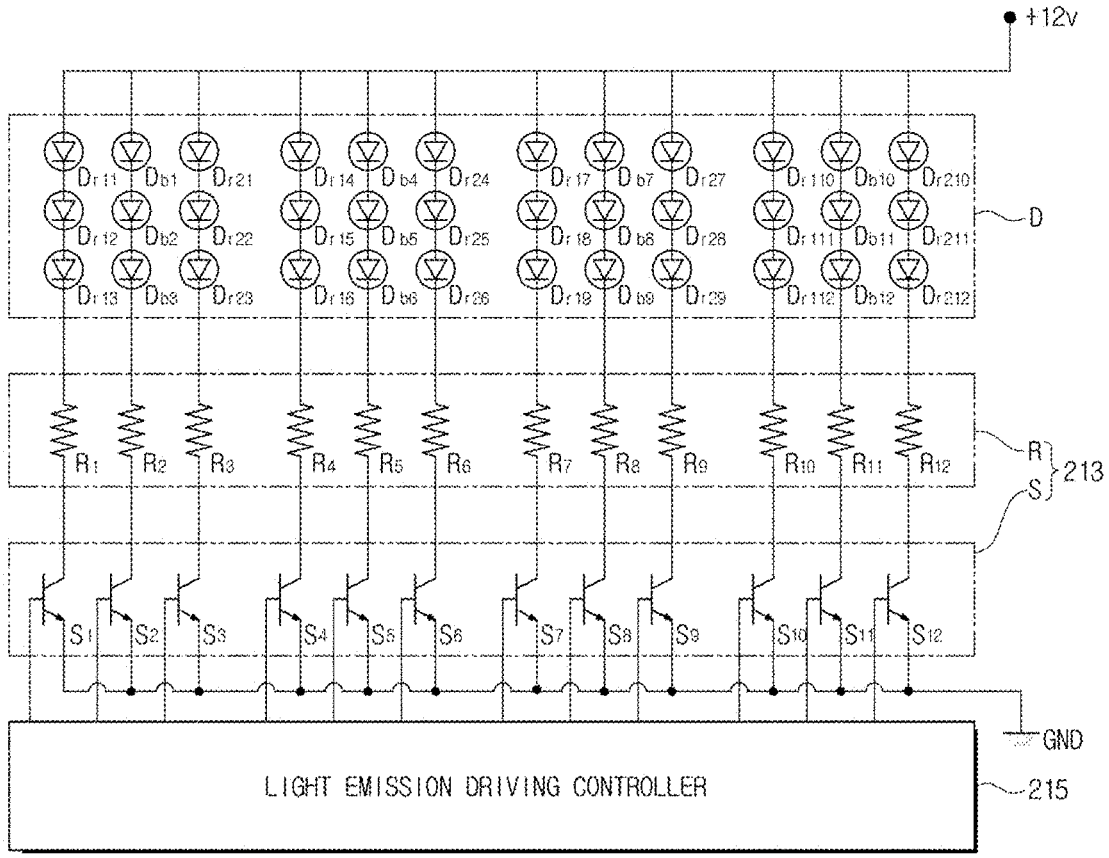
FIG. 23 is a view schematically illustrating a connection form among components in the light emitting module of FIG. 22 according to various embodiments.
Figure 24:
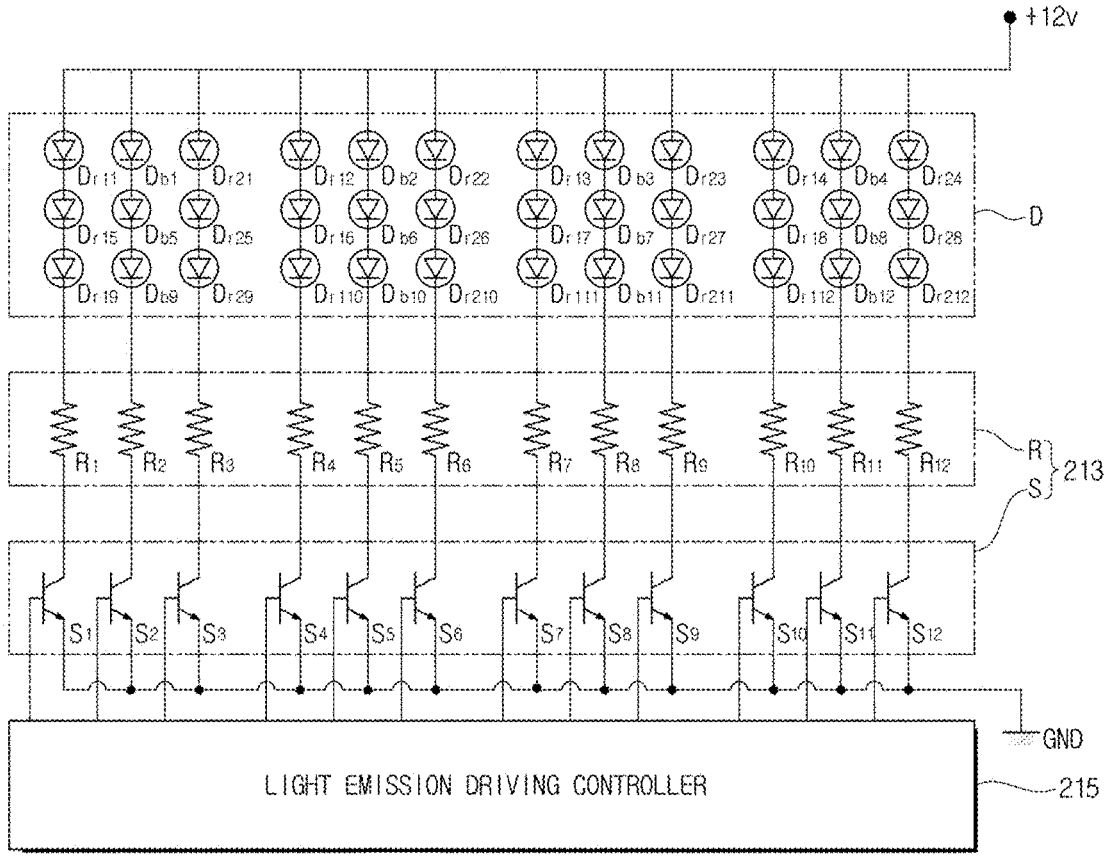
FIG. 24 is a view schematically illustrating another example of a connection form among components in the light emitting module of FIG. 22.

FIG. 21 is a control block diagram of the light emitting module according to various embodiments, and FIG. 22 is a view schematically illustrating an arrangement form of a plurality of light sources each including three sub light sources according to various embodiments. Also, FIG. 23 is a view schematically illustrating a connection form among components in the light emitting module of FIG. 22 according to various embodiments, and FIG. 24 is a view schematically illustrating another example of a connection form among components in the light emitting module of FIG. 22. Hereinafter, they will be described together to avoid a repetition of description.

Meanwhile, hereinafter, for convenience of description, although a case in which twelve light sources D are arranged to form a circular arc of about 120 degrees with respect to the center of in the induction heating coil L as shown in FIG. 14 will be described, but embodiments are not limited thereto.

Referring to FIG. 21, the light emitting module 210 may include first to twelfth light sources D1 to D12, a switch element S that turns on-off driving currents supplied to the first to twelfth light sources D1 to D12, a resistor element R that limits a level of a driving current supplied to the light source D, and the light emission driving controller 215 that controls turning on/off of the switch element S. Here, the switch element S and the resistor element R may be included in the light source driver circuit 213.

For example, each of the first to twelfth light sources D1 to D12, that is, each of the plurality of light sources D1 to D12 may include an R light source that outputs red light, a G light source that outputs green light, and a B light source that outputs blue light as described above. However, hereinafter, for convenience, a case in which each of the plurality of light sources D1 to D12 includes only a B light source that outputs blue light as a sub light source or further includes one or more R light sources as sub light sources according to a flame shape will be described.

The plurality of light sources D1 to D12 may be separately controlled. The light emission driving controller 215 may separately control the plurality of light sources D1 to D12 by applying a driving signal to each of the plurality of light sources D1 to D12. Here, the light emission driving controller 215 may control each of the plurality of light sources D1 to D12 or may control each of sub light sources included in the plurality of light sources D1 to D12 and there is no limitation. Hereinafter, the driving signal refers to driving power, a driving current, a driving voltage, and the like overall.

For example, the light emission driving controller 215 may group-control the plurality of light sources D1 to D12. The light emission driving controller 215 may perform group-control by dividing the plurality of light sources D1 to D12 into one or more groups and transmitting a driving signal for each divided group. Here, the group may include at least one light source or at least one sub light source.

The light emission driving controller 215 according to the embodiment may apply driving signals to light sources included in each group at the same time using a method of group-controlling the plurality of light sources D1 to D12. In other words, the light emission driving controller 215 may apply a driving signal to an input end of a sub light source included in a group.

Otherwise, in designing the cooking apparatus 1, it is possible to design integrally input ends of two or more of a plurality of sub light sources included in a group, as one. Accordingly, the light emission driving controller 215 may perform group-controlling by previously recognizing an input end connected to a sub light source included in a group and applying a driving signal to the recognized input end.

For example, the plurality of light sources D1 to D12, as shown in FIG. 22, may include B light sources Db1 to Db12, first R light sources Dr11 to Dr112, and second R light sources Dr21 to Dr212 as sub light sources. The plurality of light sources D1 to D12 may be separately connected or group-connected to the light emission driving controller 215 via the switch element and the resistor element.

Referring to FIG. 23, input ends of the first R light source Dr11 of the first light source D1, the first R light source Dr12 of the second light source D2, and the first R light source Dr13 of the third light source D3 may be connected in series. In other words, the first R light source Dr11 of the first light source D1, the first R light source Dr12 of the second light source D2, and the first R light source Dr13 of the third light source D3 may be connected to an output end of the light emission driving controller 215, which outputs a driving signal, through one line.

Also, the B light source Db1 of the first light source D1, the B light source Db2 of the second light source D2, and the B light source Db3 of the third light source D3 may be connected in series, and the second R light source Dr21 of the first light source D1, the second R light source Dr22 of the second light source D2, and the second R light source Dr23 of the third light source D3 may be connected in series. The sub light sources included in the fourth to twelfth light sources D4 to D12 may also be connected like the sub light sources of the first to third light sources D1 to D3. Accordingly, the cooking apparatus 1 according to the embodiment may not only reduce an arithmetic operation amount necessary for generating flame images but also reduce costs by reducing the number of output ends that output driving signals. Accordingly, the light emission driving controller 215 according to the embodiment may control the sub light sources connected in series at the same time.

Meanwhile, the light emission driving controller 215 according to the embodiment may group the plurality of light sources D1 to D12 using a variety of methods.

For example, the plurality of light sources D1 to D12 may be grouped for light sources adjacent to one another. The light emission driving controller 215 may control the light sources for each group by dividing the plurality of light sources D1 to D12 into four groups for each adjacent area and transmitting a driving signal for each thereof. In other words, the light emission driving controller 215 according to the embodiment may not only group according to a preset range based on a particular place but also group in consideration of a connection form of the sub light sources.

As various embodiments, a first group may include the first to third light sources D1 to D3, a second group may include the fourth to sixth light sources D4 to D6, a third group may include seventh to ninth light sources D7 to D9, and a fourth group may include the tenth to twelfth light sources D10 to D12.

That is, the first group may include the first R light sources Dr11 to Dr13, the B light sources Db1 to Db3, and the second R light sources Dr21 to Dr23 as sub light sources, and the second group may include the first R light sources Dr14 to Dr16, the B light sources Db4 to Db6, and the second R light sources Dr24 to Dr26 as sub light sources. Also, the third group may include the first R light sources Dr17 to Dr19, the B light sources Db7 to Db9, and the second R light sources Dr27 to Dr29 as sub light sources, and the fourth group may include the first R light sources Dr110 to Dr112, the B light sources Db10 to Db12, and the second R light sources Dr210 to Dr212 as sub light sources.

Meanwhile, the grouping form according to the embodiment is not limited to grouping light sources in an adjacent area, and the connection form among the sub light sources also is not limited to serial connection of adjacent sub light sources.

For example, the sub light sources included in the plurality of light sources D1 to D12 may be connected in series for sub light sources spaced at a preset distance, and the sub light sources spaced at the preset distance may be grouped.

Referring to FIG. 24, the first R light source Dr11 of the first light source D1, the first R light source Dr15 of the fifth light source D5, and the first R light source Dr19 of the ninth light source D9 may be connected in series. Also, the B light source Db1 of the first light source D1, the B light source Db5 of the fifth light source D5, and the B light source Db9 of the ninth light source D9 may be connected in series, and the second R light source Dr21 of the first light source D1, the second R light source Dr25 of the fifth light source D5, and the second R light source Dr29 of the ninth light source D9 are connected in series and then controllable at the same time through driving signals. Accordingly, costs may be reduced by reducing the number of output ends through which the light emission driving controller 215 according to the embodiment outputs driving signals. Also, there is an effect of reducing an arithmetic operation amount necessary for controlling flame images by the light emission driving controller 215.

The light emission driving controller 215 according to the embodiment may generate groups by grouping light sources spaced at preset distances. For example, the light emission driving controller 215 may control the light sources for each group by dividing the plurality of light sources D1 to D12 into four groups and transmitting a driving signal for each thereof.

For example, a first group may include the first, fifth, and ninth light sources D1, D5, and D9, a second group may include the second, sixth, and tenth light sources D2, D6, and D10, a third group G3 may include the third, seventh, and eleventh light sources D3, D7, and D11, and a fourth group G4 may include the fourth, eighth, and twelfth light sources D4, D8, and D12. Accordingly, the light emission driving controller 215 according to the embodiment may control output of light for each group.

Figure 25:
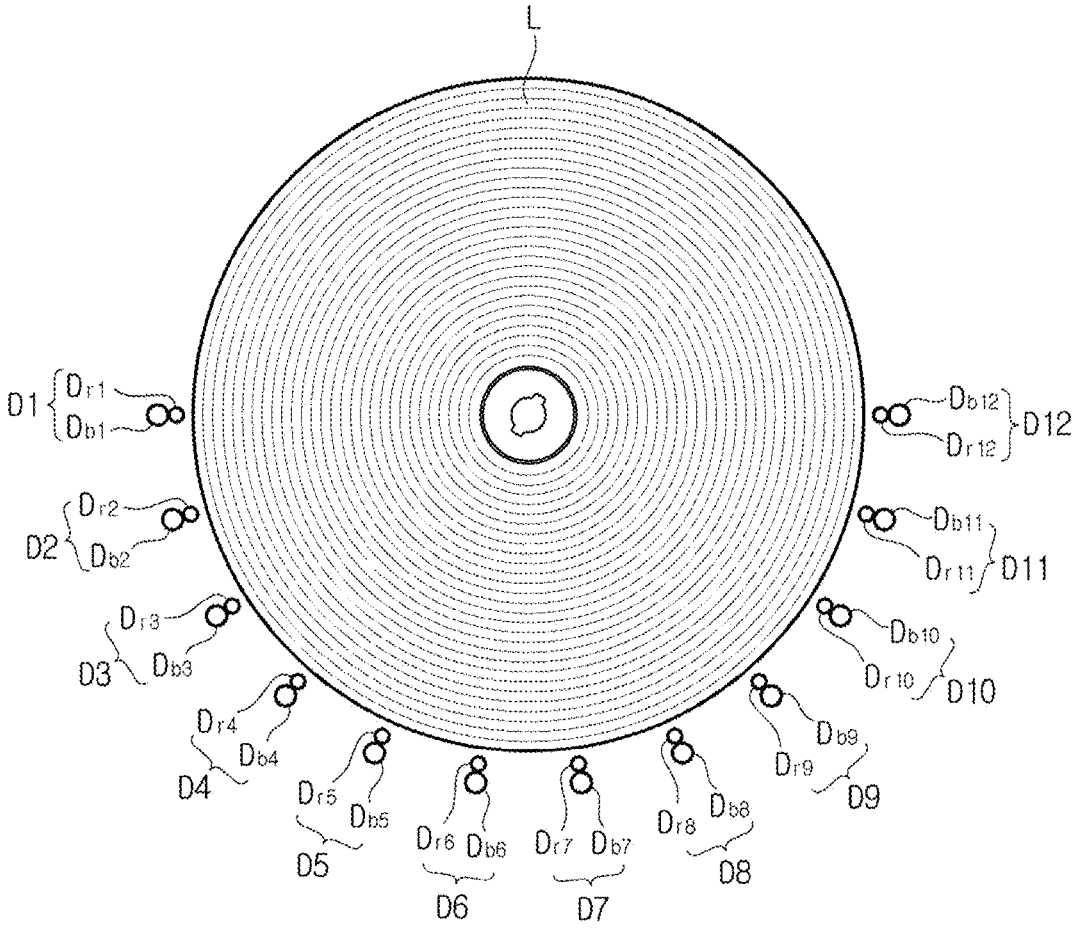
FIG. 25 is a view schematically illustrating an arrangement form of a plurality of light sources each including two sub light sources according to various embodiments.
Figure 26:
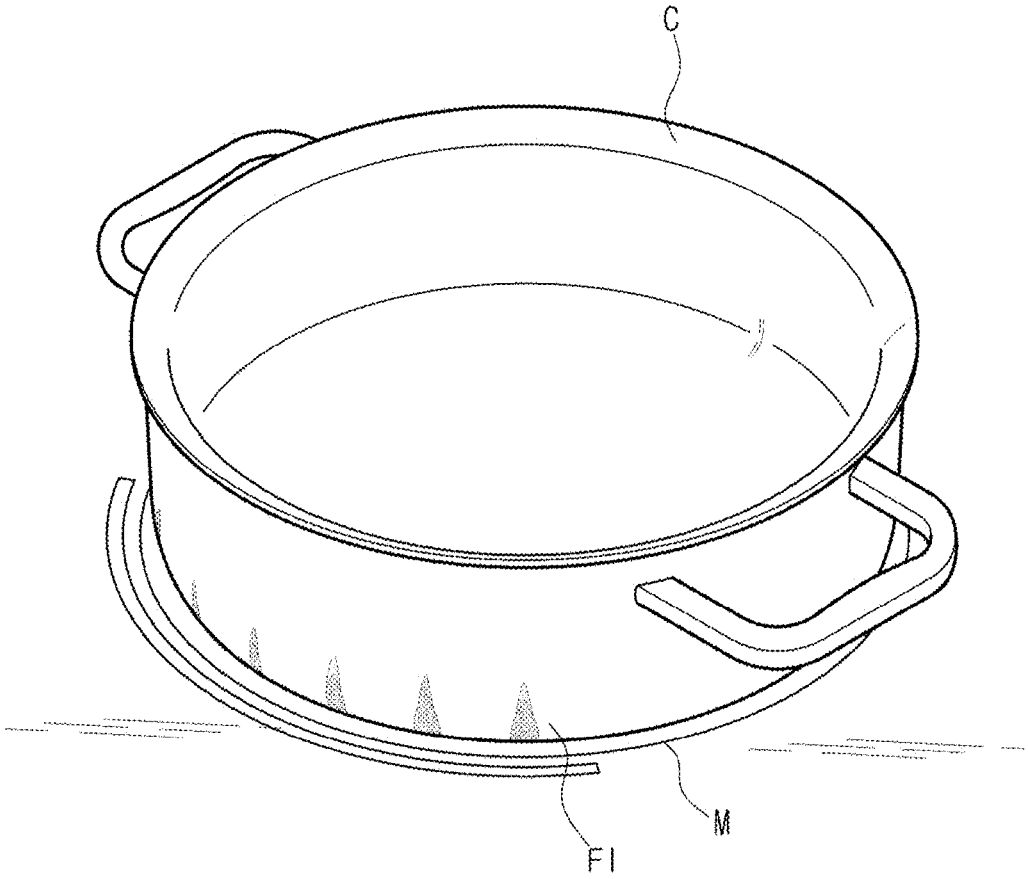
FIG. 26 is a view illustrating flame images displayed on a cooking container when the plurality of light sources, according to various embodiments, are arranged as shown in FIG. 25.
Figure 27:
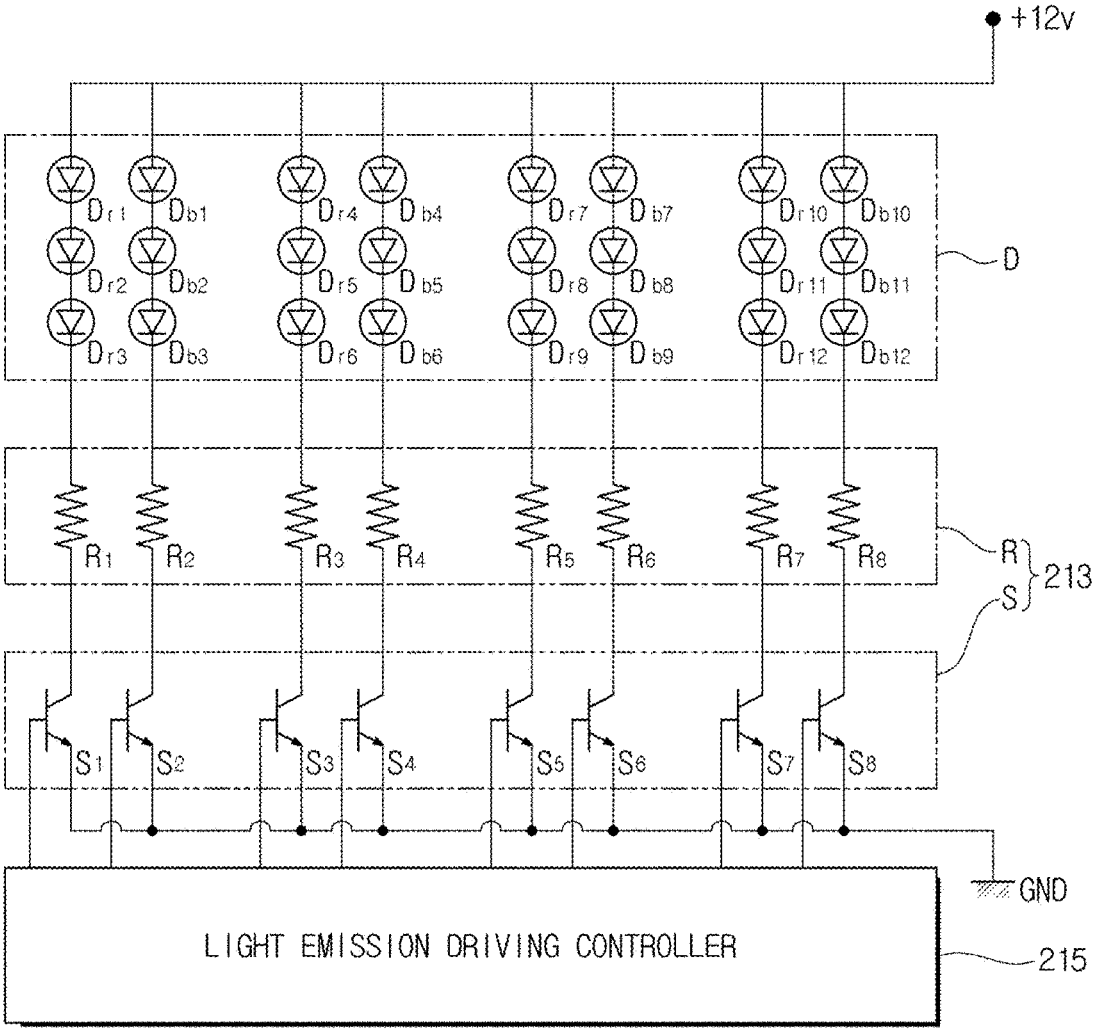
FIG. 27 is a view schematically illustrating a connection form among components in the light emitting module of FIG. 25 according to various embodiments.
Figure 28:
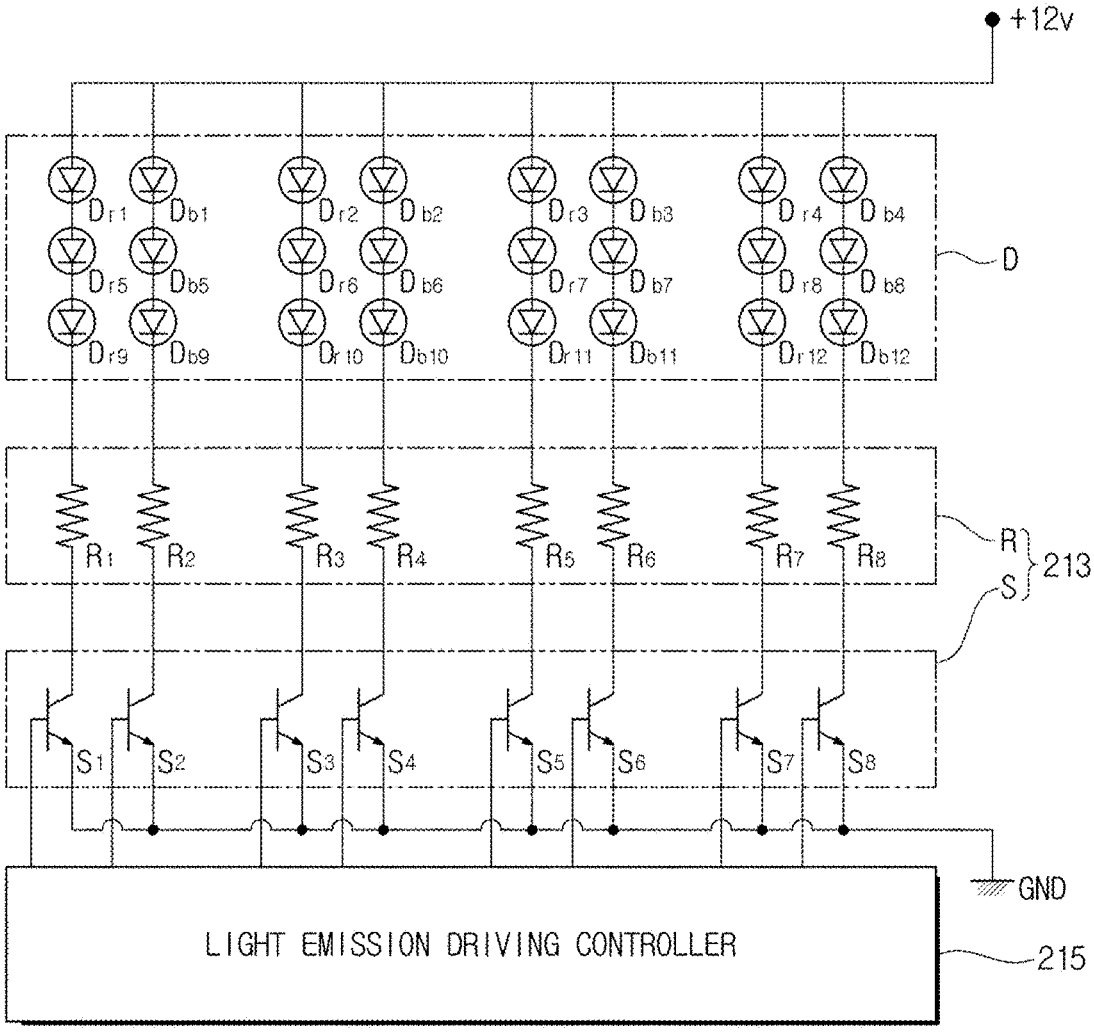
FIG. 28 is a view schematically illustrating another example of a connection form among components in the light emitting module of FIG. 25.

FIG. 25 is a view schematically illustrating an arrangement form of a plurality of light sources each including two sub light sources according to various embodiments, and FIG. 26 is a view illustrating flame images displayed on the cooking container when the plurality of light sources according to various embodiments are arranged as shown in FIG. 25. Also, FIG. 27 is a view schematically illustrating a connection form among components in the light emitting module of FIG. 25 according to various embodiments, and FIG. 28 is a view schematically illustrating another example of a connection form among components in the light emitting module of FIG. 25. Hereinafter, they will be described together to avoid a repetition of description.

Meanwhile, each of the plurality of light sources D1 to D12 may include a B light source and one R light source. For example, referring to FIG. 25, the plurality of light sources D1 to D12 may include B light sources Db1 to Db12 and R light sources Dr1 to Dr12. Here, the flame image FI shown in FIG. 26 may be shown on the cooking container C.

There may be a variety of connection forms and grouping forms between the sub light sources included in the plurality of light sources D1 to D12 including two sub light sources.

For example, referring to FIG. 27, an R light source Dr1 of the first light source D1, an R light source Dr2 of the second light source D2, and an R light source Dr3 of the third light source D3 are connected in series such that the light emission driving controller 215 may apply driving signals to the above-described sub light sources through one output end. Also, a B light source Db1 of the first light source D1, a B light source Db2 of the second light source D2, and a B light source Db3 of the third light source D3 are connected in series such that the light emission driving controller 215 may apply driving signals to the above-described sub light sources through one output end.

The light emission driving controller 215 may group the sub light sources Dr1 to Dr3 and Db1 to Db3 included in the first to third light sources D1 to D3 as a first group, may group the sub light sources Dr4 to Dr6 and Db4 to Db6 included in the fourth to sixth light sources D4 to D6 as a second group, may group the sub light sources Dr7 to Dr9 and Db7 to Db9 included in the seventh to ninth light sources D7 to D9 as a third group, and may group the sub light sources Dr10 to Dr12 and Db10 to Db12 included in the tenth to twelfth light sources D10 to D12 as a fourth group. Accordingly, the light emission driving controller 215 according to the embodiment may control the groups by transmitting a driving signal for each group.

Also, the light emission driving controller 215 may group sub light sources Dr1, Dr3, Dr5, Db1, Db3, and Db5 included in the first, third, and fifth light sources D1, D3, and D5 as a first group, may group sub light sources Dr2, Dr4, Dr6, Db2, Db4, and Db6 included in the second, fourth, and sixth light sources D2, D4, and D6 as a second group, may group sub light sources Dr7, Dr9, Dr11, Db7, Db9, and Db11 included in the seventh, ninth, and eleventh light sources D7, D9, and D11 as a third group, and may group sub light sources Dr8, Dr10, Dr12, Db8, Db10, and Db12 included in the eighth, tenth, and twelfth light sources D8, D10, and D12 as a fourth group, and there is no limitation.

As another example, referring to FIG. 28, the R light source Dr1 of the first light source D1, the R light source Dr5 of the fifth light source D5, and the R light source Dr9 of the ninth light source D9 may be connected in series and integrated as one output end. Also, the B light source Db1 of the first light source D1, the B light source Db5 of the fifth light source D5, and the B light source Db9 of the ninth light source D9 are connected in series such that the light emission driving controller 215 may apply driving signals to the above-described sub light sources through one output end.

Here, the light emission driving controller 215 according to the embodiment may group the sub light sources Dr1, Dr5, Dr9, Db1, Db5, and Db9 included in the first, fifth, and ninth light sources D1, D5, and D9 as a first group, may group sub light sources Dr2, Dr6, Dr10, Db2, Db6, and Db10 included in the second, sixth, and tenth light sources D2, D6, and D10 as a second group, may group the sub light sources Dr3, Dr7, Dr11, Db3, Db7, and Db11 included in the third, seventh, and eleventh light sources D3, D7, and D11 as a third group, and may group the sub light sources Dr4, Dr8, Dr12, Db4, Db8, and Db12 included in the fourth, eighth, and twelfth light sources D4, D8, and D12 as a fourth group. Accordingly, the light emission driving controller 215 according to the embodiment may control the groups by applying a driving signal for each group.

That is, the plurality of sub light sources may receive a driving signal through one output end. Also, the light emission driving controller 215 according to the embodiment may divide and group the sub light sources connected in series into a plurality of groups in consideration of the connection form between the sub light sources and the arrangement form of the plurality of light sources D1 to D12 and then may control for each group. Accordingly, the cooking apparatus 1 according to the embodiment may not only reduce an arithmetic operation amount necessary for generating flame images but also generate naturally moving flame images rather than a case of uniformly applying driving signals to all output ends.

Figure 29:
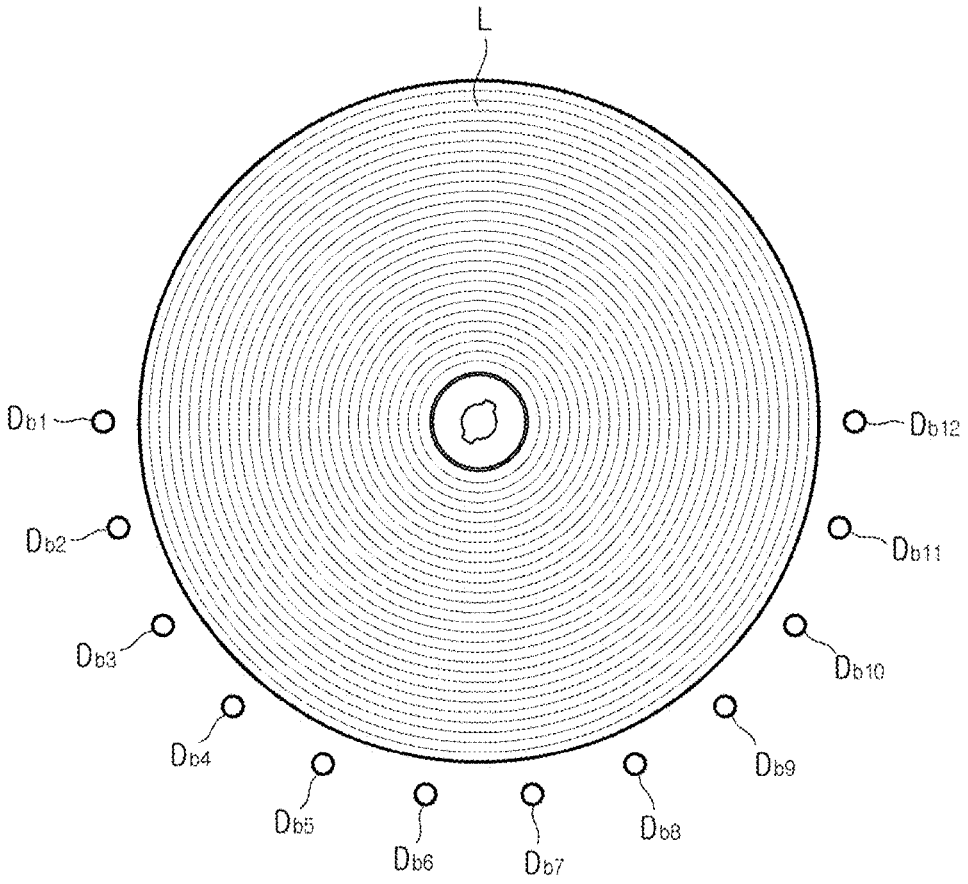
FIG. 29 is a view schematically illustrating an arrangement form of a plurality of light sources each including one sub light source.
Figure 30:
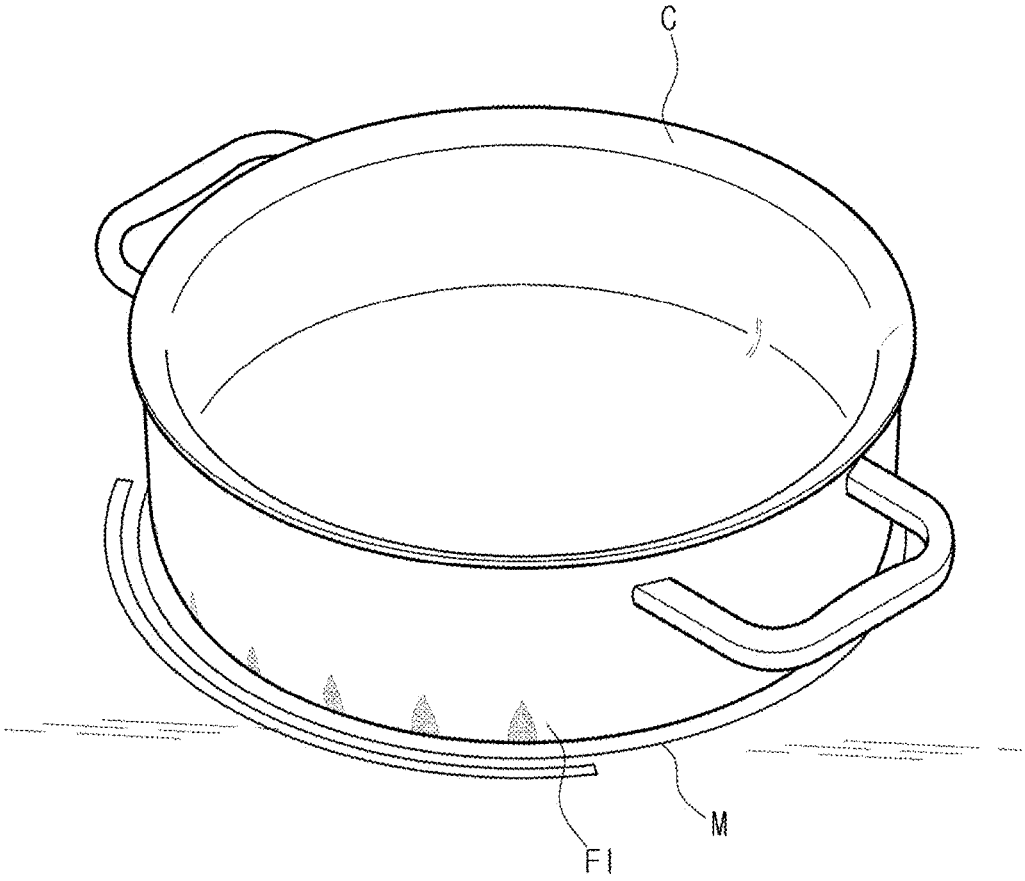
FIG. 30 is a view illustrating flame images displayed on the cooking container when the plurality of light sources according to the embodiment are arranged as shown in FIG. 29.
Figure 31:
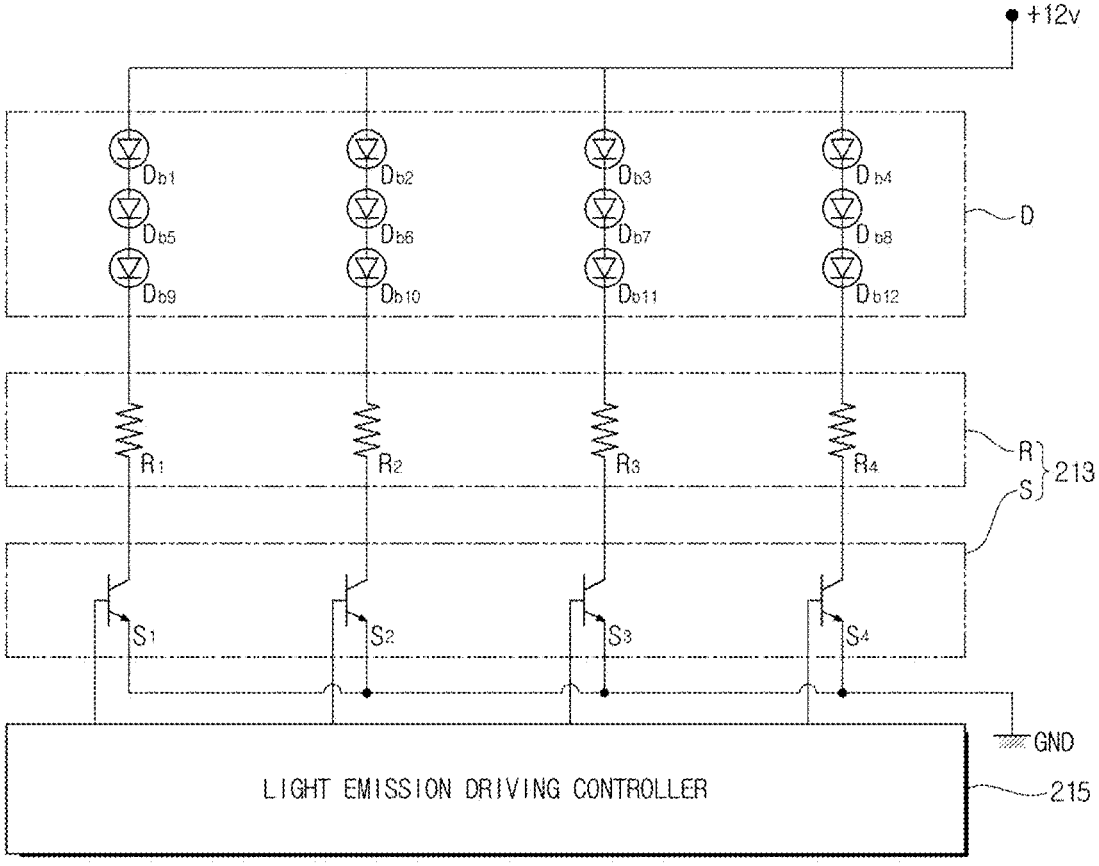
FIG. 31 is a view schematically illustrating a connection form among components in the light emitting module of FIG. 29 according to various embodiments.
Figure 32:
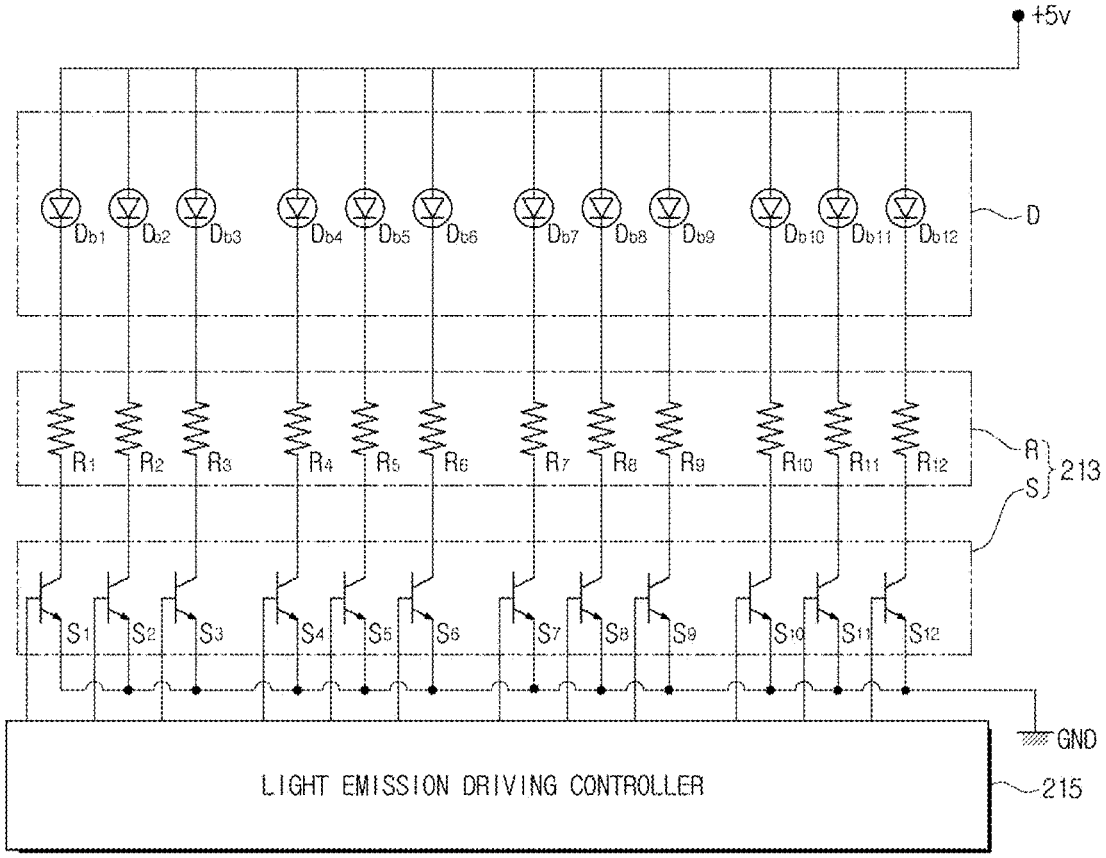
FIG. 32 is a view schematically illustrating another example of a connection form among components in the light emitting module of FIG. 29.

FIG. 29 is a view schematically illustrating an arrangement form of a plurality of light sources each including one sub light source, and FIG. 30 is a view illustrating flame images displayed on the cooking container when the plurality of light sources according to the embodiment are arranged as shown in FIG. 29. Also, FIG. 31 is a view schematically illustrating a connection form among components in the light emitting module of FIG. 29 according to various embodiments, and FIG. 32 is a view schematically illustrating another example of a connection form among components in the light emitting module of FIG. 29. Hereinafter, they will be described together to avoid a repetition of description.

Referring to FIG. 29, the plurality of light sources D1 to D12 may include B light sources Db1 to Db12 as one sub light source, respectively. Accordingly, the light emission driving controller 215 may display flame images FI shown in FIG. 30 on the side of the cooking container C.

Here, referring to FIG. 31, the B light source Db1 of the first light source D1, the B light source Db5 of the fifth light source D5, and the B light source Db9 of the ninth light source D9 are connected in series and may be connected to the light emission driving controller 215 through one output end. The B light source Db2 of the second light source D2, the B light source Db6 of the sixth light source D6, and the B light source Db10 of the tenth light source D10 are connected in series and may be connected to the light emission driving controller 215 through one output end.

Also, the B light source Db3 of the third light source D3, the B light source Db7 of the seventh light source D7, and the B light source Db11 of the eleventh light source D11 are connected in series and may be connected to the light emission driving controller 215 through one output end. Also, the B light source Db4 of the fourth light source D4, the B light source Db8 of the eighth light source D8, and the B light source Db12 of the twelfth light source D12 are connected in series and may be connected to the light emission driving controller 215 through one output end.

For example, the light emission driving controller 215 may group the B light source Db1 of the first light source D1, the B light source Db5 of the fifth light source D5, and the B light source Db9 of the ninth light source D9 as a first group, and may group the B light source Db2 of the second light source D2, the B light source Db6 of the sixth light source D6, and the B light source Db10 of the tenth light source D10 as a second group. Also, the light emission driving controller 215 may group the B light source Db3 of the third light source D3, the B light source Db7 of the seventh light source D7, and the B light source Db11 of the eleventh light source D11 as a third group, and may group the B light source Db4 of the fourth light source D4, the B light source Db8 of the eighth light source D8, and the B light source Db12 of the twelfth light source D12 as a fourth group.

In addition, the light emission driving controller 215 may group the B light source Db1 of the first light source D1, the B light source Db5 of the fifth light source D5, the B light source Db9 of the ninth light source D9, the B light source Db2 of the second light source D2, the B light source Db6 of the sixth light source D6, and the B light source Db10 of the tenth light source D10 as a first group, and may group the B light source Db3 of the third light source D3, the B light source Db7 of the seventh light source D7, the B light source Db11 of the eleventh light source D11, the B light source Db4 of the fourth light source D4, the B light source Db8 of the eighth light source D8, and the B light source Db12 of the twelfth light source D12 as a second group, and there is no limitation.

Meanwhile, the B light sources Db1 to Db12 of the first to twelfth light sources D1 to D12, as shown in FIG. 32, may be connected to first to twelfth resistor elements R1 to R12 and first to twelfth switch elements S1 to S12 in series.

The light emission driving controller 215 may group the plurality of light sources D1 to D12 using a variety of methods and may control for each group.

For example, the light emission driving controller 215 sets each of the B light sources Db1 to Db12 of the first to twelfth light sources D1 to D12 shown in FIG. 32 as one group such that totally twelve groups may be generated. As various embodiments, the light emission driving controller 215 may group the B light source Db1 of the first light source D1 as a first group and may group the B light source Db2 of the second light source D2 as a second group. The light emission driving controller 215 may generate twelve groups using this method and may separately control the twelve groups.

As still another example, the light emission driving controller 215 may group the B light sources Db1 to Db4 of the first to fourth light sources D1 to D4 as a first group, may group the B light sources Db5 to Db8 of the fifth to eight light sources D5 to D8 as a second group, and may group the B light sources Db9 to Db12 of the ninth to twelfth light sources D9 to D12 as a third group, and there is no limitation in group setting methods.

A grouping method, that is, a group setting method may be embodied as data in the form of an algorithm and a program and may be prestored in the memory of the light emission driving controller 215 or the main controller 100. Accordingly, the light emission driving controller 215 may set groups using the data stored in the memory.

Hereinafter, the light source driver circuit 213 of the light emitting module 210 will be described in detail.

Referring to FIG. 23, the plurality of switch elements S1 to S12 control supplying of driving currents to the plurality of light sources D1 to D12, and the resistor elements R1 to R12 may be connected in series between the plurality of switch elements S1 to S12 and the plurality of light sources D1 to D12.

For example, as shown in FIG. 23, the first switch element S1 may be connected in series to a first R light source Dr11 of the first light source D1, a first R light source Dr12 of the second light source D2, and a first R light source Dr13 of the third light source D3 that are connected in series.

A driving current may be supplied to or cut off from the sub light sources of the plurality of light sources D1 to D12 depending on turning on/off of the plurality of switch elements S1 to S12. Here, the turning on/off of the plurality of switch elements S1 to S12 may be driven by the light emission driving controller 215.

For example, when the first switch element S1 is turned on, a driving current is supplied to the first R light source Dr11 of the first light source D1, the first R light source Dr12 of the second light source D2, the first R light source Dr13 of the third light source D3, which are connected to the first switch element S1 in series, such that the first R light source Dr11 of the first light source D1, the first R light source Dr12 of the second light source D2, the first R light source Dr13 of the third light source D3 may output red light.

As another example, when the first switch element S1 is turned off, a driving current is not supplied to the first R light source Dr11 of the first light source D1, the first R light source Dr12 of the second light source D2, the first R light source Dr13 of the third light source D3, which are connected to the first switch element S1 in series, such that the first R light source Dr11 of the first light source D1, the first R light source Dr12 of the second light source D2, the first R light source Dr13 of the third light source D3 do not output any light.

Here, the plurality of switch elements S1 to S12 may be embodied as metal-oxide-semiconductor field effect transistors (MOSFETs), bipolar junction transistors (BJTs), or the like and additionally may be embodied as a variety of types of well-known electrical elements that are turned on/off depending on a current.

The plurality of resistor elements R1 to R12 may limit driving currents supplied to the plurality of light sources D1 to D12. When the plurality of resistor elements R1 to R12 are not present between the plurality of switch elements S1 to S12 and the plurality of light sources D1 to D12, a very high level of driving current may be supplied to each of the plurality of light sources D1 to D12 such that not only the plurality of light sources D1 to D12 but also the plurality of switch elements S1 to S12 may be damaged. Accordingly, the light source driver circuit 213 according to the embodiment may be designed to locate the plurality of resistor elements R1 to R12 between the plurality of switch elements S1 to S12 and the plurality of light sources D1 to D12.

Meanwhile, the light emitting module 210 may include the light emission driving controller 215 that controls an overall operation of the light emitting module 210. The light emission driving controller 215 may include a processor, generate a control signal, and control operations of the components in the light emitting module 210 through the generated control signal.

The light emission driving controller 215 may control turning on/off of the switch elements S1 to S12 on the basis of a control signal received from the main controller 100. For example, the light emission driving controller 215 may turn on all the switch elements S1 to S12 through a control signal. Here, the flame images FI shown in FIG. 13 may be shown on the side of the cooking container C. As another example, the light emission driving controller 215 may turn off all the switch elements S1 to S12 through a control signal. Then, all the flame images FI that appear on the side of the cooking container C may disappear.

The light emission driving controller 215 may control turning on/off of the switch elements S1 to S12 for each group on the basis of at least one of a control command received from a user, a grouping form of a plurality of light sources, and a preset operation pattern.

Hereinafter, a case in which the light emission driving controller 215 controls groups according to a variety of parameters will be described. For convenience of description, hereinafter, it will be described on the assumption of a case in which sub light sources are connected as shown in FIG. 23. However, embodiments that will be described below are not limited thereto.

Figure 34A:
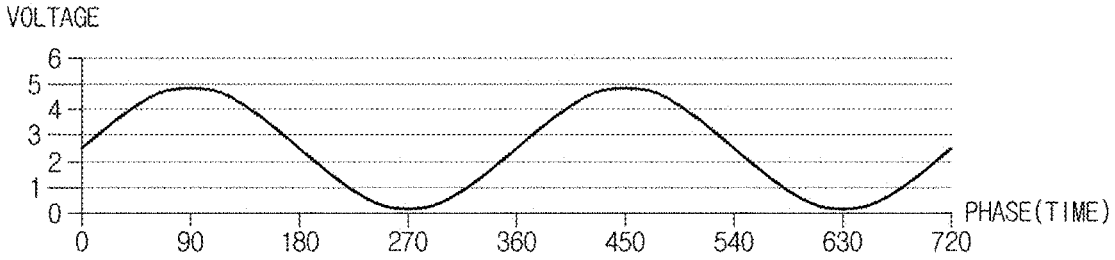
FIG. 34A is a view schematically illustrating a periodic signal of a first group according to various embodiments.
Figure 34B:
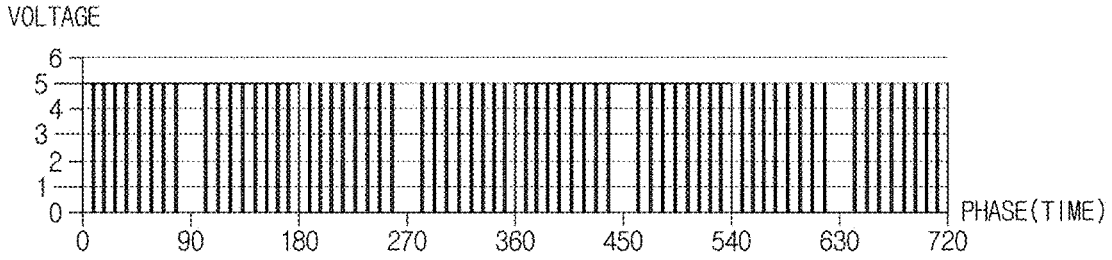
FIG. 34B is a view schematically illustrating a driving signal applied to the first group according to various embodiments.
Figure 35A:
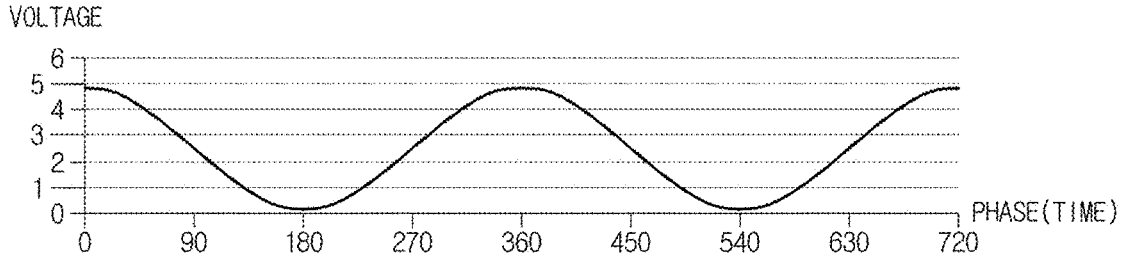
FIG. 35A is a view schematically illustrating a periodic signal of a second group according to various embodiments.
Figure 35B:
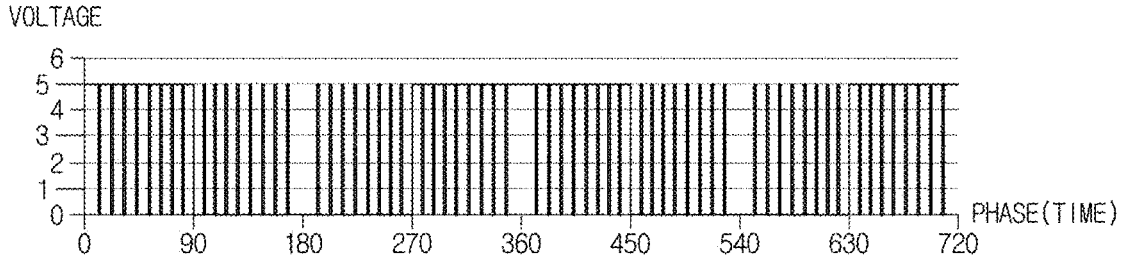
FIG. 35B is a view schematically illustrating a driving signal applied to the second group according to various embodiments.
Figure 36A:
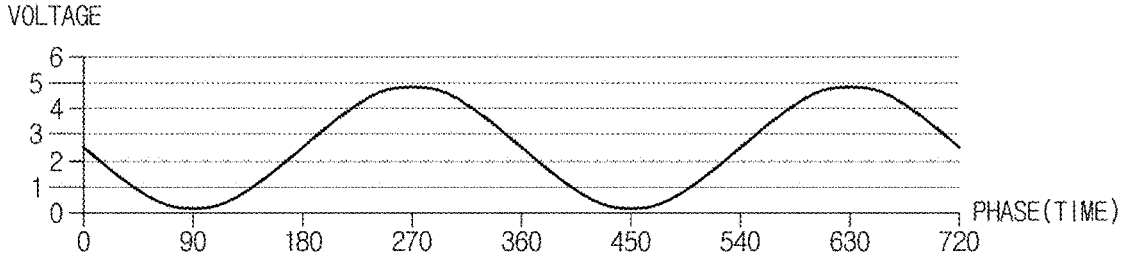
FIG. 36A is a view schematically illustrating a periodic signal of a third group according to various embodiments.
Figure 36B:
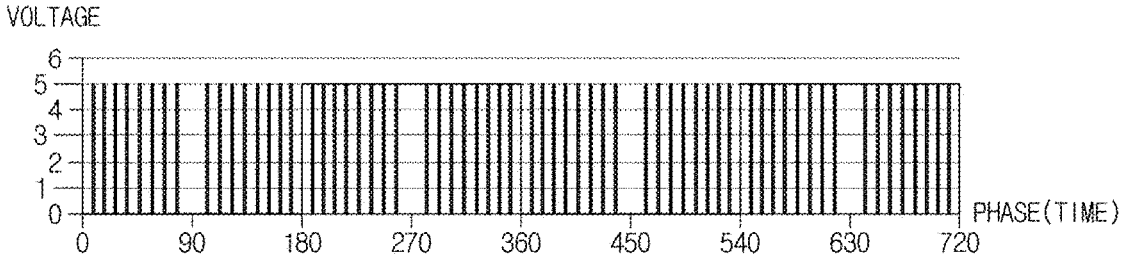
FIG. 36B is a view schematically illustrating a driving signal applied to the third group according to various embodiments.
Figure 37A:
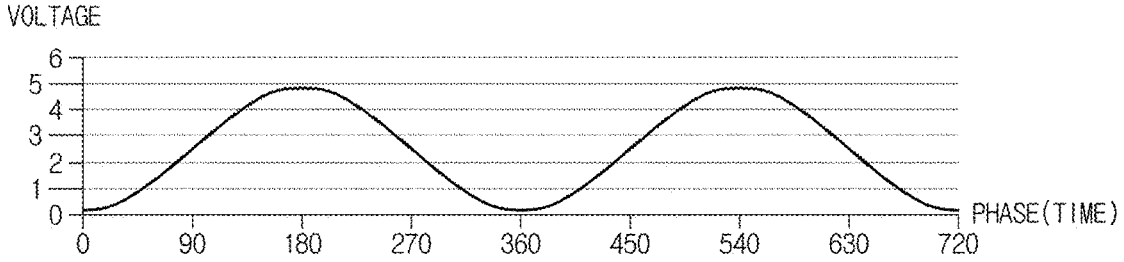
FIG. 37A is a view schematically illustrating a periodic signal of a fourth group according to various embodiments.
Figure 37B:
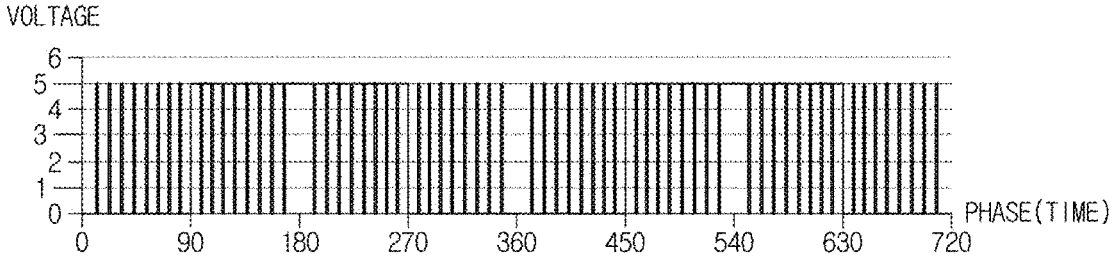
FIG. 37B is a view schematically illustrating a driving signal applied to the fourth group according to various embodiments.

FIG. 34A is a view schematically illustrating a periodic signal of a first group according to various embodiments, and FIG. 34B is a view schematically illustrating a driving signal applied to the first group according to various embodiments. Also, FIG. 35A is a view schematically illustrating a periodic signal of a second group according to various embodiments, and FIG. 35B is a view schematically illustrating a driving signal applied to the second group according to various embodiments. Otherwise, FIG. 36A is a view schematically illustrating a periodic signal of a third group according to various embodiments, and FIG. 36B is a view schematically illustrating a driving signal applied to the third group according to various embodiments. Also, FIG. 37A is a view schematically illustrating a periodic signal of a fourth group according to various embodiments, and FIG. 37B is a view schematically illustrating a driving signal applied to the fourth group according to various embodiments.

Figure 38A:
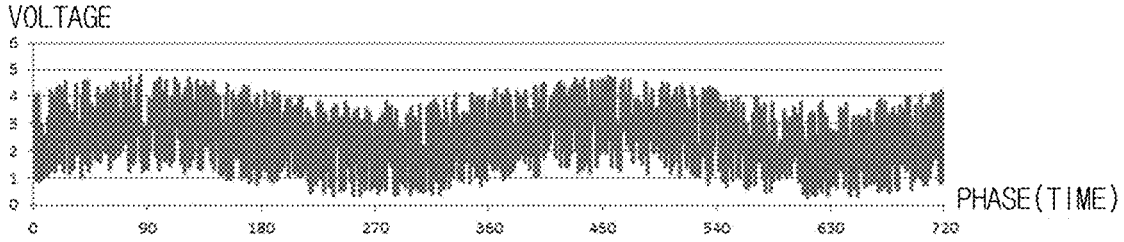
FIG. 38A is a view schematically illustrating a signal formed by synthesizing the periodic signal of the first group and a random signal according to various embodiments.
Figure 38B:
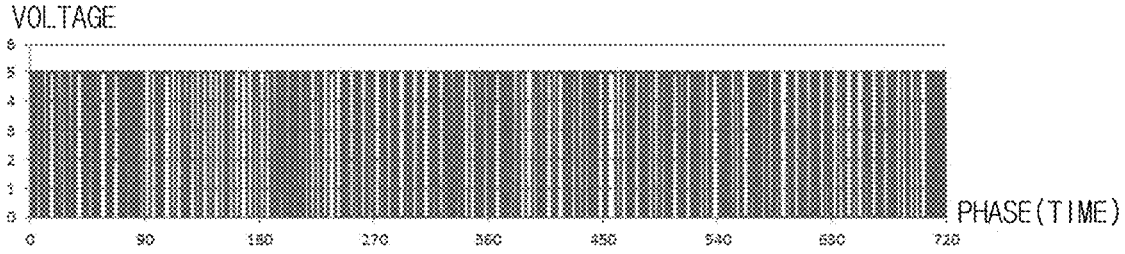
FIG. 38B is a view schematically illustrating a driving signal applied to the first group according to various embodiments.
Figure 39A:
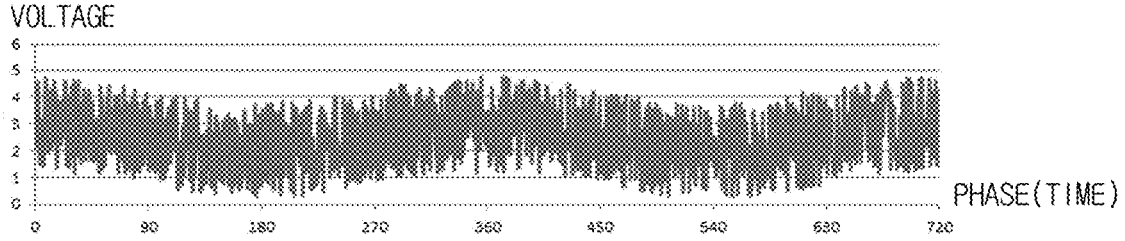
FIG. 39A is a view schematically illustrating a signal formed by synthesizing the periodic signal of the second group and a random signal according to various embodiments.
Figure 39B:
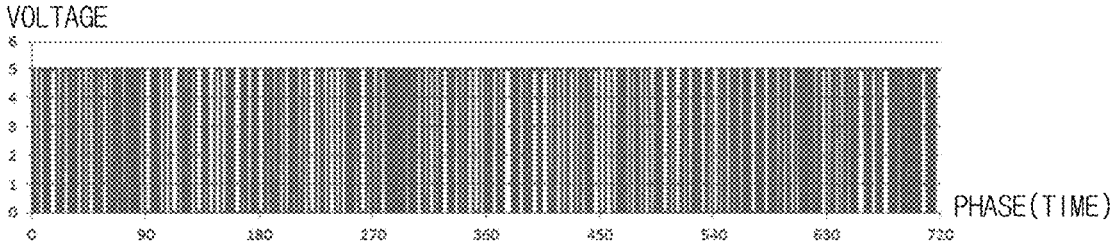
FIG. 39B is a view schematically illustrating a driving signal applied to the second group according to various embodiments.
Figure 40A:
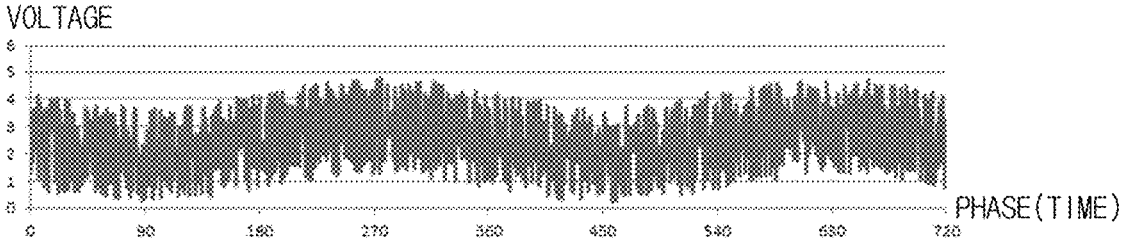
FIG. 40A is a view schematically illustrating a signal formed by synthesizing the periodic signal of the third group and a random signal according to various embodiments.
Figure 40B:
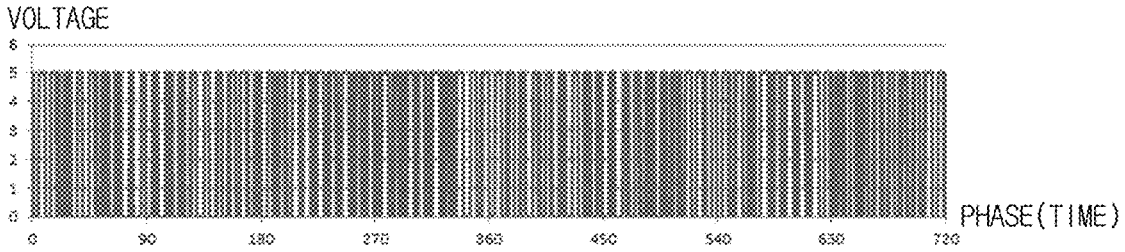
FIG. 40B is a view schematically illustrating a driving signal applied to the third group according to various embodiments.
Figure 41A:
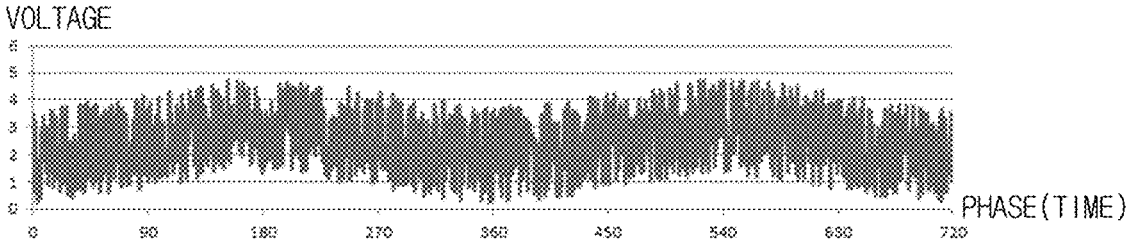
FIG. 41A is a view schematically illustrating a signal formed by synthesizing the periodic signal of the fourth group and a random signal according to various embodiments.
Figure 41B:
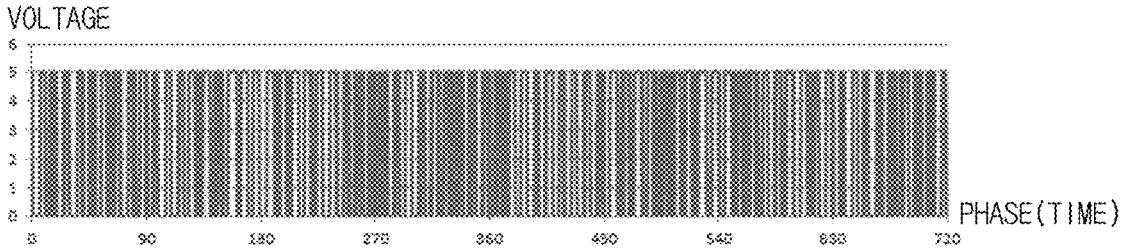
FIG. 41B is a view schematically illustrating a driving signal applied to the fourth group according to various embodiments.

Also, FIG. 38A is a view schematically illustrating a signal formed by combining the periodic signal of the first group and a random signal according to various embodiments, and FIG. 38B is a view schematically illustrating a driving signal applied to the first group according to various embodiments. Also, FIG. 39A is a view schematically illustrating a signal formed by combining the periodic signal of the second group and a random signal according to various embodiments, and FIG. 39B is a view schematically illustrating a driving signal applied to the second group according to various embodiments. Also, FIG. 40A is a view schematically illustrating a signal formed by combining the periodic signal of the third group and a random signal according to various embodiments, and FIG. 40B is a view schematically illustrating a driving signal applied to the third group according to various embodiments. Also, FIG. 41A is a view schematically illustrating a signal formed by combining the periodic signal of the fourth group and a random signal according to various embodiments, and FIG. 41B is a view schematically illustrating a driving signal applied to the fourth group according to various embodiments. Hereinafter, they will be described together to avoid a repetition of description.

For example, when a user adjusts an output level by manipulating the operation dial 15, the main controller 100 may receive a command for adjusting the output level from the user interface 120 and transmit the command to the light emission driving controller 215. Then, the light emission driving controller 215 may adjust brightness and a size of a flame image FI formed on the side of the cooking container C to correspond to the output level input by the user.

The light emission driving controller 215 may generate a driving signal to correspond to the output level. For example, the light emission driving controller 215 may adjust strength of light output from the plurality of light sources D1 to D12 by generating a driving signal through pulse width modulation (PWM) and applying the generated driving signal to the plurality of light sources D1 to D12. Here, the light emission driving controller 215 may allow more realistic flame images to be shown on the cooking container C by generating a driving signal for each group and applying the generated driving signal for each group. A detailed description thereof will be described below.

For example, the light emission driving controller 215 may generate a driving signal by performing PWM on a periodic signal having a certain period. Here, the periodic signal is a signal having a certain period and may include a variety of well-known periodic signals such as a sine signal, a cosine signal, and the like.

Figure 33:
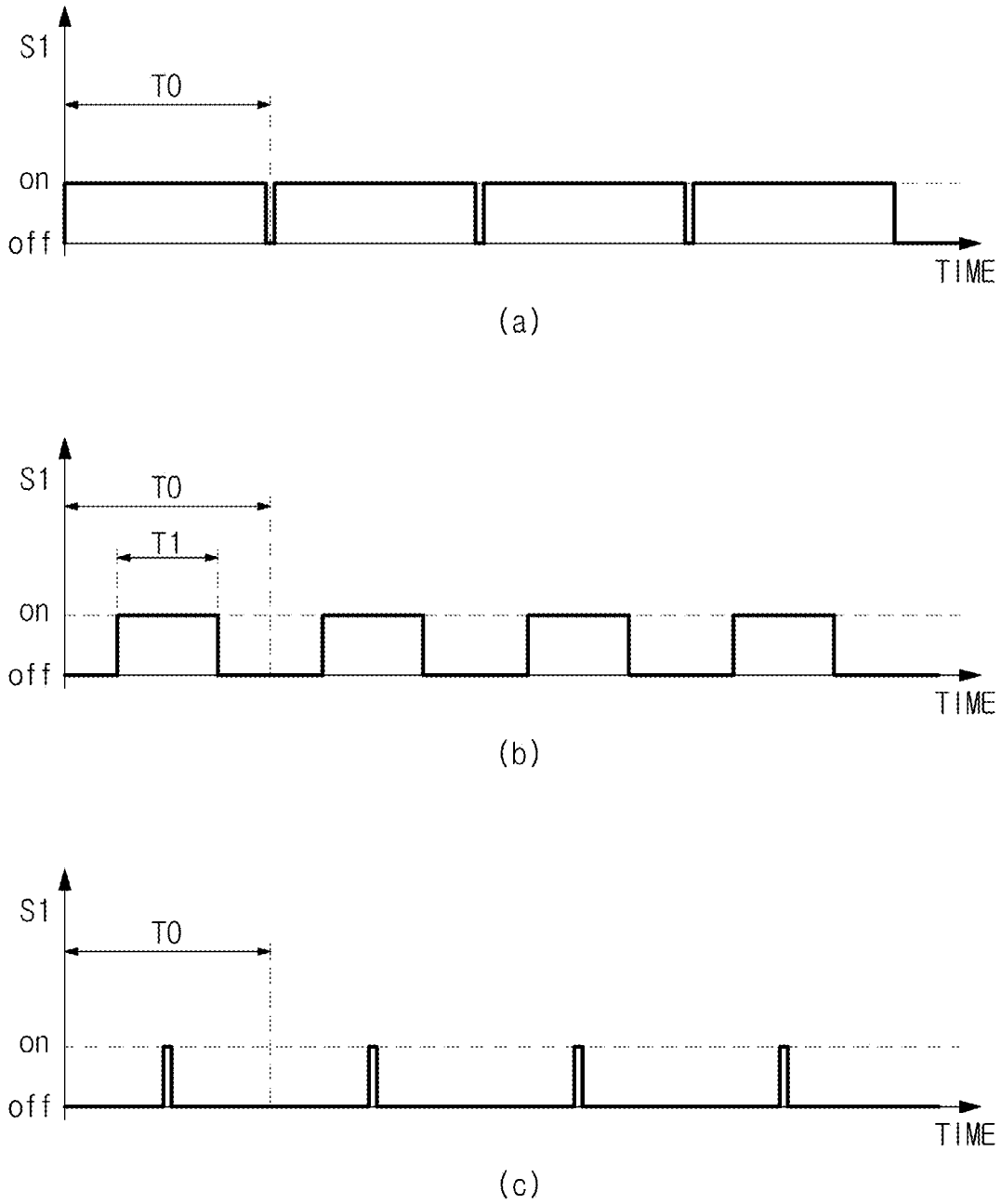
FIG. 33 is a view illustrating a case of adjusting intensity of emitted light according to various embodiments.

The light emission driving controller 215 may set a pulse width period for PWM, generate a driving signal with an adjusted duty ratio of an ON signal output to the switch elements S1 to S12 within a PWM period, and adjust strength of output light by applying the generated driving signal. Here, the pulse width period for PWM may correspond to a period of a periodic signal but is not limited thereto. The duty ratio of the ON signal refers to a ratio of an output time amount of the ON signal to the PWM period. In FIG. 33, the PWM period may correspond to T0, and the output time of the ON signal may correspond to T1.

For example, the light emission driving controller 215 may adjust the duty ratio of the ON signal output to the switch element S1 to be 100% as shown in FIG. 33A in order to allow the sub light sources Dr11, Dr12, and Dr13 connected to the switch element S1 to output light with maximum strength. As another example, the light emission driving controller 215 may adjust the duty ratio of the ON signal to be 50% as shown in FIG. 33B in order to allow the sub light sources Dr11, Dr12, and Dr13 connected to the switch element S1 to output light with 50% strength. As still another example, the light emission driving controller 215 may set the duty ratio of the ON signal to be 0% as shown in FIG. 33C in order not to allow the sub light sources Dr11, Dr12, and Dr13 connected to the switch element S1 to output light.

In other words, the light emission driving controller 215 may adjust strength of light output from the plurality of light sources D1 to D12 by generating a driving signal formed by adjusting the duty ratio of the ON signal with respect to the plurality of switch elements S1 to S12.

Here, the light emission driving controller 215 may adjust brightness and the size of the flame image FI by adjusting strength of light for each group. For example, the light emission driving controller 215, in order to represent more realistic flame images, may differently set sizes of driving signals applied to groups rather than uniformly reducing sizes of the driving signals applied to the groups.

For example, when it is necessary to adjust strength of light output from the plurality of light sources D1 to D12 according to a command for adjusting an output level, the light emission driving controller 215 may control not to simultaneously adjust and to sequentially adjust output strength of all sub light sources connected to a plurality of groups. As various embodiments, when the output level is adjusted from 9 to 5, the light emission driving controller 215 may sequentially apply a driving signal for each group from a first group to a fourth group to adjust strength of light output therefrom. The light emission driving controller 215 may control to sequentially adjust strength of light by setting a phase difference between driving signals applied to the groups.

As another example, to represent more realistic flame image, the light emission driving controller 215 may stop applying of a driving signal to at least one of a plurality of groups at or below a preset output level. In other words, at or below a preset output level, the light emission driving controller 215 may control not to allow at least one of a plurality of groups to output light.

In addition, the light emission driving controller 215 may set a difference between driving signals applied to groups to represent more vivid flame images.

For example, the plurality of light sources D1 to D12 are divided into four groups, the light emission driving controller 215 may set a phase difference between periodic signals that are source signals of driving signals applied to the four groups.

A driving signal, that is, a PWM signal may be generated by performing PWM with respect to the periodic signal as described above. For example, the light emission driving controller 215 may generate a PWM signal by performing PWM on a sine signal and may apply the PWM signal to input ends of the plurality of light sources D1 to D12.

The light emission driving controller 215 may generate four sine waves to allow a phase difference between a periodic signal of a first group and a periodic signal of a second group to be 90°, to allow a phase difference between the periodic signal of the second group and a periodic signal of a third group to be 90°, and to allow a phase difference between the periodic signal of the third group and a periodic signal of a fourth group to be 90°.

FIG. 34A is a view illustrating a sine signal of the first group, FIG. 35A is a view illustrating a sine signal of the second group, FIG. 36A is a view illustrating a sine signal of the third group, and FIG. 37A is a view illustrating a sine signal of the fourth group. The x-axis of a graph corresponds to a phase but may be represented by time, and the y-axis corresponds to a voltage but may be represented by a current.

Here, a phase difference between the sine signal of FIG. 34A and the sine signal of FIG. 35A may be 90°, a phase difference between the sine signal of FIG. 35A and the sine signal of FIG. 36A may be 90°, a phase difference between the sine signal of FIG. 36A and the sine signal of FIG. 37A may be 90°, and a phase difference between the sine signal of FIG. 37A and the sine signal of FIG. 38A may be 90°.

The light emission driving controller 215 may generate the sine signals as shown in FIGS. 34A, 35A, 36A, and 37A and then may generate driving signals as shown in FIGS. 34B, 35B, 36B, and 37B by performing PWM on the sine signals. Then, the light emission driving controller 215 may apply the generated driving signals to output ends connected to the groups. Accordingly, the cooking apparatus 1 according to the embodiment may display more vivid flame images by a difference between lights output from the plurality of light sources D1 to D12 being set.

Meanwhile, the light emission driving controller 215, in order to represent more realistic flame images, may generate driving signals by adding an aperiodic signal to the periodic signal and then performing PWM thereon.

For example, the light emission driving controller 215 may add a random signal, as an example of the aperiodic signal, to each of the sine signals as shown in FIGS. 34A, 35A, 36A, and 37A. FIG. 38A is a view illustrating a signal waveform of the first group, FIG. 39A is a view illustrating a signal waveform of the second group, FIG. 40A is a view illustrating a signal waveform of the third group, and FIG. 41A is a view illustrating a signal waveform of the fourth group.

The light emission driving controller 215 may generate the signal waveforms as shown in FIGS. 38A, 39A, 40A, and 41A by adding a random signal to each of the sine signals as shown in FIGS. 34A, 35A, 36A, and 37A. For example, the light emission driving controller 215 may generate the above-described signal waveforms on the basis of following Equation 1.

$$\text{Applied Signal} = \text{Offset} + \text{Gain} * \text{Sine}(\text{Angle} + \theta) + \text{Random}(\,) \qquad \text{[Equation 1]}$$

Here, the applied signal refers to a driving signal before performing PWM thereon, and Offset refers to a minimum driving output value necessary for a sub light source to output light and may be a current or voltage value. Also, Gain may refer to a gain, Sine(Angle+θ) may refer to a sine signal, and Random( ) may refer to a random signal.

Here, a θ value may differ for each group. For example, the light emission driving controller 215 may input 0 for a θ value with respect to a signal applied to a first group, may input 90° for a θ value with respect to a signal applied to a second group, may input 180° for a θ value with respect to a signal applied to a third group, and may input 270° for a θ value with respect to a signal applied to a fourth group. Accordingly, driving signals generated through PWM and applied to the first to fourth groups may be shown as the signal waveforms as shown in FIGS. 38B, 39B, 49B, and 41B.

The light emission driving controller 215 according to the embodiment may not only set a difference between the driving signals applied to the groups but also generate the driving signals on the basis of random signals and thus generate more vivid flame images.

Meanwhile, the cooking apparatus 1 according to the embodiment may perform a variety of types of group control on the basis of a control command received from the user. Hereinafter, first, a group control process performed by the cooking apparatus 1 according to receiving an operation initiation/stop command will be described.

Figure 42:
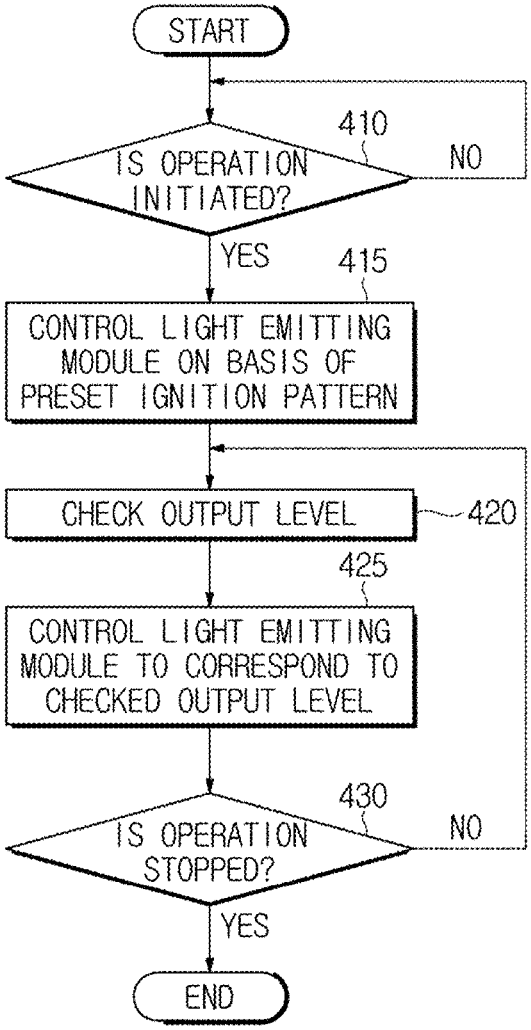
FIG. 42 is a flowchart schematically illustrating operations of the light emitting module according to inputting of an ignition-initiation command and an output level adjustment command according to various embodiments.
Figure 43A:
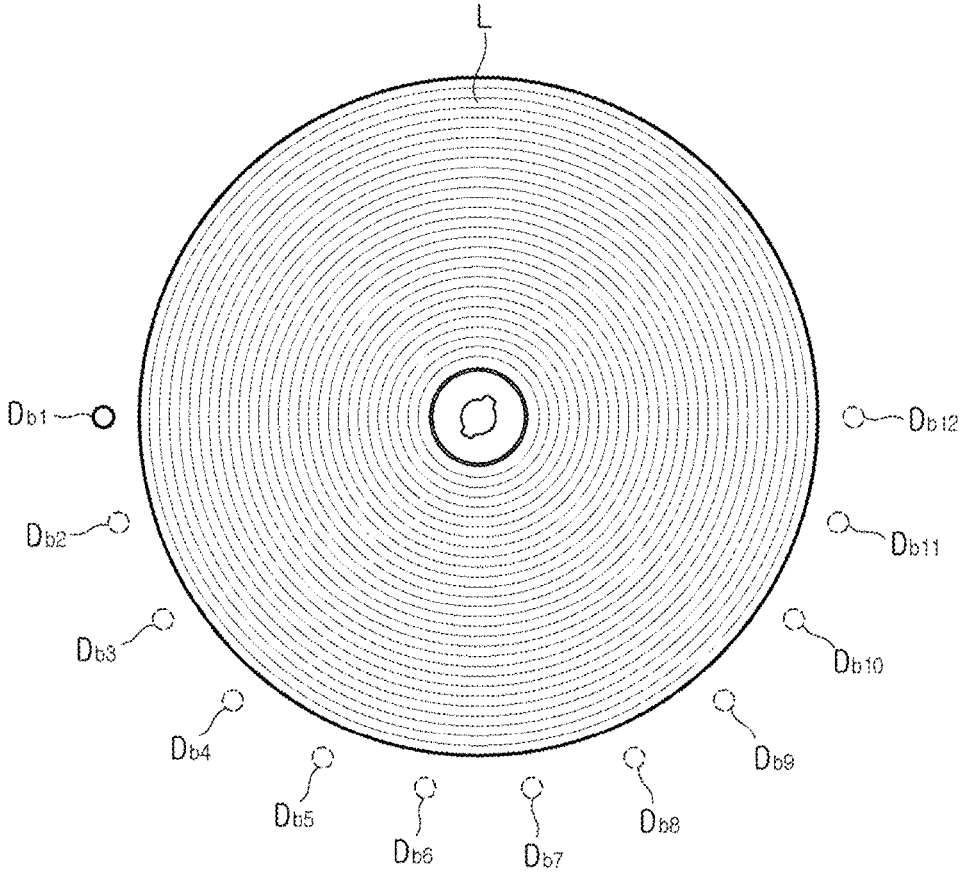
FIGS. 43A, 43B, and 43C are views illustrating operation patterns according to the ignition-initiation command according to different embodiments.
Figure 43B:
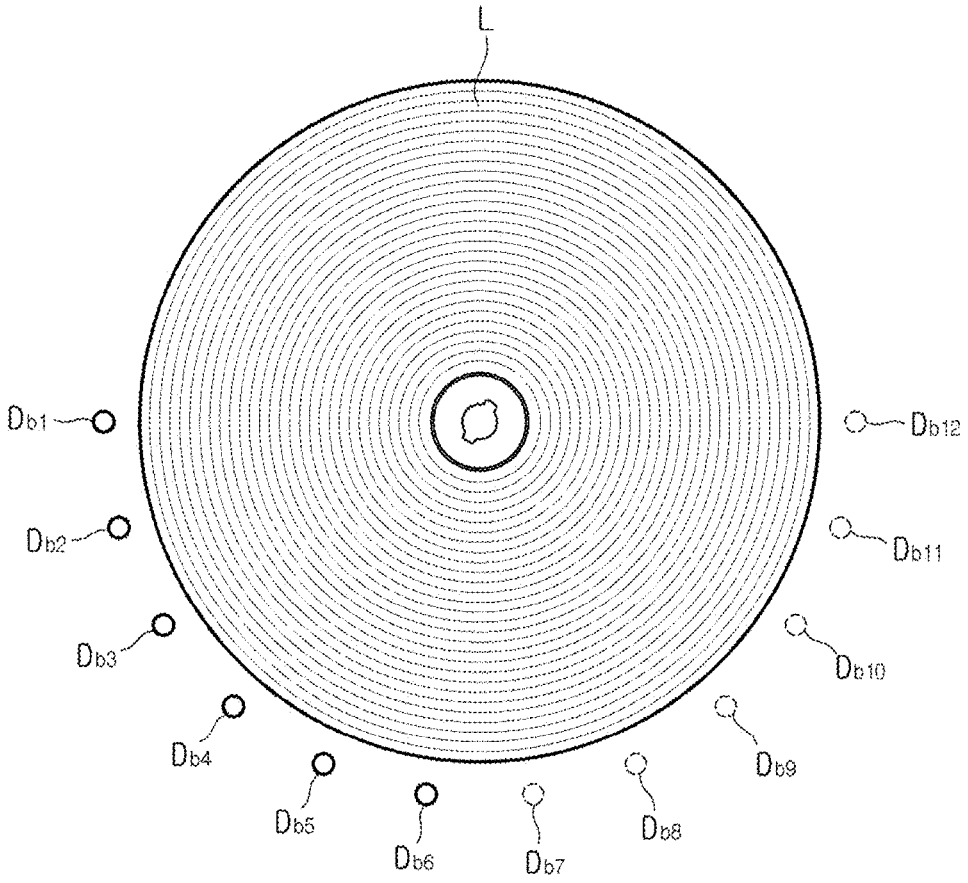
Figure 43C:
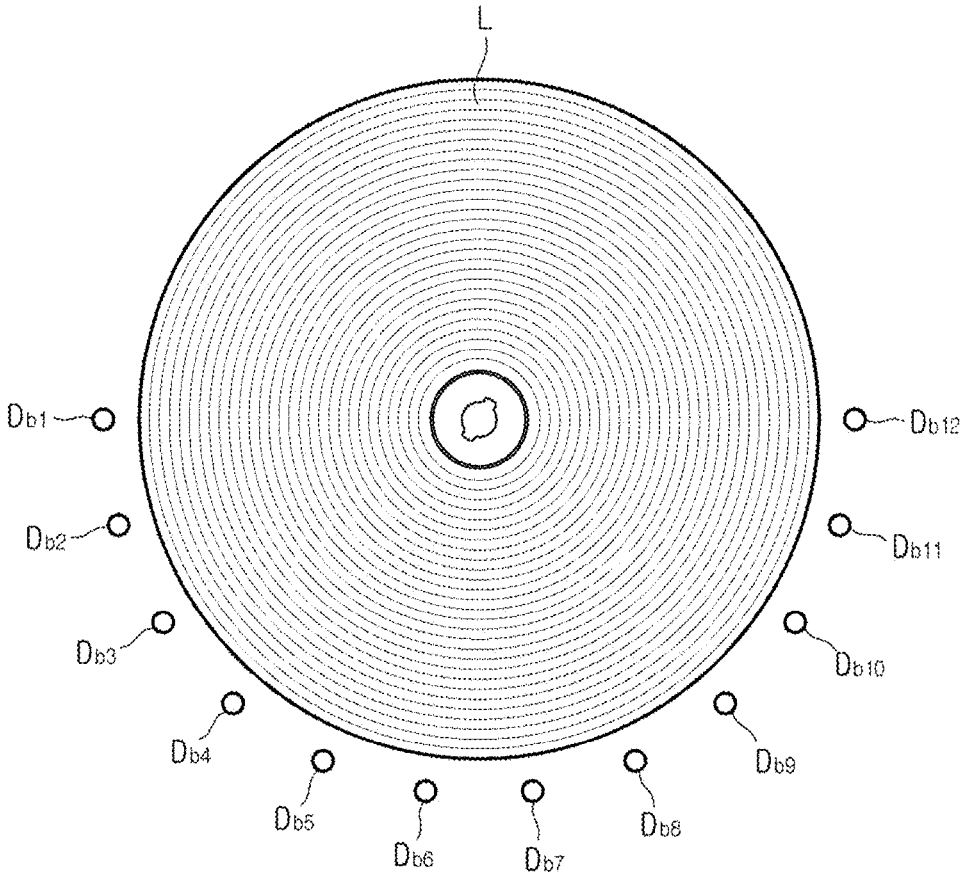
Figure 44A:
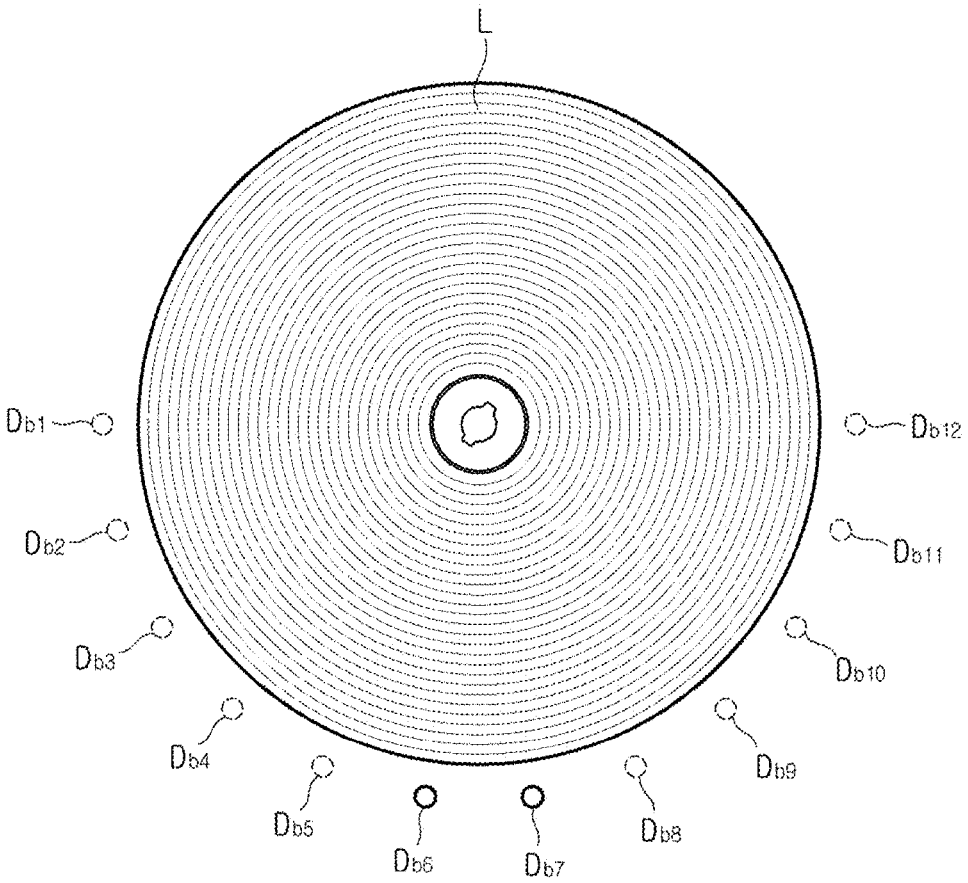
FIGS. 44A, 44B, and 44C are views illustrating operation patterns according to the ignition-initiation command according to different embodiments.
Figure 44B:
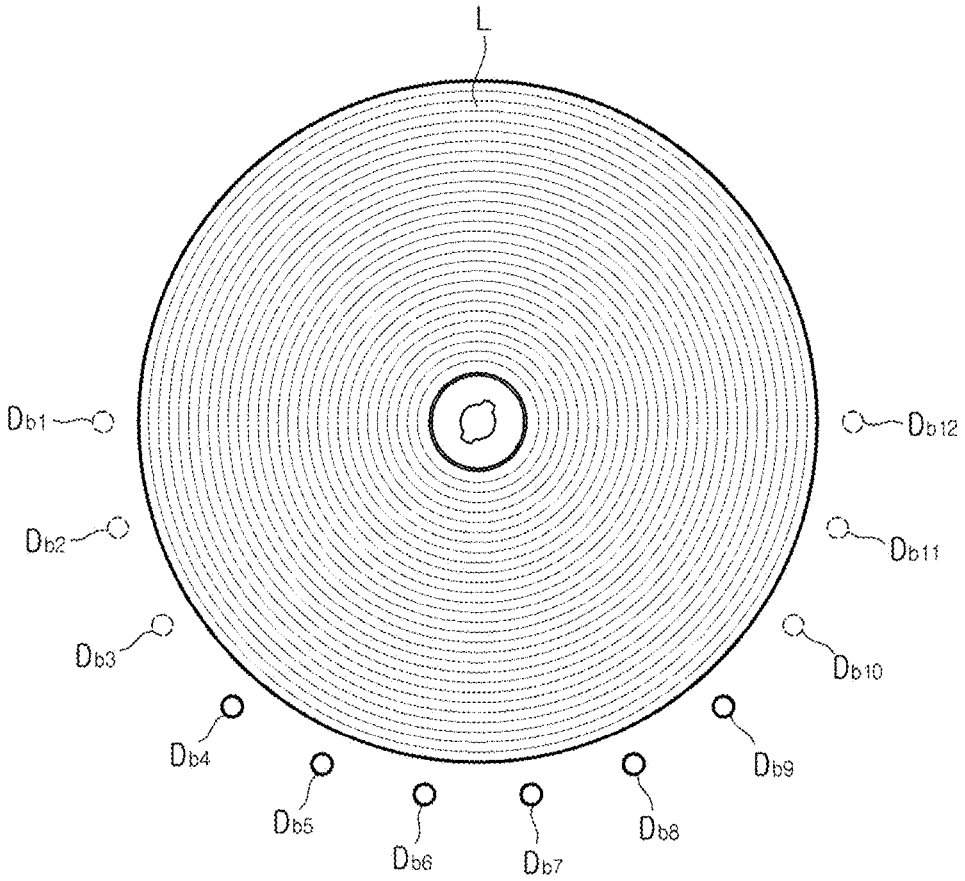
Figure 44C:
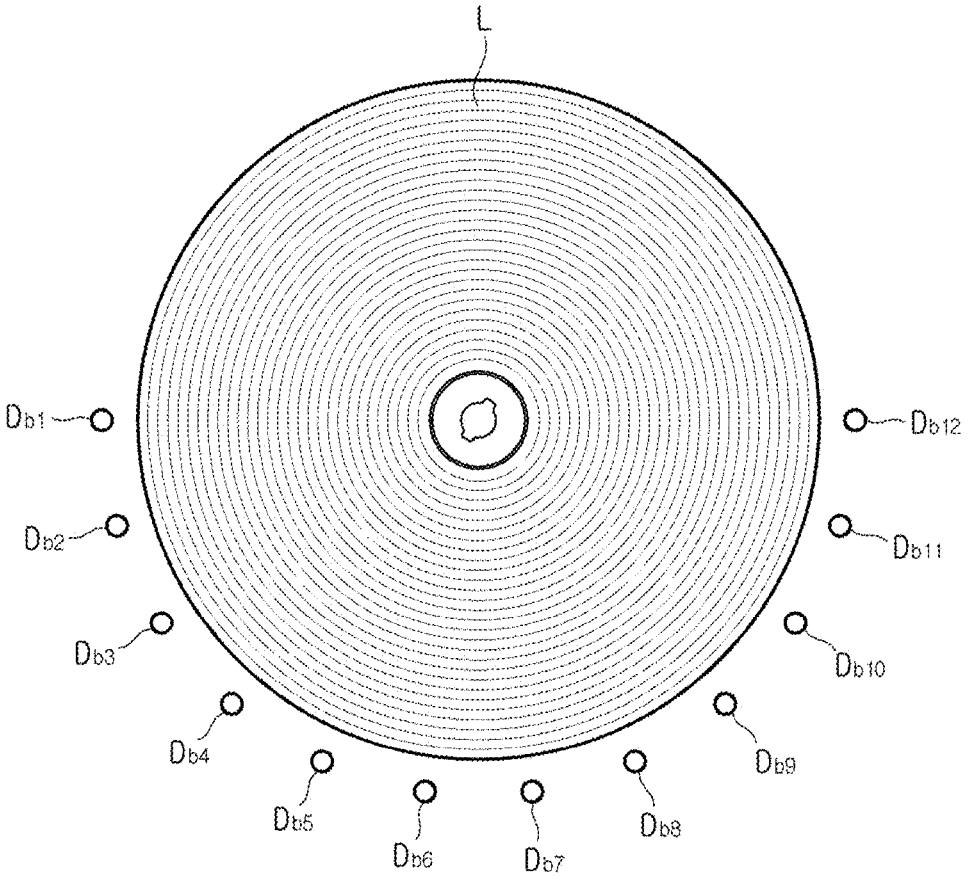

FIG. 42 is a flowchart schematically illustrating operations of the light emitting module according to inputting of an ignition-initiation command and an output level adjustment command according to various embodiments, FIGS. 43A, 43B, and 43C are views illustrating operation patterns according to the ignition-initiation command according to different embodiments, and FIGS. 44A, 44B, and 44C are views illustrating operation patterns according to the ignition-initiation command according to different embodiments. Hereinafter, they will be described together to avoid a repetition of description.

Referring to FIG. 42, the light emission driving controller 215 may determine whether an operation initiation command is input (410). For example, when the operation initiation command is input by a user through the user interface 120, the user interface 120 may transmit the operation initiation command to the main controller 100. Then, by receiving the operation initiation command from the main controller 100, the light emission driving controller 215 may determine that the operation initiation command is input.

When it is determined that the operation initiation command is input, the light emission driving controller 215 may control the components in the light emitting module 210 on the basis of a preset ignition pattern (415).

For example, the plurality of light sources D1 to D12, as shown in FIGS. 43A to 43C, may include B light sources Db1 to Db12, respectively. The light emission driving controller 215 may allow the user to feel an ignition be actually performed by allowing at least one of a plurality of such B light sources Db1 to Db12 to sequentially output light.

As various embodiments, the light emission driving controller 215, as shown in FIG. 43A, may control to allow a first B light source Db1 to output light to generate one flame image and to allow a second B light source Db2, a third B light source Db3, a fourth B light source Db4, a fifth B light source Db5, and a sixth B light source Db6 to sequentially output light. Accordingly, the light emission driving controller 215, as shown in FIG. 43B, may control the first to sixth B light sources Db1 to Db6 to output light to generate six flame images.

Next, the light emission driving controller 215 may control a seventh B light source Db7, an eighth B light source Db8, a ninth B light source Db9, a tenth B light source Db10, an eleventh B light source Db11, and a twelfth B light source Db12 to sequentially output light. Accordingly, the light emission driving controller 215, as shown in FIG. 43C, may control the first to twelfth B light sources Db1 to Db12 to output light to generate twelve flame images such that the user may feel the ignition be actually performed.

As still another example, the light emission driving controller 215 may allow two flame images to be generated by outputting light from the sixth and seventh B light sources Db6 and Db7 as shown in FIG. 44A and then allow six flame images to be generated by outputting light from the fourth to ninth B light sources Db4 to Db9 as shown in FIG. 44B. Next, the light emission driving controller 215, as shown in FIG. 44C, may control the first to twelfth B light sources Db1 to Db12 to output light by increasing lighting to generate twelve flame images such that the user may feel the ignition be actually performed.

That is, the light emission driving controller 215 may control one or more light sources to sequentially output light according to a preset order for a preset amount of time to generate flame images. Here, the preset amount of time may refer to an amount of time generally consumed for representing all flame images when an actual ignition is performed. Information on the preset amount of time may be prestored in the memory of the light emission driving controller 215 or the main controller 100 and may be changed by the user later.

Also, during the operation, the user may input a command for adjusting an output level through the user interface 120. Then, the light emission driving controller 215 may receive the command for adjusting the output level from the main controller 100 and may check an output level input by the user (420).

The light emission driving controller 215 may adjust strength of light output from the plurality of light sources D1 to D12 to correspond to the output level that is input. Here, the light emission driving controller 215 may be simultaneously or may sequentially adjust the strength of light output from all groups. Otherwise, the light emission driving controller 215 may adjust the strength of light with respect to at least one of a plurality of groups and may perform a variety of operations for naturally representing flame images.

Also, when the output level input by the user is a preset output level or below, the light emission driving controller 215 stops applying a driving signal with respect to at least one of the plurality of groups such that the user may feel like experiencing flames of an actual gas stove.

Figure 45:
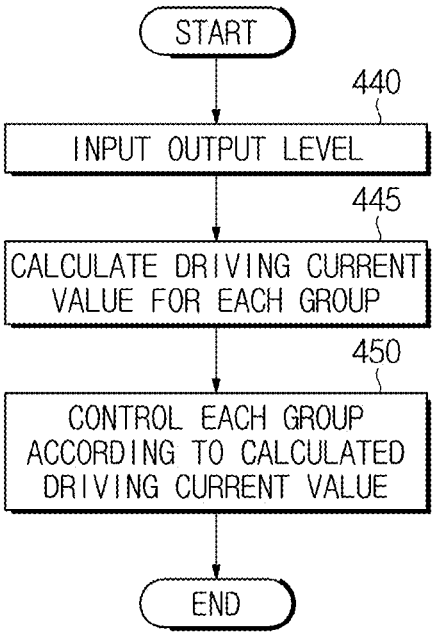
FIG. 45 is a flowchart schematically illustrating an operation of calculating a driving current value for each group to correspond to an output level value that the cooking apparatus, according to various embodiments, receives.

FIG. 45 is a flowchart schematically illustrating an operation of calculating a driving current value for each group to correspond to an output level value that the cooking apparatus according to various embodiments receives.

Referring to FIG. 45, the user may input a command for adjusting an output level through the user interface 120. Then, the coil driving controller 115 may receive the command for adjusting an output level from the main controller 100 and may adjust strength of a magnetic filed induced by the induction heating coil L to correspond to the received output level. Also, the light emission driving controller 215 may receive the command for adjusting the output level from the main controller 100 and may adjust a size of flame images and the like to correspond to the output level.

Here, the light emission driving controller 215 may calculate a driving current value for each group (445). The light emission driving controller 215 sets a difference driving current values applied to one or more groups as described above such that a plurality of vivid flames that are not uniform may be displayed.

For example, the light emission driving controller 215 may set driving current values applied to the groups to have a difference therebetween as a preset amount of time or a preset phase. As various embodiments, when a plurality of light sources are grouped into three, the light emission driving controller 215 may generate driving signals to set a phase difference of 120° among driving signals applied to the groups and may calculate driving current values based on the generated driving signals. As another embodiment, when a plurality of light sources are grouped into six, the light emission driving controller 215 may generate driving signals to set a phase difference of 60° among driving signals applied to the groups and may calculate driving current values based on the generated driving signals.

Then, the light emission driving controller 215 may perform control for each group according to the calculated driving current values (450). The light emission driving controller 215 may control flame images for each group by applying a driving current to an input end that belongs to each group according to the calculated driving current value. Accordingly, the light emission driving controller 215 may not only represent vivid flame images rather than uniform flame images but also control the plurality of light sources with a lower complexity level than separately controlling the plurality of light sources.

Hereinafter, a lens shape embodied according to the number of sub light sources included in a light source will be described.

Figure 46:
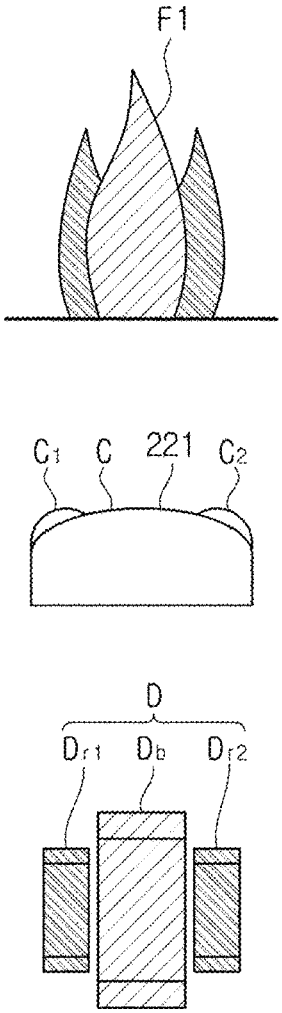
FIG. 46 is a view illustrating a flame image and a lens shape embodied when a light source includes three sub light sources according to various embodiments.
Figure 47:
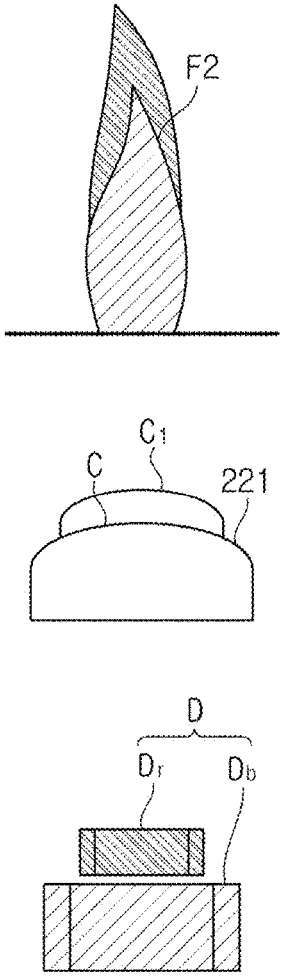
FIG. 47 is a view illustrating a flame image and a lens shape embodied when a light source includes two sub light sources according to various embodiments.
Figure 48:
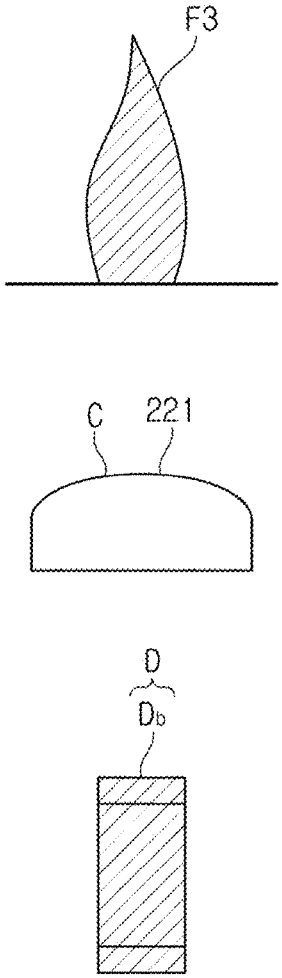
FIG. 48 is a view illustrating a flame image and a lens shape embodied when a light source includes one sub light source according to various embodiments.
Figure 49:
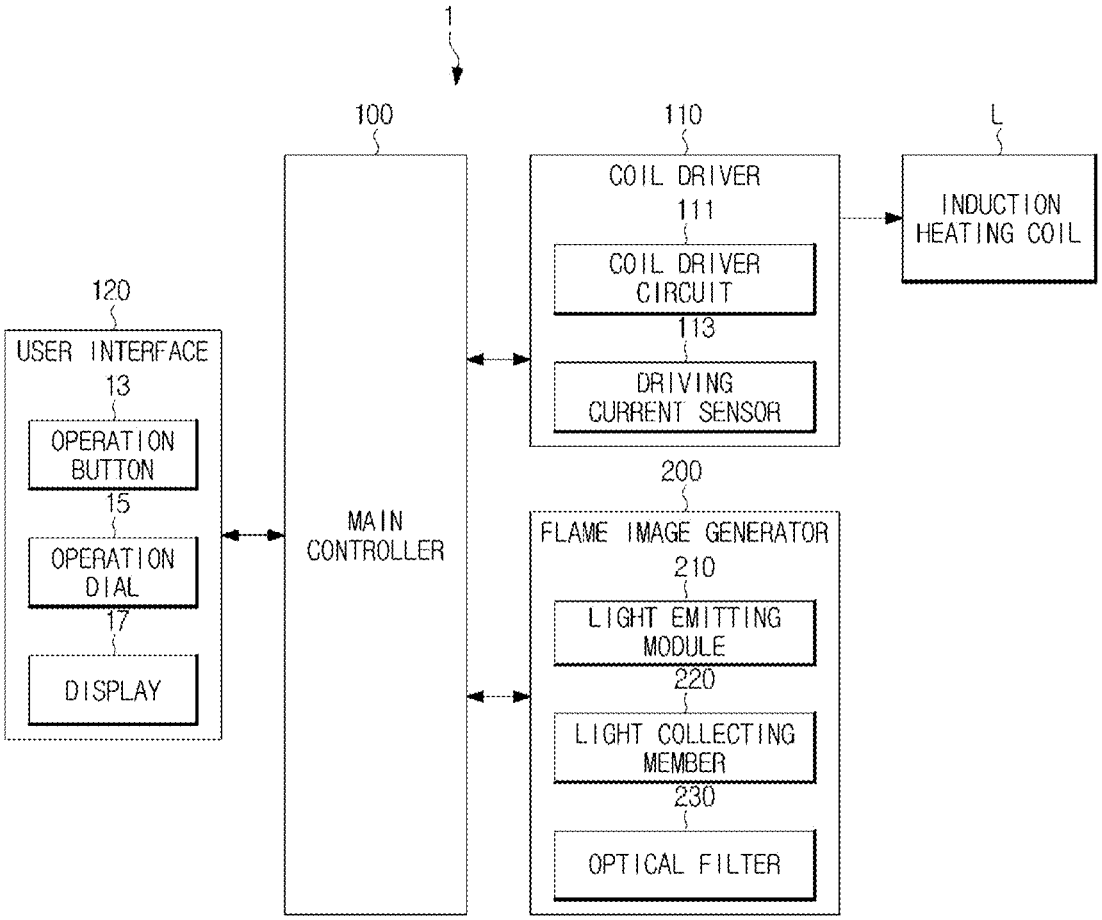
FIG. 49 is a schematic control diagram of a cooking apparatus according to another embodiment.

FIG. 46 is a view illustrating a flame image and a lens shape embodied when a light source includes three sub light sources according to various embodiments, and FIG. 47 is a view illustrating a flame image and a lens shape embodied when a light source includes two sub light sources according to various embodiments. FIG. 48 is a view illustrating a flame image and a lens shape embodied when a light source includes one sub light source according to various embodiments, and FIG. 49 is a schematic control diagram of a cooking apparatus according to another embodiment. Hereinafter, they will be described together to avoid a repetition of description.

As described above, a lens may be embodied to have only one focus or a plurality of focuses according to the number of sub light sources included in the light source D.

For example, the light source D, as shown in FIG. 46, may include first and second R light sources Dr1 and Dr2 and a B light source Db. Here, the lens may be embodied to have one focus. Otherwise, the lens 221, as shown in FIG. 46, may be embodied to have three focuses C, C1, and C2. A first focus C may enlarge blue light output from the B light source Db to be clearer. Also, a second focus C1 may enlarge red light output from the first R light source Dr1 to be clearer. A third focus C2 may enlarge red light output from the second R light source Dr2 to be clearer. Accordingly, a flame image FI, as shown in FIG. 46, may be embodied to have left and right red flames and a central blue flame clearer and enlarged.

As another example, the light source D, as shown in FIG. 47, may include an R light source Dr and a B light source Db. Here, the lens may be embodied to have one focus. Otherwise, the lens 221, as shown in FIG. 47, may be embodied to have two focuses C and C1.

A first focus C may enlarge blue light output from the B light source Db to be clearer. Also, a second focus C1 may enlarge red light output from the R light source Dr to be clearer. Accordingly, a flame image F2, as shown in FIG. 47, may be embodied to have an upper red flame and a lower blue flame of the flame image F2 clearer and enlarged.

As another example, the light source D, as shown in FIG. 48, may include only a B light source Db. Here, the lens 221 may be embodied to have one focus such that a flame image F3 may be embodied to be enlarged as shown in FIG. 48.

Meanwhile, some or all of the components of the coil driver 110 and the components of the flame image generator 200 may be included in the main controller. For example, referring to FIG. 49, the coil driving controller 115 (refer to FIG. 4) of the coil driver 110 and the light emission driving controller 215 (refer to FIG. 4) of the flame image generator 200 may be integrated to a main controller 101 (refer to FIG. 49).

Accordingly, the main controller 101 may perform integrated operations of the coil driving controller 115 and the light emission driving controller 215. In addition, it may be embodied that only some of operations of the coil driving controller 115 and the light emission driving controller 215 may be performed by the main controller 101.

Meanwhile, since the main controller 101 merely performs the above-described operations performed by the coil driving controller 115 and the light emission driving controller 215 and the operations are the same, a detailed description thereof will be omitted. Hereinafter, a flow of operations of the cooking apparatus 1 will be described.

Figure 50:
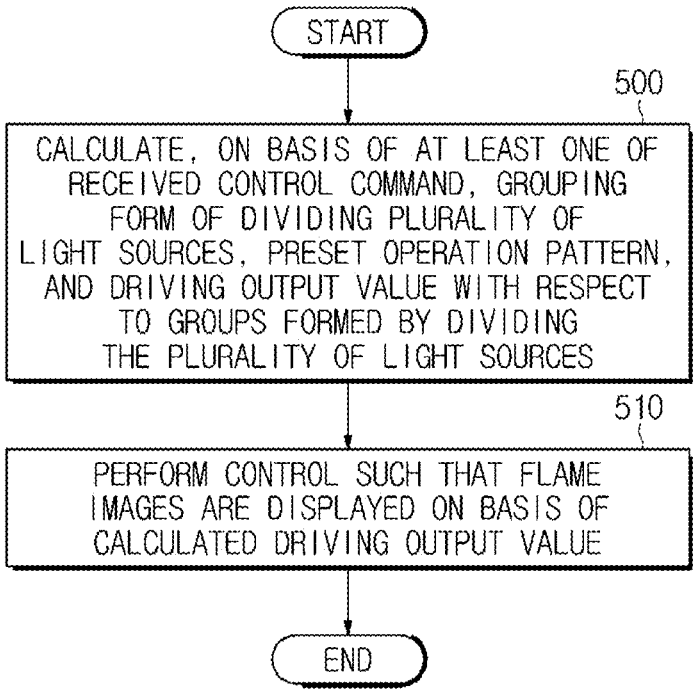
FIG. 50 is a flowchart schematically illustrating operations of the cooking apparatus that calculates a driving output value with respect to a plurality of light sources and controls flame images to be displayed according to the calculated driving output values.

FIG. 50 is a flowchart schematically illustrating the operations of the cooking apparatus that calculates a driving output value with respect to a plurality of light sources and controls flame images to be displayed according to the calculated driving output values.

The cooking apparatus may calculate a driving output value with respect to a plurality of light sources on the basis of at least one of an input control command, a grouping form of dividing a plurality of light sources, and a preset operation pattern (500). Here, the driving output value is an output value according to a driving signal and may be a voltage value or a current value. Accordingly, the cooking apparatus may control a flame image to be displayed on the basis on the calculated driving output value (510).

The cooking apparatus may control groups for representing more natural flame images according to at least one of a received control command, a grouping form of dividing a plurality of light sources, and a preset operation pattern.

When an operation initiation command is input as one example of control commands, the cooking apparatus, as a preset operation pattern, may control flame images to be displayed according to a preset sequence for a preset amount of time with respect to a particular group.

For example, the cooking apparatus may control flame images to be displayed by sequentially outputting light counterclockwise with respect to a first B light source Db1 among arranged sub light sources, which is disposed on a left side as shown in FIG. 43A. As still another example, the cooking apparatus may control flame images to be displayed by sequentially outputting light according to two ways with respect to sixth and seventh B light sources Db6 and Db7 among arranged sub light sources, which are arranged in a center as shown in FIG. 44A.

When an operation stop command is input as one example of control commands, the cooking apparatus, as a preset operation pattern, may stop applying a driving current in order to allow all flame images to disappear at the same time. Otherwise, the cooking apparatus, as a preset operation pattern, may control flame images to more naturally disappear by sequentially stopping applying a driving current through group controlling.

When a command for adjusting an output level is input as one example of control commands, the cooking apparatus, as a preset operation pattern, may apply adjusted driving currents to all the groups at the same time in order to adjust sizes and colors of all flame images at the same time. Otherwise, the cooking apparatus, as a preset operation pattern, may adjust sizes and colors of flame images to be more natural by sequentially applying an adjusted driving current for each group. Also, when an output level input by a user is a preset output level or below, the cooking apparatus, as a preset operation pattern, may represent more realistic flame images by stopping applying a driving current to a preset group.

For example, the cooking apparatus, as one example of grouping form, may determine a phase difference and the like between driving signals according to the number of groups. Otherwise, the cooking apparatus may determine an order of applying of driving signals, a phase difference or time difference between driving signals applied to the groups, or the like according to a distance between sub light sources included in the group, and there is no limitation.

Also, the cooking apparatus may determine whether a malfunction occurs during operation and may perform a corresponding measure process on the basis of a determination result. Here, the malfunction that occurs during operation includes a malfunction that occurs in the cooking apparatus itself. Additionally, the malfunction that occurs during operation includes a malfunction that occurs due to a mistake of the user, for example, a case in which a malfunction occurs since the user disposes a cooking container on a cooking plate, which is not available to be heated using an induction heating coil.

When it is determined that a malfunction occurs during operation, the cooking apparatus, as one example of a preset operation pattern, may process a corresponding measure process. For example, the cooking apparatus may control some or all of a plurality of light sources to output red light. Otherwise, the cooking apparatus may control applying driving currents to allow some or all of the plurality of light sources to flicker or control applying driving currents to allow light output through the plurality of light sources to flicker.

The above-described preset operation patterns may be preset according to a grouping form, for example, which sub light sources are included in a group, the number of sub light sources, and positions of sub light sources included in the group, an interval between sub light sources included in the group, and the like. Also, the above-described preset operation pattern may be set according to a corresponding measure process performed when it is determined that a malfunction occurs. A method of controlling a light emitting module according to a preset operation pattern may be embodied as data in the form of an algorithm and a program, may be stored in a memory of a cooking apparatus, and may be updated.

The embodiments disclosed in the specification and the components shown in the drawings are merely preferable examples of the present disclosure and various modifications capable of replacing the embodiments and drawings of the specification may be made at the time of filing the present application.

Also, the terms used herein are intended to explain the embodiments but are not intended to limit and/or define the present disclosure. Singular forms, unless defined otherwise in context, include plural forms. Throughout the specification, the terms "comprise", "have", and the like are used herein to specify the presence of stated features, numbers, steps, operations, elements, components or combinations thereof but do not preclude the presence or addition of one or more other features, numbers, steps, operations, elements, components, or combinations thereof.

Also, even though the terms including ordinals such as "first," "second," and the like may be used for describing various components, the components will not be limited by the terms and the terms are used only for distinguishing one element from others. For example, without departing from the scope of the present disclosure, a first component may be referred to as a second component, and similarly, the second component may be referred to as the first component. The term "and/or" includes any and all combinations or one of a plurality of associated listed items.

Also, the terms "a portion", "a device", "a block", "a member", "a module" and the like used herein may refer to a unit that performs or processes at least one function or operation. For example, they may refer to software and hardware such as a field-programmable gate array (FPGA) and an application-specific integrated circuit (ASIC). However, the terms "portion," "device," "block," "member", "module," and the like are not limited to the software or hardware and may be components stored in an accessible storage medium and executed by one or more processors.

One aspect of the present disclosure provides a cooking apparatus that displays a more natural flame image.

Another aspect of the present disclosure provides a cooking apparatus capable of reducing costs and the cooking apparatus with a lower complexity level by group-controlling a plurality of light sources.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A cooking apparatus comprising:

a plurality of light sources configured to emit light toward a cooking container and grouped into a plurality of groups; and a light emission driving controller configured to:

perform control in a manner that flame images are displayed by performing group controlling based on at least one of a control command input by a user, a grouping form of the plurality of groups, and a preset operation pattern, wherein the plurality of groups comprises a first group comprising first light sources and a second group comprising second light sources, and wherein the light emission driving controller is configured to:

generate a first driving signal applied to the first group based on a first periodic signal, generate a second driving signal applied to the second group based on a second periodic signal, and set a phase difference between the first periodic signal and the second periodic signal according to the grouping form of the plurality of groups.

2. The cooking apparatus of claim 1, wherein each of the plurality of light sources comprises at least one of a sub light source that outputs blue light and a sub light source that outputs red light.

3. The cooking apparatus of claim 1, wherein each of the plurality of light sources comprises one or more sub light sources, and wherein the one or more sub light sources are connected to the light emission driving controller through one input end.

4. The cooking apparatus of claim 1, wherein, when an operation stop command is input by the user, the light emission driving controller is further configured to:

stop applying a driving signal with respect to at least one group preset among the plurality of groups, and sequentially stop applying the driving signal in a preset direction.

5. The cooking apparatus of claim 1, wherein, when a command for adjusting an output level is input by the user, the light emission driving controller is further configured to:

simultaneously apply driving signals, which are adjusted corresponding to a received command for adjusting the output level, to the plurality of groups, or sequentially apply the adjusted driving signals according to a preset sequence.

6. The cooking apparatus of claim 1, wherein, when an output level input by the user is a preset output level or below, the light emission driving controller is further configured to stop applying a driving signal with respect to at least one of the plurality of groups.

7. The cooking apparatus of claim 1, wherein, when an output level input by the user is a preset output level or below, the light emission driving controller is further configured to:

stop applying a driving signal with respect to any one of the plurality of groups, and apply a driving signal adjusted corresponding to a received output level with respect to another group.

8. The cooking apparatus of claim 1, further comprising a lens configured to concentrate the light emitted from each of the plurality of light sources, wherein a number of focuses provided on the lens is previously designed corresponding to a number of sub light sources included in each of the light sources.

9. The cooking apparatus of claim 1, wherein, when a malfunction occurs during operation, the light emission driving controller is further configured to:

stop applying a driving signal to at least one group of the plurality of groups, or control an application of the driving signal to allow the at least one group to output red light.

10. A method of controlling a cooking apparatus, comprising:

calculating a driving output value with respect to a plurality of light sources based on at least one of a control command input by a user, a grouping form of a plurality of groups, into which the plurality of light sources are divided, and a preset operation pattern; and performing control in a manner that a flame image is displayed based on the calculated driving output value;

wherein the plurality of groups comprises a first group comprising first light sources and a second group comprising second light sources, and wherein the calculating comprises:

generating a first driving signal applied to the first group based on a first periodic signal, generating a second driving signal applied to the second group based on a second periodic signal, and setting a phase difference between the first periodic signal and the second periodic signal according to the grouping form of the plurality of groups.

11. The method of claim 10, wherein:

each of the plurality of light sources comprises one or more sub light sources, and the one or more sub light sources are connected in series through one line.

12. The method of claim 10, wherein the performing control, when an operation stop command is input by the user, comprises:

performing control in a manner that application of a driving signal with respect to at least one group preset among the plurality of groups is stopped, and performing control in a manner that the application of the driving signal is sequentially stopped in a preset direction.

13. The method of claim 10, wherein, the performing control comprises, when a command for adjusting an output level is input by the user, performing control in a manner that driving signals, which are adjusted corresponding to a received command for adjusting the output level, are simultaneously applied to the plurality of groups, or the adjusted driving signals are sequentially applied according to a preset sequence.

14. The method of claim 10, wherein, the performing control comprises, when an output level input by the user is a preset output level or below, performing control in a manner that application of a driving signal with respect to at least one of the plurality of groups is stopped.

15. The method of claim 10, wherein, the performing control comprises, when an output level input by the user is a preset output level or below, performing control in a manner that an application of a driving signal with respect to any one of the plurality of groups is stopped and a driving signal adjusted corresponding to a received output level is applied to another group.

16. The method of claim 10, wherein, the performing control comprises, when a malfunction occurs during operation, performing control in a manner that an application of a driving signal to at least one of the plurality of groups is stopped or controlling the application of the driving signal to allow at least one group to output red light.

17. The method of claim 10, wherein, the generating the first driving signal comprises synthesize the first periodic signal and a random signal, and the generating the second driving signal comprises synthesize the second periodic signal and the random signal.

18. The method of claim 10, wherein the performing control, when an operation initiation command is input by the user, comprises:

performing control in a manner that the flame image is displayed by applying a driving signal with respect to at least one group preset among the plurality of groups, and sequentially applying the driving signal in a preset direction.

19. The cooking apparatus of claim 1, wherein the light emission driving controller is configured to generate the first driving signal by synthesizing the first periodic signal and a random signal, and generate the second driving signal by synthesizing the second periodic signal and the random signal.

20. The cooking apparatus of claim 1, wherein, when an operation initiation command is input by the user, the light emission driving controller is further configured to:

perform control in a manner that a flame image is displayed by applying a driving signal with respect to at least one group preset among the plurality of groups, and sequentially apply the driving signal in a preset direction.

* * * * *